United States Patent [19]

Stapp et al.

[11] 4,144,694

[45] Mar. 20, 1979

[54] MACHINE FOR PACKING FLAT ARTICLES IN A CASE

[75] Inventors: Willis J. Stapp, Miami Township, Clermont County; Quentin E. Honnert, Cincinnati, both of Ohio

[73] Assignee: Multifold-International, Inc., Milford, Ohio

[21] Appl. No.: 841,193

[22] Filed: Oct. 11, 1977

Related U.S. Application Data

[62] Division of Ser. No. 714,562, Aug. 16, 1976, Pat. No. 4,064,675.

[51] Int. Cl.[2] ..... B65B 5/10; B65B 7/26; B65B 57/10

[52] U.S. Cl. ..... 53/52; 53/535; 53/245; 53/250; 53/374; 53/382

[58] Field of Search ..... 53/52, 59 R, 74, 162, 53/244, 245, 249, 250, 374, 382

[56] References Cited

U.S. PATENT DOCUMENTS

| | | | |
|---|---|---|---|
| 3,011,298 | 12/1961 | Protor | 53/374 |
| 3,102,374 | 9/1963 | Lloyd et al. | 53/162 X |
| 3,645,067 | 2/1972 | Siegel | 53/374 X |

*Primary Examiner*—Robert Louis Spruill
*Attorney, Agent, or Firm*—James W. Pearce; Roy F. Schaeperklaus

[57] ABSTRACT

A machine for packing flat articles in a case which includes a case elevator on which a case is supported with an open side of the case sloping and exposed. Flat articles are directed into the case transversely of the open side to form a stack inside the case. A tongue engages the stack as the stack increases in size. The tongue controls means for lowering the case as the articles are projected into the case so that the level of the upper end of the stack remains substantially constant. The tongue is withdrawn when the stack has reached a predetermined size. A hold down and pusher member is advanced into engagement with an upper portion of the stack when the stack has reached the predetermined size to hold the articles of the stack in the case as the tongue is being withdrawn. The case is transferred to a tipover frame which swings the case upwardly against a flap folding belt. As the case is transferred, flaps are closed.

9 Claims, 43 Drawing Figures

FIG. 24
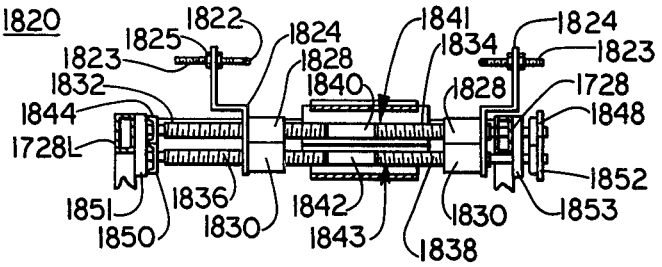
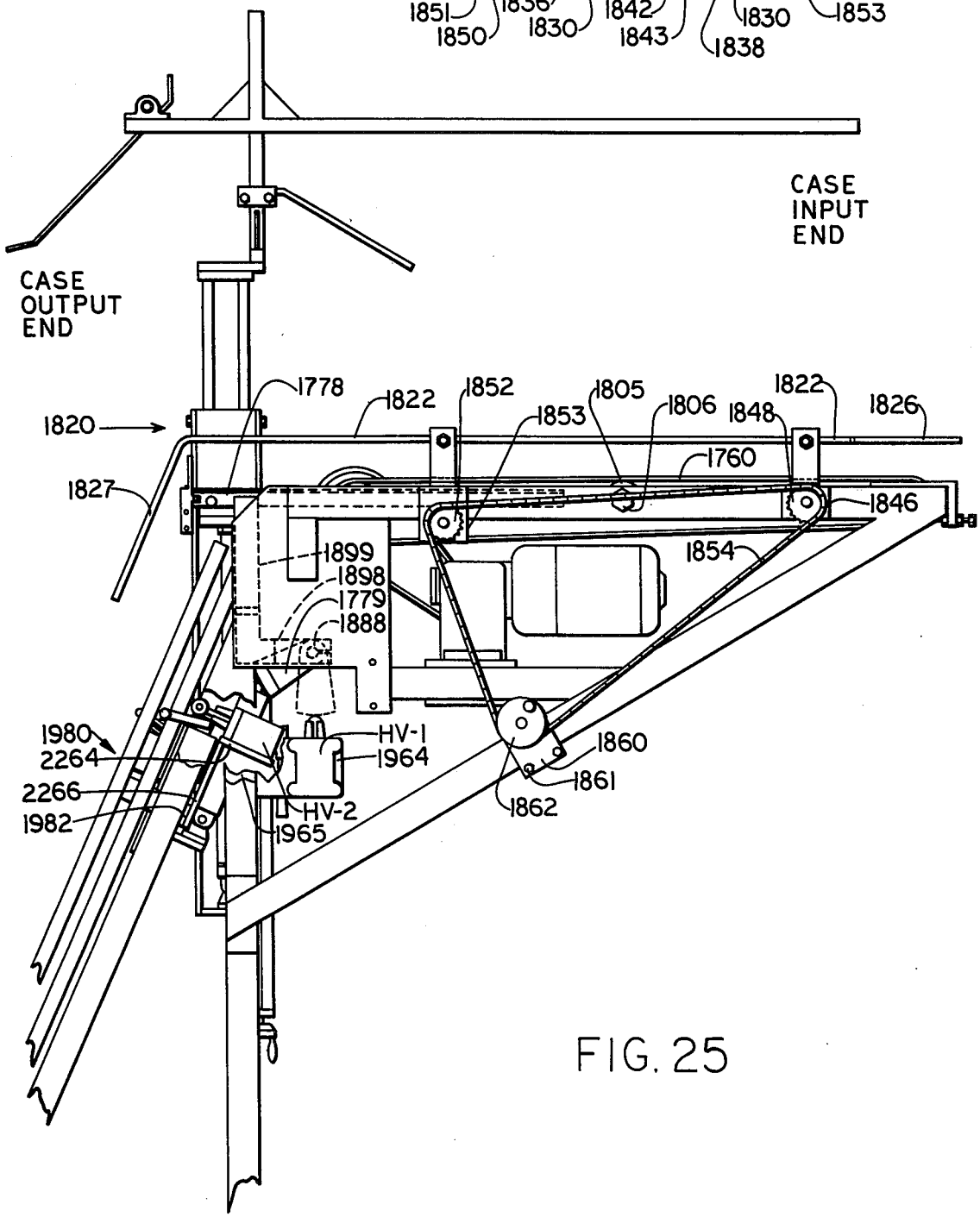
FIG. 25

FIG. 30
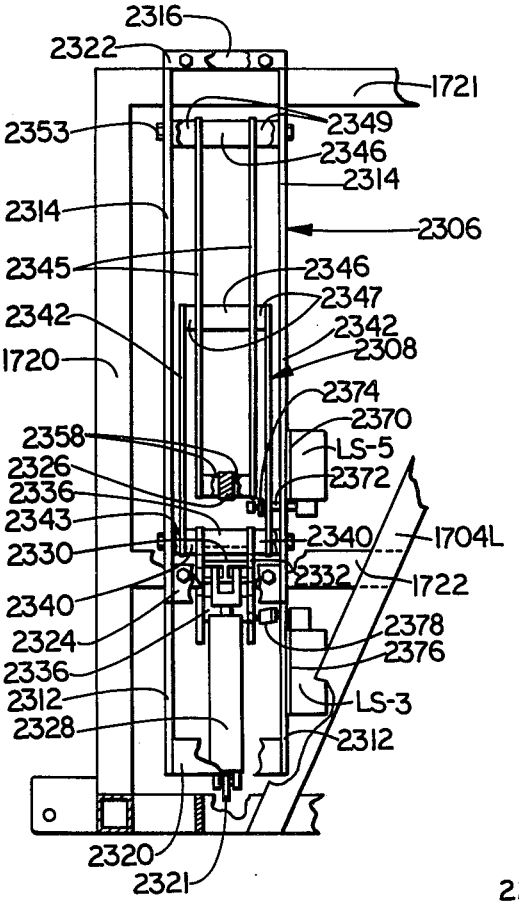
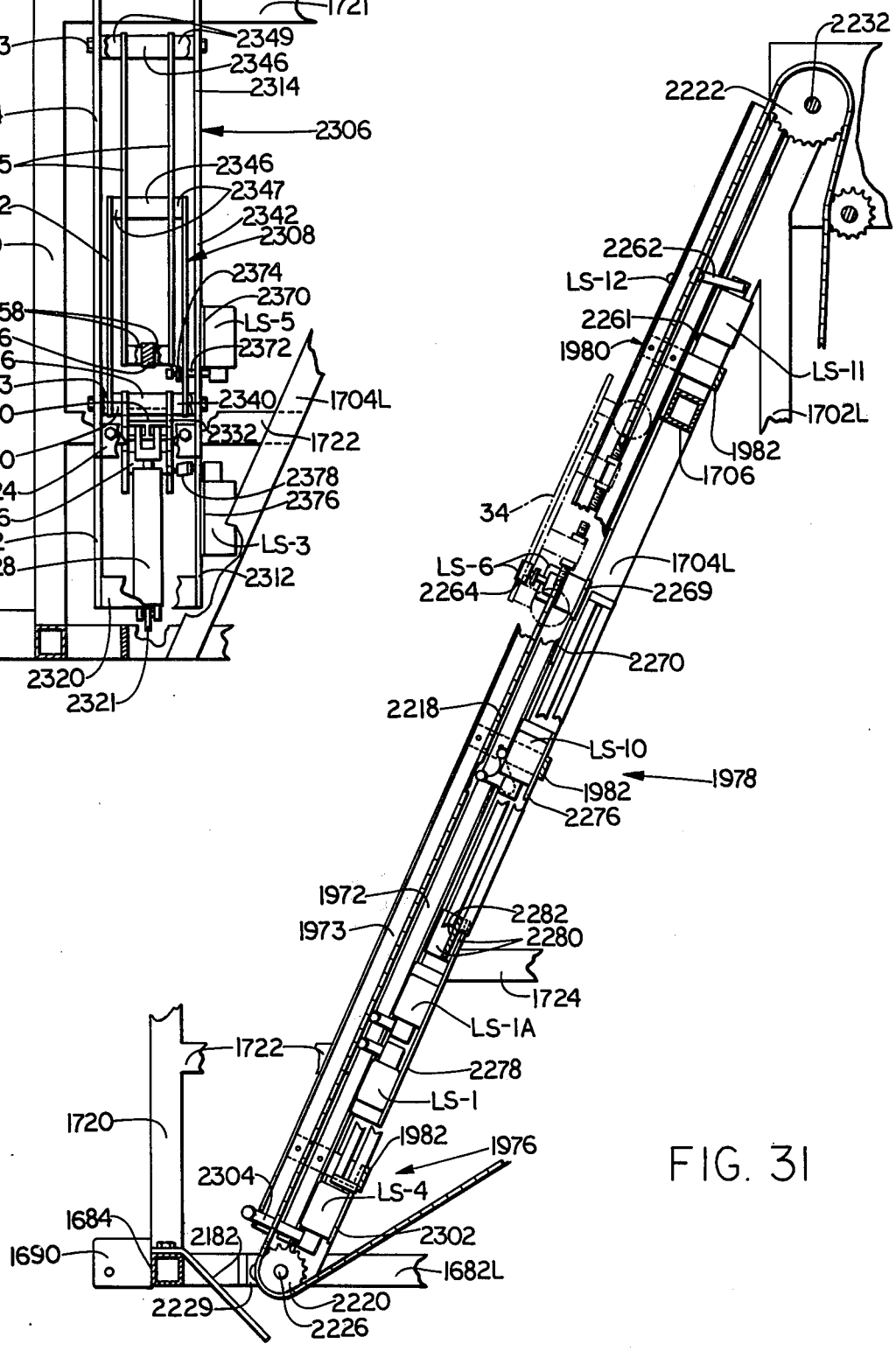
FIG. 31

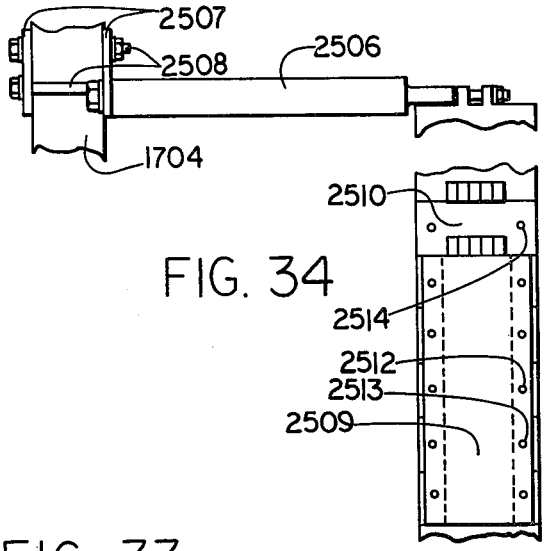
FIG. 34
FIG. 33
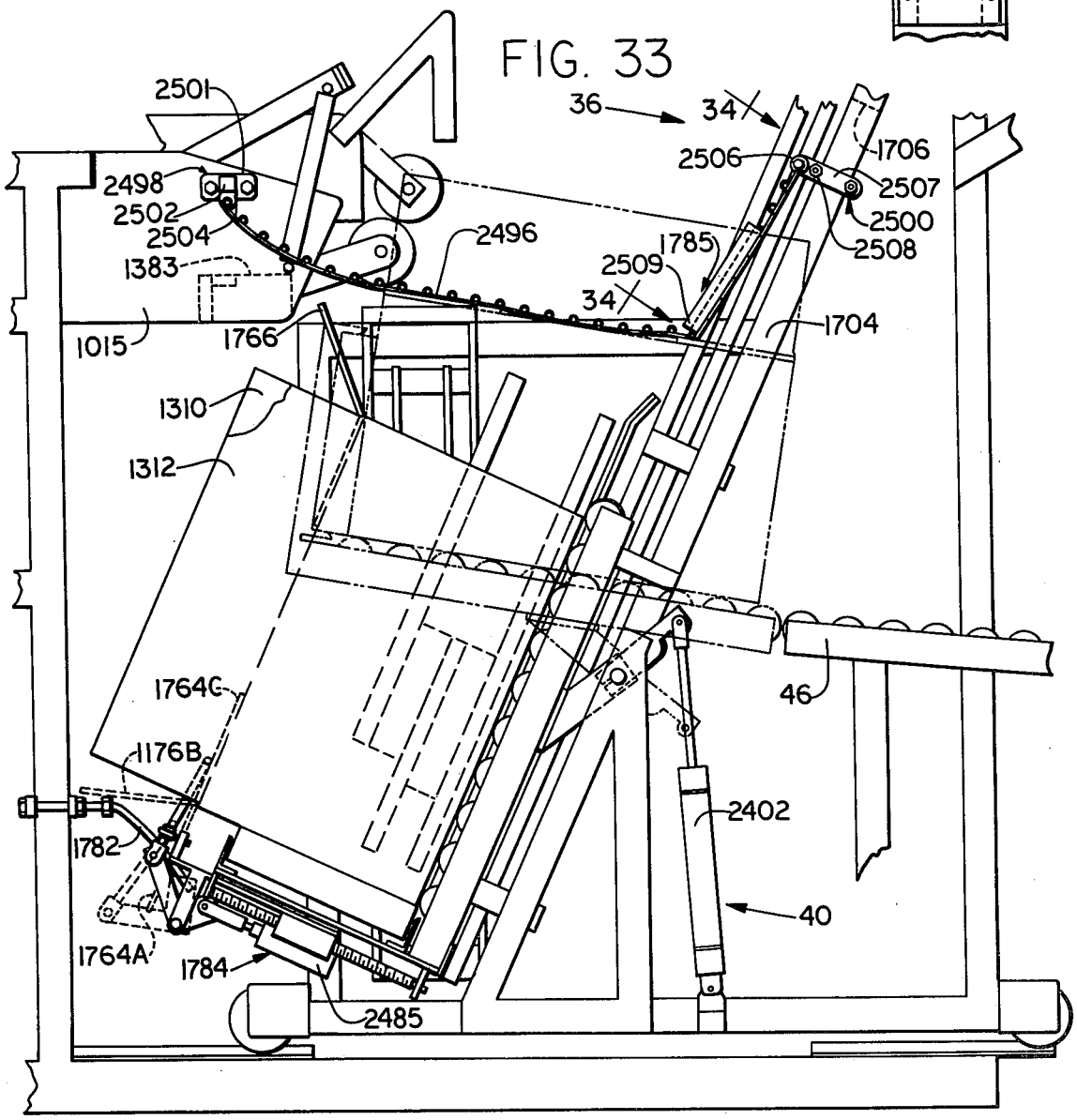

MACHINE FOR PACKING FLAT ARTICLES IN A CASE

This is a division of our copending application Ser. No. 714,562 filed Aug. 16, 1976, now U.S. Pat. No. 4,064,675 issued Dec. 27, 1977.

This invention relates to a machine for checking or testing folding cartons of the type used for supporting bottles and the like and for freeing portions of the carton which may be held together inadvertently by misplaced specks or splatter of glue, and then packing the cartons in a case.

An object of this invention is to provide such a machine which, after inspection, feeds the cartons in a stream directly into a case.

A further object of this invention is to provide such a machine in which the height of a stack of cartons forming inside the case is measured as the cartons are being introduced into the case so that the delivery of cartons to the case can be stopped when the case has been filled and so that the case can be replaced by another case.

A further object of this invention is to provide such a machine in which the cartons pass through the carton opening and inspection station in a steady stream, but in which the flow of cartons to the case is interrupted when the case must be removed for replacement by another case.

Briefly, this invention provides a machine which receives folding cartons from a gluing machine and in which the cartons form an input stack as they are received from the gluing machine. The lowermost carton on the stack is advanced sidewise and also endwise a small amount to separate the lowermost carton from the next higher carton in the input stack. A conveyor then picks up the lowermost carton and advances the carton to a carton opening and inspection station. At this station, vacuum cups engage upper and lower faces of the folding carton and draw the upper and lower faces apart to cause partial opening of the carton. Any small glue specks which might set and cure to prevent opening of the carton are broken in this carton opening operation. While the carton is partially open, the carton passes an inspection position at which a light beam is directed into the carton to demonstrate that the carton has properly opened. The carton passes from the carton opening and inspection station to a surge hopper from which cartons are fed in a shingle stream formation to a loading station at which a case is supported in position to receive the stream of cartons. A carton hold down and metering arm overlies the cartons as the cartons build up in the case, and the case is lowered under control of mechanism actuated by the hold down and metering arm until the case has been filled. When the case has been lowered to a position at which the case is filled, the flow of cartons to the case is halted as the case is removed and a new case is introduced into position for receiving cartons. The new case is automatically introduced when the first case is removed. However, the flow of cartons through the carton opening and inspection station continues unhalted and cartons build up in the surge hopper. The case introducing apparatus holds the new case open as the hold down and metering arm is inserted into the new case and the case filling operation is started again.

The above and other objects and features of the invention will be apparent to those skilled in the art to which this invention pertains from the following detailed description and the drawings, in which:

FIG. 24 is a view in section taken on the line 24—24 in FIG. 26;

FIG. 25 is a side elevational view of the case input section taken in the direction of the arrows 25—25 in FIG. 22;

FIG. 30 is a view in section showing the case pushoff assembly taken on the line 30—30 in FIG. 29, a pusher plate being omitted;

FIG. 31 is a sectional view of the packing elevator taken on the line 31—31 in FIG. 29, parts being cut away to further expose pertinent machinery and limit switches;

FIG. 33 is a schematic view in side elevation that depicts the inter-relationship between the packing assembly, case pushoff assembly, an output tipover assembly, a flap closing belt and the customer output conveyor;

FIG. 34 is a fragmentary view looking in the direction of the arrows 34—34 in FIG. 33;

FIG. 41 is a schematic view of major electrical connections of the machine.

In the following detailed description and the drawings, like reference characters indicate like parts.

INTRODUCTION

Figure 1:
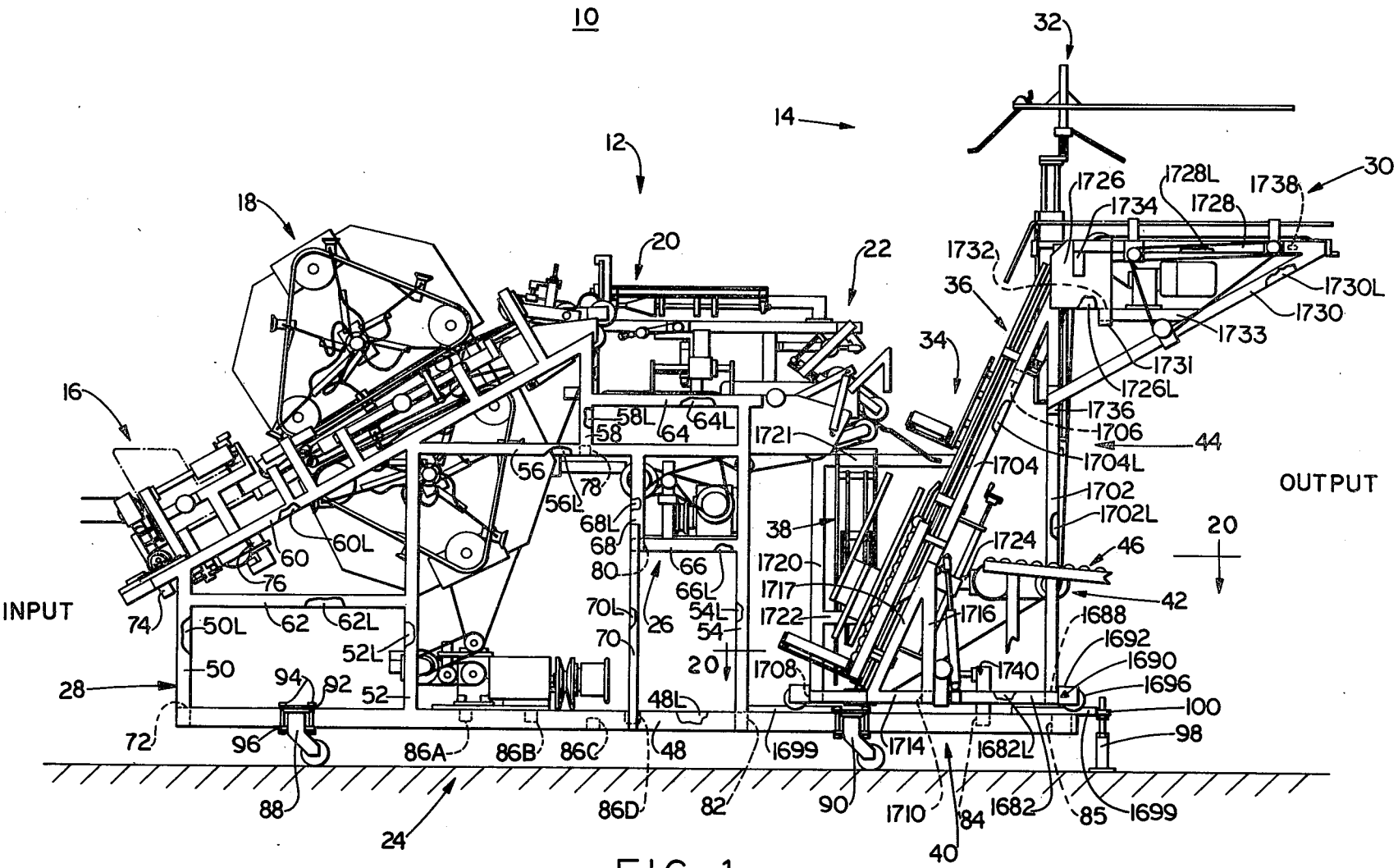
FIG. 1 is a somewhat schematic side elevational view of a bottle carrier checker/packer machine constructed in accordance with an embodiment of this invention showing the major structure of the machine and the relative placement of subassemblies thereupon.

FIG. 1 shows a bottle carrier checker/packer machine 10 which is constructed in accordance with an embodiment of this invention.

The bottle carrier checker/packer machine 10 is comprised of two major sections; a bottle carrier handling assembly 12 and a case handling assembly 14. The bottle carrier handling assembly 12 is further comprised of an input hopper 16, a carrier inspection section 18, a surge hopper 20, a carrier packing assembly 22, an inspection and input section drive assembly 24, a surge and pack section drive assembly 26 and a carrier section frame assembly 28. The case handling assembly 14 is further comprised of a case input conveyor 30, an input tipover assembly 32, a packing elevator 34, an elevator incline 36, a case pushoff assembly 38, an output tipover assembly 40, a case handling system drive assembly 42 and a case section frame assembly 44.

A definition of logistical terms is now in order. The reader, in viewing FIG. 1, is looking at the right side of the bottle carrier checker/packer machine 10. This is also known as the operator side. The left side of the machine is known as the reject side. This convention of left and right sides will be maintained for both the bottle carrier handling assembly 12 and the case handling assembly 14.

The left extremity of FIG. 1 is the carrier input end. The longitudinal direction is in general parallel to the direction of bottle carrier flow. The lateral direction is transverse to the longitudinal direction. The lateral and longitudinal conventions will apply to the entire bottle carrier checker/packer machine 10.

The bottle carriers travel from the left to the right of the figure. The output end of the bottle carrier handling assembly 12 is at the right hand extremity of the carrier packing assembly 22. Conversely, the input end of the case handling assembly 14 is located at the extreme upper right of FIG. 1. Corrugated cases (one of which is shown at 1288 in FIG. 44) are entered onto the case input conveyor 30 (FIG. 1) either manually, or by customer conveyor, and the cases travel temporarily from right to left of the figure, then in general, vertically downward by means of the packing elevator 34. The cases reverse directions by means of the output tipover assembly 40, exiting the case handling assembly 14 travelling from left to right on a customer output conveyor 46. Except for the case input conveyor 30 and the input tipover assembly 32 of the case handling assembly 14, the input side of any part is that side whih faces the input end of the bottle carrier handling assembly 12, while the output side of any part is that side which faces the customer output conveyor 46. With respect to the case input conveyor 30 and the input tipover assembly 32, the input side of any part is that side which faces an oncoming case, while the output side of any part is that side which faces the bottle carrier handling assembly 12.

The carrier section frame assembly 28 is comprised of a pair of bottom stringers 48 and 48L. The stringers 48 and 48L run the full length of the bottle carrier handling assembly 12 and the case handling assembly 14. A pair of short input posts 50 and 50L is rigidly affixed in a vertical disposition to the carrier input ends of the pair of bottom stringers 48 and 48L. Following from left to right of FIG. 1, the carrier section frame assembly 28 also comprises a pair of long input posts 52 and 52L and a pair of output posts 54 and 54L. A pair of short stringers 56 and 56L is fixedly attached in a horizontal disposition from the top end of the pair of long input posts 52 and 52L to the input face of and near the top of the pair of output posts 54 and 54L. A pair of short output posts 58 and 58L is rigidly affixed in a vertical disposition to the center of the span of the pair of short stringers 56 and 56L. A pair of inclined stringers 60 and 60L is rigidly affixed across the top of the pair of short input posts 50 and 50L, the pair of long input posts 52 and 52L and the pair of short output posts 58 and 58L, as shown in FIG. 1. A pair of longitudinal input stiffeners 62 and 62L is rigidly affixed between the pair of short input posts 50 and 50L and the pair of long input posts 52 and 52L. Rigidly affixed to the output face of the pair of short output posts 58 and 58L and across the top of the pair of output posts 54 and 54L is a pair of top longitudinal stringers 64 and 64L. The surge and pack section drive assembly 26 is fixedly mounted upon a pair of short mounting members 66 and 66L that is suspended in horizontal disposition from the bottom ends of a pair of short vertical hangers 68 and 68L and the input face of the pair of output posts 54 and 54L. A pair of vertical support members 70 and 70L is fixedly attached to the outboard surfaces of, the lower extremity of the pair of short vertical hangers 68 and 68L, and the pair of bottom stringers 48 and 48L.

The right and left hand sides of the carrier section frame assembly 28 are held in spaced lateral and parallel relation with each other by means of an input lateral stiffener 72, an input incline lateral stiffener 74, a second incline lateral stiffener 76, an inspection output lateral stiffener 78, a drive assembly lateral stiffener 80, a carrier output lateral stiffener 82, a case lateral stiffener 84 and a case output lateral stiffener 85. Secondary lateral stiffeners 86A, 86B, 86C and 86D are provided to also function as support members for the inspection and input section drive assembly 24 as well as providing lateral stability to the carrier section frame assembly 28.

The carrier section frame assembly 28 is supported and made movable by a pair of input casters 88 and a pair of output casters 90 that are fixedly attached to a set of four caster mounting plates 92. The set of four caster mounting plates 92 support the pairs of input and output casters 88 and 90, respectively, in a cantilever manner on the outboard sides of the carrier section frame assembly 28. Each mounting plate of the set of four caster mounting plates 92 is fixedly clamped about its respective bottom stringer 48 and 48L by means of a set of four bolts and nuts 94 and a bottom retainer plate 96. The manner of attachment permits the longitudinal repositioning of the pairs of input and output casters 88 and 90 respectively, if necessary. Upon installation, the bottle carrier checker/packer machine 10 is aligned and positioned with respect to customer related machinery by means of the pairs of input and output casters 88 and 90 and then locked into fixed position by means of a jack screw 98. The jack screw 98 is threadably mounted in a jack plate 100 that is in turn rigidly affixed to the top and center of the case output lateral stiffener 85 in cantilever manner as shown at the case output end of FIG. 1.

CARRIER PACKING ASSEMBLY

Figure 2:
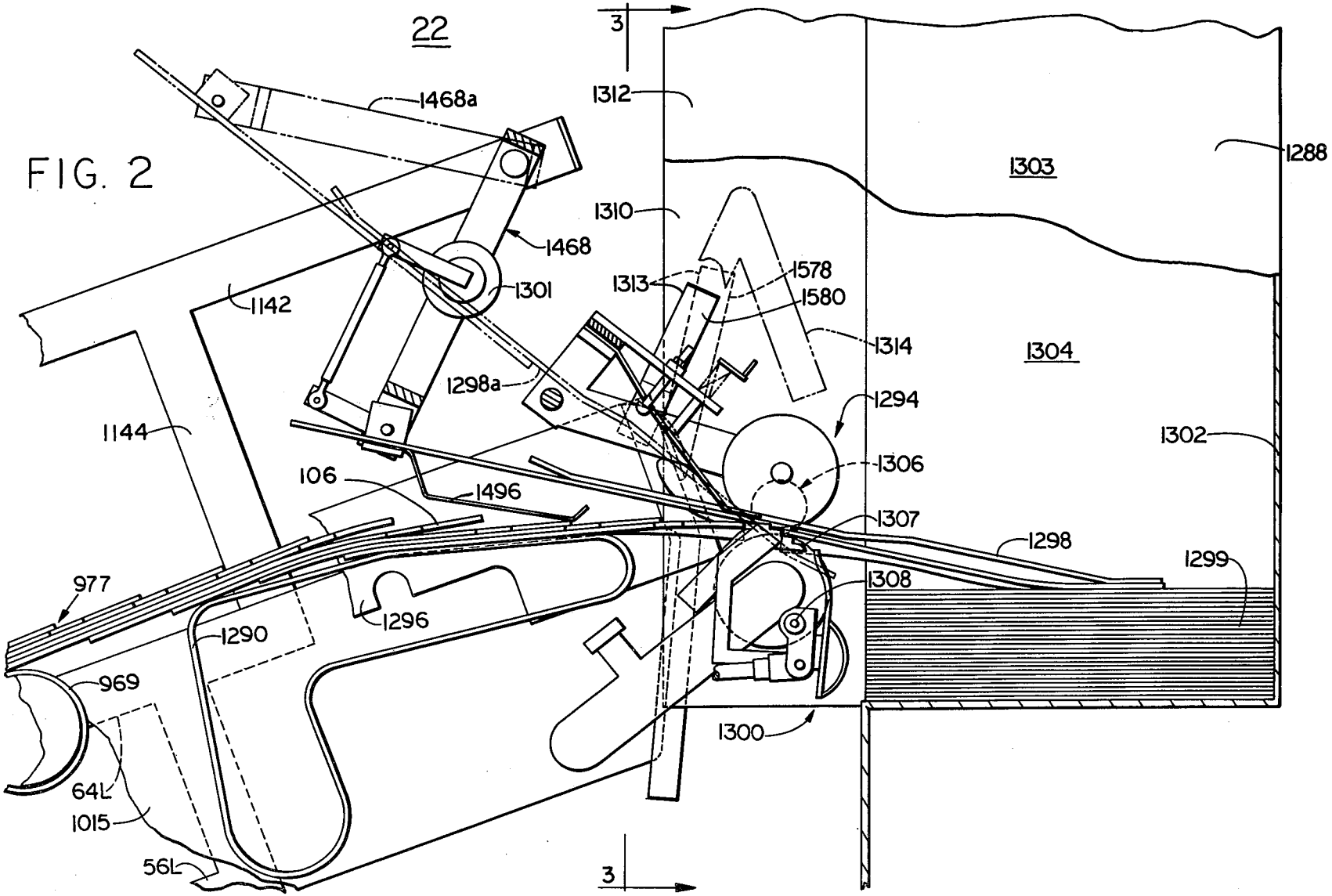
FIG. 2 is a schematic view in side elevation of a bottle carrier packing assembly of the bottle carrier checker/-packer machine.

After inspection and acceptance, bottle carriers 106 are delivered into the surge hopper 20, which is the first step in the packing process. The input of bottle carriers 106 to the surge hopper 20 is substantially steady and continuous, whereas the surge hopper output stream of carriers 977 is intermittent, but high output. The bottle carriers 106 are injected at this high speed into a case 1288 of corrugated fiberboard construction, as shown in FIG. 2. As one case 1288 is filled, a finite amount of time is necessary to remove the case 1288 and insert another one, at which time there is no flow of bottle carriers 106 from the surge hopper 20. The purpose then of the surge hopper 20 is to provide a variable reservoir of bottle carriers 106 to permit substantially continuous flow of bottle carriers through the inspection section 18 while supplying the carrier packing assembly 22 with an intermittent and high speed stream. During the high speed packing phase, the stack of carriers 973 of the surge hopper 20 will diminish, and then rebuild while the full case 1288 is being removed and an empty one inserted.

The surge hopper output stream of carriers 977 in shingle formation (FIG. 2) enters the carrier packing assembly 22 upon a packing belt 1290 as can be seen in FIG. 2. The packing belt 1290 moves in a clockwise cycle, transporting the shingled stream of bottle carriers toward a nip wheel assembly 1294. It can be seen in FIGS. 3 and 6 that the shingled stream of bottle carriers is held in lateral alignment by a right hand carrier guide 1295 and a left hand carrier guide 1296. As the shingled stream of bottle carriers passes through the nip wheel assembly 1294, it is forcefully inserted into the case 1288. The peripheral speed of the wheels of the nip wheel assembly 1294 is slightly higher than the surface speed of a packing belt 1290, but not high enough to unshingle the shingled stream of bottle carriers 1299. The bottle carriers 106 are not permitted to slow down in a manner to increase their shingle to prevent binding between cartons. The additional velocity derived from the nip wheel assembly 1294 helps the individual bottle carriers 106 to overcome the frictional effects being applied by a hold down tongue 1298 (FIGS. 2 and 3) and possible contact with either side of the case 1288. As a case stack of carriers 1299 increases within the case 1288, three operations are performed on the stack to insure a successful pack.

First, a pack patter 1300 (FIG. 2) continuously nudges the individual bottle carriers of the case stack of carriers 1299 into physical contact with a case bottom 1302 of the case 1288.

Figure 3:
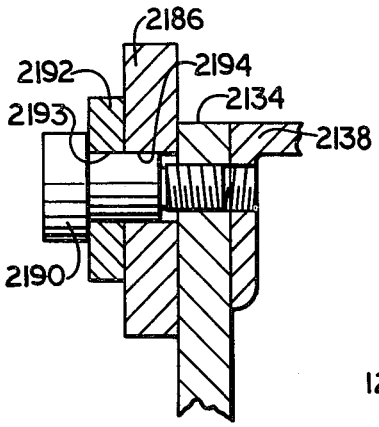
FIG. 3 is an end elevational view of a corrugated case during the packing operation looking in the direction of arrows 3—3 in FIG. 2, portions of a packing elevator utilized in transporting the corrugated case past the packing assembly being shown in association therewith.

Secondly, as the case stack of carriers 1299 increases, it tends to fall over due to a differential thickness between the bottle carrier handle 108 and the carrier bottom 112 which is thinner. This effect is indicated in FIG. 3 by the partial stack of carriers shown in double dot and dash lines. The case stack of carriers 1299 will not fall over per se, since the cases are laterally restrained within a case right side 1303 and a case left side 1304 of the case 1288. Nevertheless, the case stack of carriers 1299 will rise unevenly, causing the bottle carrier handle 108 side to be considerably higher than the carrier bottom 112. Eventually this unevenness would become so extreme that the top bottle carrier 106 of the case stack of carriers 1299 would slide off the stack and down between the stack and the case left side 1304. Other carriers would follow, resulting in lateral deformation of the case left side 1304 and failure of the pack cycle. To prevent this, the hold down tongue 1298 exerts a vertically downward pressure upon the bottle carrier handle 108 of the case stack of carriers 1299. The hold down tongue 1298 is a dual function device, also incorporating a microtorque or modulating valve 1301 (FIG. 2) that controls the rate of descent of the case 1288, thus keeping the top of the case stack of carriers 1299 in line with the nip wheel assembly 1294. The carrier bottom 112 of each bottle carrier 106 is bent downwardly by a carrier bottom bender 1306 that in its cumulative effect tends to compensate for the unevenness caused by the differential thickness previously described. The carrier bottom bender 1306 is mounted upon the left hand surface of the nip wheel assembly 1294 and will be discussed in greater detail hereinafter.

And thirdly, as the microtorque valve 1301 indexes the case 1288 downward, a count switch 1309 (FIGS. 7, 8 and 9) counts the cartons and a circuit controlled thereby, to be described hereinafter, is preset to determine the exact number of bottle carriers 106 that will fit in the case 1288. The last two or three bottle carriers 106 entering a particular case 1288 (FIG. 2) come under additional friction when entering the case 1288 and consequently can remain extended therefrom due to the tight fit. A nudger assembly 1307, a stepped pusher, is cycled once, pivoting about a nudger pivot 1308 that swings the assembly forwardly and downwardly. In so doing the nudger assembly 1307 catches the trailing edges 117 of the extended bottle carriers 106 on successive steps of the nudger to forcefully push them into the case 1288 in a flush alignment with the rest of the case stack of carriers 1299, thus completing a successful pack.

Figure 6:
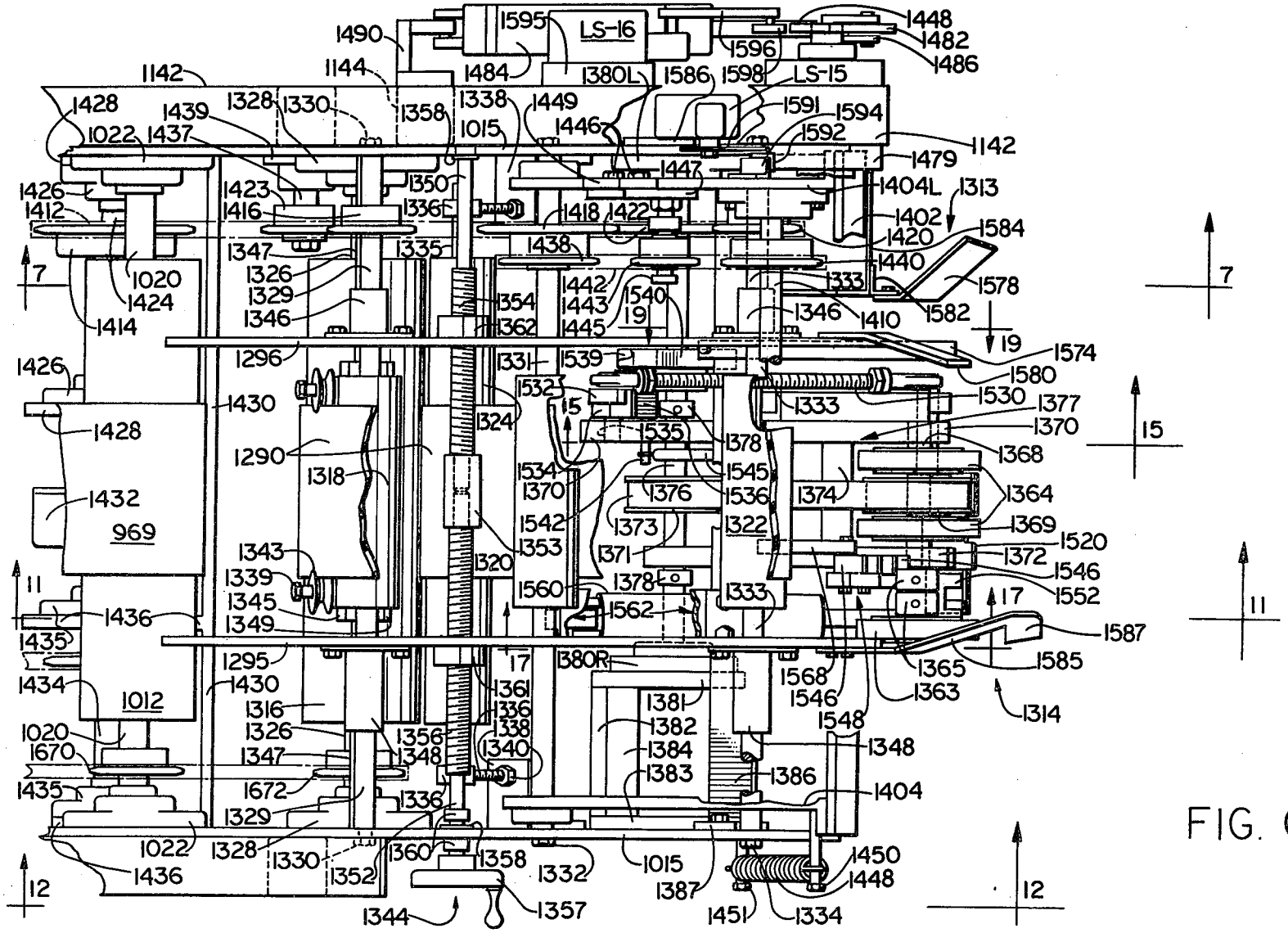
FIG. 6 is a plan view of the packing assembly shown in schematic form in FIG. 2, parts being cut away to expose assemblies in the lower portion of the assembly.
Figure 7:
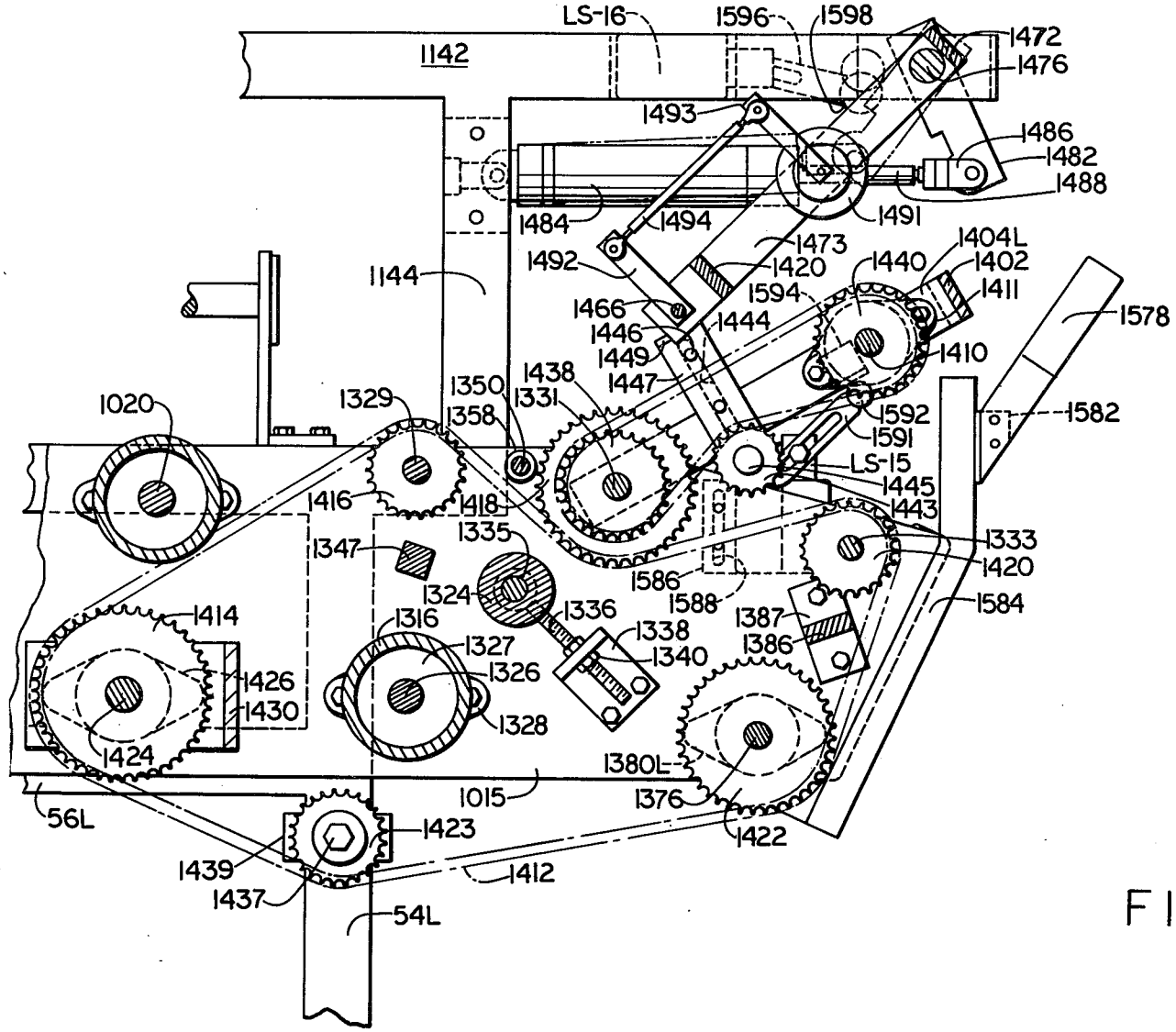
FIG. 7 is a view in section of the packing assembly taken on the line 7—7 in FIG. 6.

Shortly before the predetermined number of bottle carriers 106 have arrived at the case 1288, a limit switch LS-1A (FIG. 31), to be discussed hereinafter with respect to the case handling assembly 14, is operated by the downward movement of the case 1288, and makes the appropriate circuit which permits the machine to utilize a "pack on count cycle". The count switch is thereby preset, and when the predetermined count is reached, the packing belt 1290 (FIG. 2) is stopped abruptly by means of a brake. The circuitry provides a small time delay to permit the last few bottle carriers 106 to clear the nip wheel assembly 1294, which continues to run, then simultaneously activates the nudger assembly 1307 and retracts the hold down tongue 1298 to a retracted position 1298*a* as shown in FIG. 2. The nudger assembly 1307 cycles faster than the hold down tongue 1298 can retract, so that when a limit switch LS-16, as shown in FIGS. 6 and 7, is actuated by the structure of the hold down tongue 1298, everything is clear of the case 1288. The limit switch LS-16 then makes the appropriate circuit which lowers the case 1288 in preparation for leaving the bottle carrier checker/packer 10. If the counter malfunctions, providing a pack signal before the limit switch LS-1A is reached, the count signal is ignored, the case 1288 will continue to fill and will enter the pack cycle when a limit switch LS-1 (FIG. 31) is activated by the descending case 1288. The limit switch LS-1 is located just below the limit switch LS-1A on the lower portion of the elevator incline 36. The limit switch LS-1 will also be discussed hereinafter since it is a part of the case handling assembly 14. If the counter malfunctions, by giving a pack signal after the limit switch LS-1 has been reached, then the limit switch LS-1 will have pre-empted the count switch and started the pack cycle, thereby preventing an overfill of the case 1288. The limit switch LS-1 also can reset the counter in preparation for another cycle.

As the case 1288 descends into physical proximity of the carrier packing assembly 22, a left side flap 1310 (FIG. 3) of the case left side 1304 is guided down past the nip wheel assembly 1294 and associated assemblies by a left side guide assembly 1313. Similarly, a right side flap 1312 of the case right side 1303 is guided downwardly and around the nip wheel assembly 1294 by a right side flap guide 1314 shown in FIG. 3, and in FIG. 2 in double dot dash lines to indicate a phantom showing and that the piece is located to the right of the plane of the FIG. 2.

A mechanical description of the carrier packing assembly 22 follows. The packing belt 1290 and its associated structure is shown specifically in FIGS. 6, 7 and 11. The packing belt 1290 is mounted and made mobile in the clockwise direction upon a pack conveyor drive roller 1316 (FIG. 11), an input pack conveyor roller 1318, a middle pack conveyor roller 1320, an output pack conveyor roller 1322, and a pack conveyor idler 1324. The pack conveyor drive roller 1316 is a hollow drum and is rigidly affixed upon a pack conveyor drive shaft 1326 by a pair of end plates 1327 that is rigidly affixed in the ends thereof. The pack conveyor drive shaft 1326 is rotatably mounted in a pair of conveyor bearings 1328 that is in turn fixedly attached to the inboard surfaces of the pair of pack assembly side plates 1015. The pair of conveyor bearings 1328 is located just above and to the output side of the intersection of the pair of short stringers 56 and 56L and the pair of output costs 54 and 54L.

The input pack conveyor roller 1318 is rotatably mounted upon a conveyor input shaft 1329 by integral bearings, not shown. The conveyor input shaft 1329 is fixedly attached at each end, and in a perpendicular disposition to the inboard surfaces of the pair of pack assembly side plates 1015, by a pair of input shaft cap screws 1330 (FIG. 6). The conveyor input shaft 1329 is located above the pack conveyor drive shaft 1326 and at the top of the pair of pack assembly side plates 1015.

The middle pack conveyor roller 1320 (FIG. 11) is rotatably mounted upon a conveyor middle shaft 1331 by integral bearings, not shown. The conveyor middle shaft 1331 is fixedly attached at each end to the inboard surfaces of, and at the top of, the pair of pack assembly side plates 1015 by a pair of middle shaft cap screws 1332 (FIG. 6). It is also located to the output side of the conveyor input shaft 1329.

The output pack conveyor roller 1322 (FIG. 11) is likewise rotatably mounted upon a conveyor output shaft 1333 by integral bearings, not shown. The conveyor output shaft 1333 is fixedly attached at both ends to the inboard surfaces of, and near the top output end of, the pair of pack assembly side plates 1015 by a pair of output shaft cap screws 1334. The pairs of input shaft, middle shaft and output shaft cap screws, 1330, 1332 and 1334 respectively, pass through clear holes in the pair of pack assembly side plates 1015 and threadably mount within the ends of the hollow conveyor input, middle and output shafts 1329, 1331 and 1333, respectively.

The pack conveyor idler 1324 is also rotatably mounted upon a conveyor idler shaft 1335 by integral bearings, not shown. The conveyor idler shaft 1335 is laterally disposed within the carrier packing assembly 22, between the pack conveyor drive shaft 1326 and the conveyor middle shaft 1331. Each end of the conveyor idler shaft 1335 is fixedly held within the eye of a pair of pack conveyor eyebolts 1336. The threaded shank of each of the pair of pack conveyor eyebolts 1336 passes through a clear hole in a laterally extending flange of one of a pair of eyebolt angle mounts 1338 (FIGS. 6 and 7). The threaded shank of the pair of pack conveyor eyebolts 1336 is fixedly and axially adjustable within the clear hole by a pair of lock nuts 1340. The pair of eyebolt angle mounts 1338 is fixedly attached upon the inboard surface of the pair of pack assembly side plates 1015 and approximate to the output side of the pack conveyor drive shaft 1326. The pair of eyebolt angle mounts 1338 is positioned at approximately a 45° angle to the vertical, so as the pair of locknuts 1340 is adjusted, the pack conveyor idler is moved angularly upward in opposition against the outside surface of the packing belt 1290 to bring tension therein.

The packing belt 1290 moves in a clockwise direction (FIG. 11) about the pack conveyor drive roller 1316, then upwardly to pass over the input, middle and output pack conveyor rollers 1318, 1320 and 1322, respectively. The packing belt 1290 reverses its direction in passing around the output pack conveyor roller 1322 and extends horizontally in the input direction to pass over and downwardly about the pack conveyor idler 1324 before returning to the output side of the pack conveyor drive roller 1316.

Figure 11:
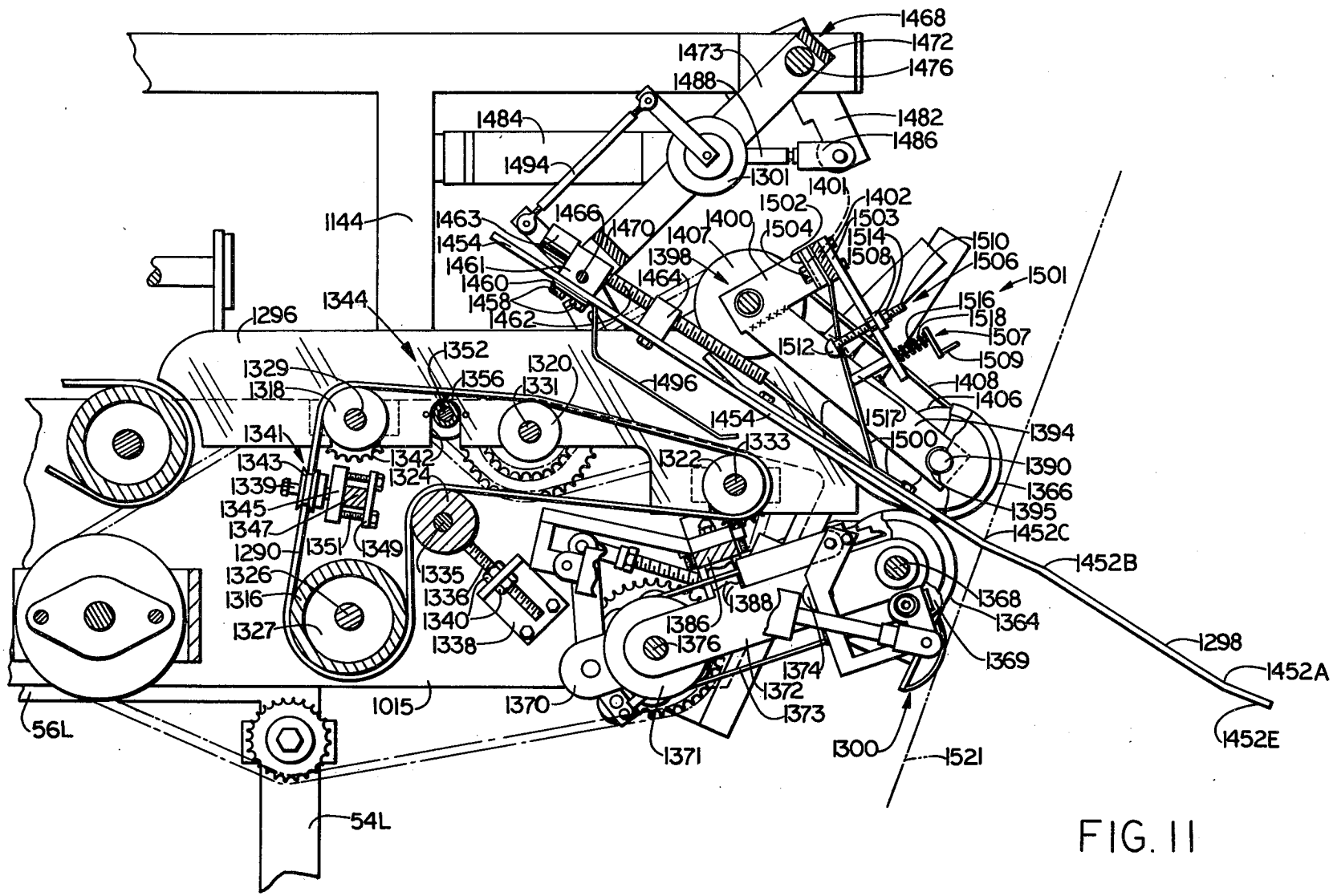
FIG. 11 is a view in section of the packing assembly taken on the line 11—11 in FIG. 6.
Figure 12:
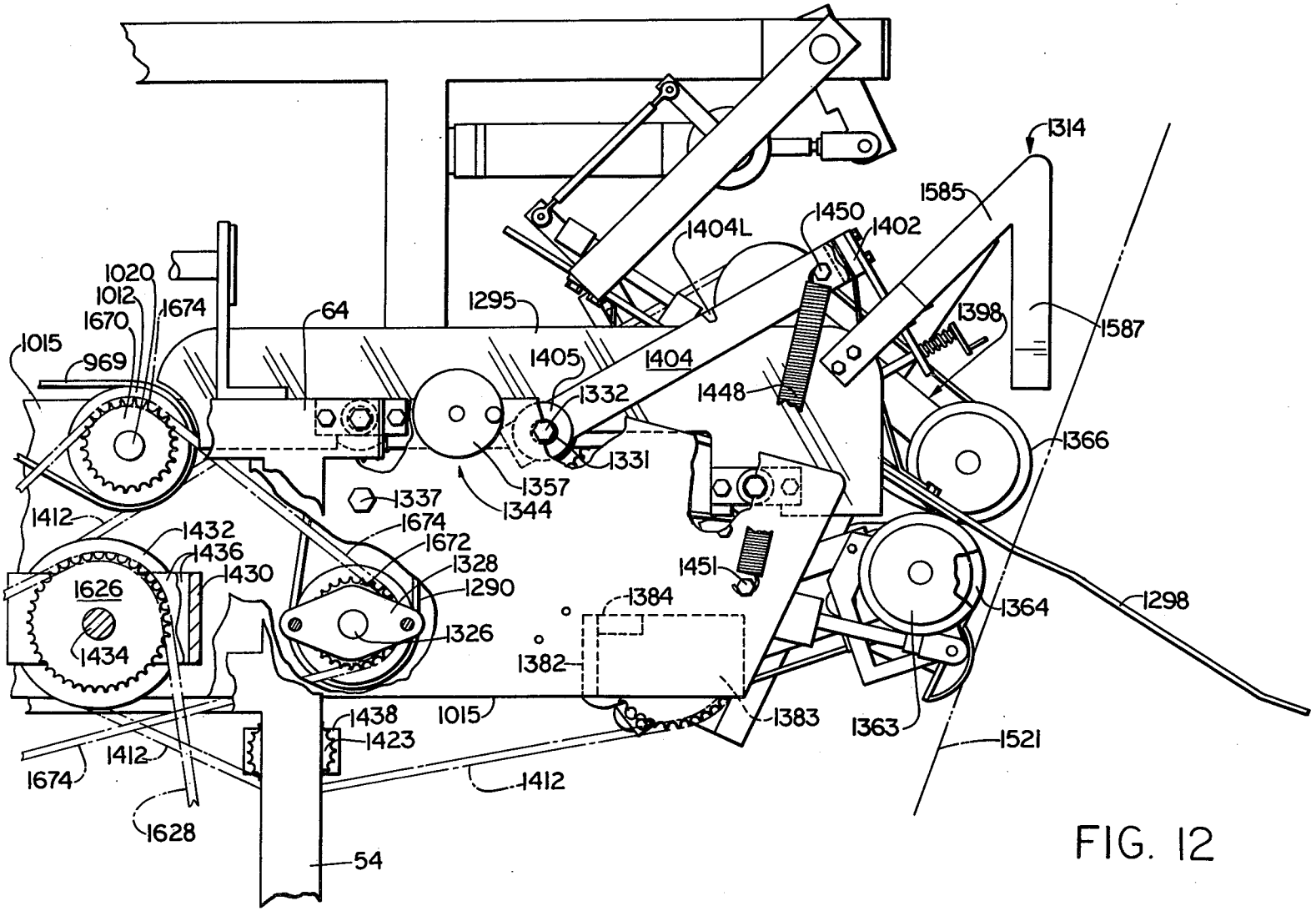
FIG. 12 is a side elevational view of the packing assembly looking in the direction of the arrows 12—12 in FIG. 6, parts being cut away to expose machinery otherwise not visible in the views.

The packing belt 1290 is maintained in lateral placement by a lateral guide assembly 1341, as shown in FIGS. 6, 7, 11 and 12. The lateral guide assembly 1341 is located between the pack conveyor drive roller 1316 and the input pack conveyor roller 1318, as is best seen in FIG. 11. The lateral guide assembly 1341 is comprised of a pair of side guide rollers 1343, a pair of guide roller mounts 1345 and a lateral guide mount bar 1347. Each one of the pair of guide rollers 1343 is rotatably mounted upon a guide spindle 1339 that is in turn fixedly attached in a perpendicular orientation in the input face of one of the pair of guide roller mounts 1345. Each one of the pair of guide roller mounts 1345 is fixedly clamped to the input face of the lateral guide mount bar 1347 by a back plate 1349 and a pair of spanner bolts 1351 that passes through clear holes in the back plate 1349 and threadably mount in the overhanging portions of each one of the pair of guide roller mounts 1345. The lateral guide mount bar 1347 is fixedly attached at each end to the inboard surfaces of the pair of pack assembly side plates 1015 by a pair of cap screws 1337 that passes through clear holes therein and threadably mount in the ends of the latter guide mount 1347, as can be seen in FIG. 12. In this manner the pair of guide rollers 1343 can be adjusted angularly to coincide with the edges of the packing belt 1290 as it rises from the pack conveyor drive roller 1316 to the input pack conveyor rollers 1318, as well as laterally upon the lateral guide mount bar 1347 to permit installation and proper alignment of the packing belt 1290.

As the shingled stream of bottle carriers 977 passes through the carrier packing assembly 22 upon the packing belt 1290, it is held in lateral alignment by the left hand carrier guide 1296 and the right hand carrier guide 1295. Referring to FIGS. 6 and 11, the left hand carrier guide 1296 is a flat plate and irregularly shaped to conform to the upper profile of the packing belt 1290. The left hand carrier guide 1296 also incorporates along its bottom edge a series of cutouts 1342 that permit lateral passage of the conveyor input, middle and output shafts 1329, 1331 and 1333, respectively, and also a lateral adjustment assembly 1344. The left hand carrier guide 1296 is fixedly attached to a pair of slide mounts 1346 that is concentrically aligned with the end cutouts of the series of cutouts 1342. The pair of slide mounts 1346 is slidably mounted upon the left hand side of the conveyor input and output shafts 1329 and 1333, respectively.

The right hand carrier guide 1295, shown in FIGS. 6 and 12, is of generally similar in shape to the left hand carrier guide 1296 and is fixedly attached to a pair of right hand slide mounts 1348. The pair of right hand slide mounts 1348 is slidably mounted upon the right hand side of the conveyor input and output shafts 1329 and 1333, respectively.

The left and right hand carrier guides 1296 and 1295, respectively, are laterally and symmetrically adjustable with respect to the carrier packing assembly 22 by the lateral adjusting assembly 1344 as is shown in FIGS. 6 and 11. The lateral adjusting assembly 1344 comprises a left hand crankshaft 1350 and a right hand crankshaft 1352, a shaft coupler 1353, a left hand thread hollow shaft 1354, a right hand thread hollow shaft 1356, and a packer guide crank handle 1357. The left hand thread hollow shaft 1354 is rigidly and coaxially affixed about the left hand crank shaft 1350 in such a lateral position as to have a short length of the left hand crankshaft 1350 protruding from the right hand extremity of the left hand thread hollow shaft 1354. Similarly, the right hand thread hollow shaft is rigidly and coaxially affixed upon the right hand crankshaft 1352 in such a lateral position as to leave a short length of the right hand crankshaft 1352 protruding from the left hand extremity of the right hand thread hollow shaft 1356. Consequently, the protruding ends of the left and right hand crankshafts 1350 and 1352, respectively, are fixedly attached end to end by the shaft coupler 1353 to form one continuous and rigid shaft that spans the carrier packing assembly 22. This combined shaft is rotatably held through the pair of pack assembly side plates 1015 by a pair of bushings 1358, that is in turn fixedly pressed into holes provided near the top of the pair of pack assembly side plates 1015. The combined shaft is laterally restrained in the pair of bushings 1358 by a pair of locking collars 1360 that is installed upon the right hand crankshaft 1352 on both sides of the right hand member of the pair of pack assembly side plated 1015. The packer guide crank handle 1357 is fixedly attached to the right hand extremity of the right hand crankshaft 1352.

The right hand carrier guide 1295 is connected to the right hand thread hollow shaft 1356 by a right hand thread collar 1361 and the left hand carrier guide 1296 is connected to the left hand thread hollow shaft 1354 by a left hand thread collar 1362. Therefore, as the packer guide crank handle 1357 is manually turned clockwise with respect to FIG. 12, the left and right hand carrier guides 1296 ad 1295, respectively, will move away from each other, increasing the distance between themselves, in accommodation of a larger bottler carrier 106. Counterclockwise rotation will adjust the carrier guides inwardly to accommodate smaller cartons.

The nip wheel assembly 1294 is comprised of a pair of bottom pack nip wheels 1364 and a pair of top pack nip wheels 1366, as can be seen most easily in FIGS. 6 and 11. The pair of bottom pack nip wheels 1364 is fixedly attached upon a lower nip shaft 1368 that is in turn rotatably mounted in bearings (not shown) in the output ends of a left side nip beam 1370 and a right side nip beam 1372. The right extremity of the lower nip shaft 1368 extends to the right of the right side nip beam 1372 to fixedly incorporate an auxiliary nip wheel 1363 to assure vertical support for large bottle carriers 106. The auxiliary nip wheel 1363 is spacedly mounted from the right side nip beam 1372 with the aid of a pair of shaft collars 1365. The left and right side nip beams 1370 and 1372, respectively, are held in lateral and parallel spaced relationship by a transverse beam 1374 that is rigidly affixed therebetween. The input ends of the left and right side nip beams 1370 and 1372, respectively, are pivotally mounted upon a lower nip mount shaft 1376 by a pair of bearings not shown. The left and right side nip beams 1370 and 1372, respectively, and the transverse beam 1374 comprise a lower nip frame 1377 that is held in lateral place upon the rotating lower nip mount shaft 1376 by a pair of lock collars 1378. The pair of lock collars 1378 is fixedly attached to the lower nip mount shaft 1376 on each side of lower nip frame 1377.

The lower nip mount shaft 1376 is rotatably mounted in a pair of pack nip bearings 1380R and 1380L. The left hand pack nip bearing 1380L is fixedly attached to the inboard surface of, and at the lower output corner of, the left hand member of the pair of pack assembly side plates 1015, as can be seen in FIG. 49. The right hand pack nip bearing 1380R is fixedly attached to the inboard surface of a standoff bearing mount 1381 (FIGS. 48 and 51) that is in turn rigidly affixed to the left end of a standoff plate 1382. The standoff plate 1382 is rigidly attached at the input end of, and upon the inboard surface, of a standoff mount 1383 that is in turn fixedly attached to the inboard surface of, and at the lower output corner of, the right hand member of the pair of pack assembly side plates 1015. The standoff bearing mount 1381, the standoff plate 1382, and the standoff mount 1383 form a U-shaped bracket with its open end toward the output end of the carrier packing assembly 22. A partial web plate 1384 is rigidly affixed within the bottom of the "U", but at the top of the mounting assembly for additional strength. This mounting arrangement permits the right side flap 1312 of the case 1288 to freely pass during the pack cycle.

The lower nip frame 1377 is fixedly held in angular relationship to the carrier packing assembly 22 by a lower nip stabilizer bar 1386 (FIGS. 7 and 11). The lower nip stabilizer bar 1386 incorporates a pair of mounting pads 1387 rigidly affixed to the ends thereof, the pair of mounting pads 1387 being fixedly attached to the inboard surfaces of, and near the output ends of, the pair of pack assembly side plates 1015. A pair of lower nip frame hangers 1388 (FIG. 11) is rigidly and centrally affixed to the underside of the lower nip stabilizer bar 1386. The pair of lower nip frame hangers 1388 is also rigidly affixed in an integral manner to the top edge of the left side nip beam 1370 and the right side nip beam 1372, suspending the lower nip frame 1377 in an inclined orientation in the output direction, as previously indicated.

A bottom nip timing sheave 1369 is fixedly attached to the lower nip shaft 1368 between the pair of bottom pack nip wheels 1364. Power is transferred to the bottom nip timing sheave 1369 from a bottom transfer sheave 1371 by a lower nip belt 1373. The bottom transfer sheave 1371 is fixedly attached upon, and in the center of, the lower nip mount shaft 1376.

Figure 13:
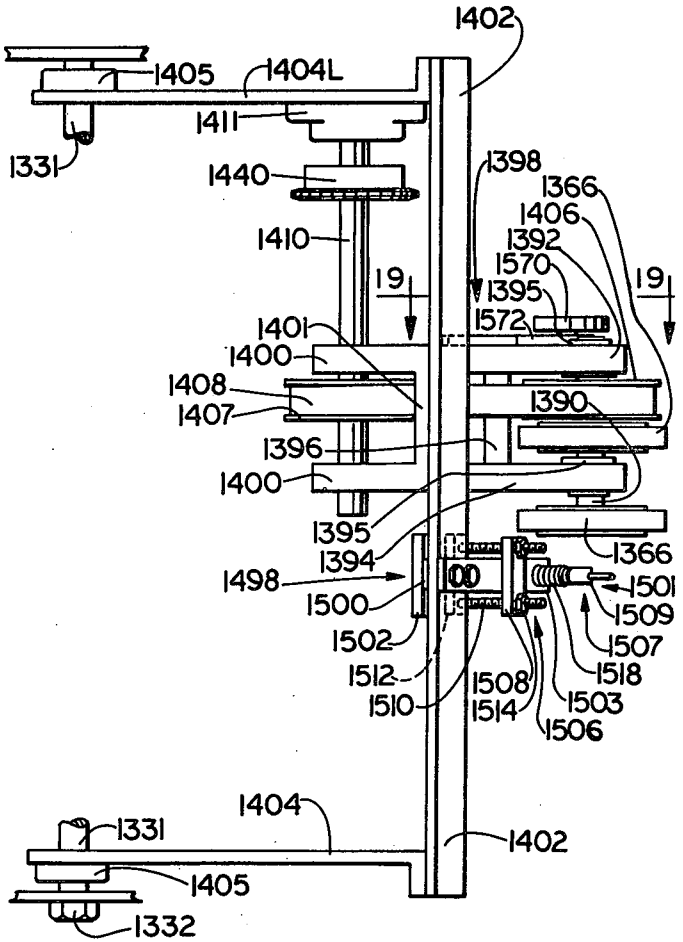
FIG. 13 is a fragmentary plan view of an upper nip roll assembly of the machine.

The pair of top pack nip wheels 1366 and its supporting structure are shown in FIGS. 11 and 13. The pair of top pack nip wheels 1366 is fixedly attached to a top nip shaft 1390 that is in turn rotatably mounted in the output ends of a left hand nip beam 1392 and a right hand nip beam 1394 by a pair of top nip shaft bearings 1395. The left and right hand nip beams 1392 and 1394, respectively, are held in rigid parallel and lateral spaced relationship by a top lateral brace 1396 to form a top nip frame 1398. The top nip shaft 1390 is rotatably mounted in the pair of top nip shaft bearings 1395 in such manner that it extends from the right hand side thereof, to incorporate the right hand member of the pair of top pack nip wheels 1366. The left hand member of the pair of top pack nip wheels 1366 is mounted along the left hand side of the right hand nip beam 1394 of the top nip frame 1398. The orientation upon the top nip shaft 1390 brings the pair of top pack nip wheels 1366 in vertical alignment with the pair of bottom pack nip wheels 1364.

The top nip frame 1398 also comprises a pair of hanger mounts 1400 that is rigidly affixed to the input ends thereof, as is shown in FIG. 50. The upper ends of the pair of hanger mounts 1400 are held in lateral spaced relationship by a spacer mount 1401 that is rigidly affixed therebetween. The top nip frame 1398 is fixedly attached to the central input side of a top nip cross bar 1402, as is best shown in FIGS. 49, 51 and 52. The top nip cross bar 1402 is fixedly attached at its ends to the upper extremities of a pair of top nip radius arms 1404 and 1404L, which are in turn pivotally mounted upon the conveyor middle shaft 1331 by a pair of upper nip bearings 1405.

Fixedly attached to the top nip shaft 1390 is an upper timing belt sheave 1406 (FIGS. 11 and 13) that is located between the left hand nip beam 1392 and the left hand member of the pair of top pack nip wheels 1366. Power is transferred to the upper timing belt sheave 1406 from a transfer timing sheave 1407 by an upper timing belt 1408. The transfer timing sheave 1407 is fixedly attached to a short nip transfer shaft 1410 that is in turn rotatably held in a pair of bearings (not shown in detail) in the input end of the pair of hanger mounts 1400 of the top nip frame 1398, and a top nip transfer bearing 1411. The top nip transfer bearing 1411 is fixedly attached to the inboard surface of and at the upper end of the left hand top nip radius arm 1404L as is seen in FIG. 7.

Referring now to FIGS. 6 and 7, power is distributed to the pairs of top and bottom pack nip wheels 1366 and 1364, respectively, by a distribution chain 1412. The distribution chain 1412 is mounted and made mobile in the clockwise direction (with respect to FIG. 7), upon a distribution sprocket 1414, a conveyor input shaft sprocket 1416, a conveyor middle shaft sprocket 1418, a conveyor output shaft sprocket 1420, a lower nip mount shaft sprocket 1422, and a distribution idler sprocket 1423. The distribution sprocket 1414 is fixedly attached upon a left side pack clutch shaft 1424 that is in turn rotatably mounted within a pair of left side clutch bearings 1426, as can be seen in FIGS. 1B, 6 and 7. The pair of left side clutch bearings 1426 is fixedly attached to the opposing surfaces of a pair of left side bearing mounts 1428 that is in turn rigidly affixed at its output edge, and in a cantilever manner, to the input face of a clutch mount beam 1430. The left member of the pair of left side bearing mounts 1428 is located at the left extremity of the clutch mount beam 1430 and also functions as a mounting plate for the clutch mount beam 1430. The right member of the pair of left side bearing mounts 1428 is located just left of center upon the clutch mount beam 1430. The right extremity of the left side pack clutch shaft 1424 is appropriately affixed within a pack clutch 1432. The right side of the pack clutch 1432 is appropriately affixed to the left extremity of a right side pack clutch shaft 1434 that is rotatably mounted in a pair of right side clutch bearings 1435. The pair of right side clutch bearings 1435 is fixedly mounted to the inboard surfaces of a pair of right side bearing mounts 1436 that is in turn rigidly affixed at its output edge, and in a cantilever manner, to the input face of the clutch mount beam 1430. The left member of the pair of right side bearing mounts 1436 is located just right of center of the carrier packing assembly 22 and adjacent to the pack clutch 1432. The right member of the pair of right side bearing mounts 1436 is located at the right extremity of the clutch mount beam 1430 and also functions as a mounting plate for the clutch mount beam 1430. The clutch mount beam 1430 is fixedly attached to the inboard surfaces of and at the bottom of the pair of pack assembly side plates 1015, and located underneath the surge output shaft 1020 of the surge hopper 20. Further explanation of the pack clutch 1432 will be included hereinafter.

The conveyor input shaft sprocket 1416 (FIGS. 6 and 7) is rotatably mounted upon the left side of the conveyor input shaft 1329, the conveyor middle shaft sprocket 1418 is rotatably mounted upon the left side of the conveyor middle shaft 1331, the conveyor output shaft sprocket 1420 is rotatably mounted upon the left side of the conveyor output shaft 1333, and the lower nip mount shaft sprocket 1422 is fixedly attached to the left side of the lower nip mount shaft 1376. The distribution chain 1412 passes clockwise (FIG. 49) about the distribution sprocket 1414, then upwardly and in the output direction to pass over the conveyor input shaft sprocket 1416, then under the conveyor middle shaft sprocket 1418. The distribution chain 1412 continues in the output direction to pass over the conveyor output shaft sprocket 1420, then downward to pass around and under the lower nip mount shaft sprocket 1422 (rotation is clockwise). The distribution chain 1412 returns to the distribution sprocket after passing under the distribution idler sprocket 1423. The distribution idler sprocket 1423 (FIG. 7) is rotatably mounted upon a short spindle 1437 that is in turn mounted in a perpendicular manner upon the inboard face of a distribution idler mount 1439. The distribution idler mount 1439 is rigidly affixed to the inboard surface of the left hand output post 54L, just below the intersection of the left hand short stringer 56L.

In this manner, the conveyor input and output shaft sprockets 1416 and 1420 perform as idlers only, while power is transferred from the distribution sprocket 1414 to the conveyor middle shaft sprocket 1418, and the lower nip mount shaft 1376 by the lower nip mount shaft sprocket 1422. Fixedly attached to the inboard face of the hub of the conveyor middle shaft sprocket 1418 is a top nip output sprocket 1438. Power is delivered from the top nip output sprocket 1438 to a top nip transfer sprocket 1440 by a top nip transfer chain 1442. A transfer idler 1443 bears against the underside of the lower half of the top nip transfer chain 1442, forcing it upward and developing the proper tension therein. The transfer idler 1443 is rotatably mounted upon a transfer idler spindle 1445 that is in turn rigidly affixed in a perpendicular disposition upon the inboard face of, and at the lower end of, a transfer idler slide 1447 (FIGS. 6 and 7). The transfer idler slide 1447 is fixedly and adjustably attached to the inboard side of a transfer idler mount 1449 that incorporates an elongated slot 1444 through which a pair of slide bolts 1446 clearly pass to be threadably mounted into the transfer idler slide 1447. The transfer idler mount 1449 is rigidly affixed along its bottom edge to the top edge of the left hand top nip radius arm 1404L, slightly to the output side of the conveyor middle shaft sprocket 1418, as is shown in FIG. 7. The top nip transfer sprocket 1440 is fixedly attached to the left side of the short nip transfer shaft 1410 delivering power thereto (FIG. 13). Consequently, power is transferred through the transfer timing sheave 1407, the upper timing belt 1408, the upper timing belt sheave 1406, the top nip shaft 1390, and to the pair of top pack nip wheels 1366. In similar manner, power is transferred through the lower nip mount shaft sprocket 1422 (FIGS. 6 and 7), the lower nip mount shaft 1376, the bottom transfer sheave 1371, the lower nip belt 1373, the bottom nip timing sheave 1369 and the lower nip shaft 1368, to the pair of bottom pack nip wheels 1364.

Referring now to FIG. 12, as the shingled stream of bottle carriers passes between the pairs of bottom and top pack nip wheels 1364 and 1366, respectively, the pair of top pack nip wheels 1366 is moved upwardly, pivoting the top nip frame 1398, the top nip cross bar 1402 and the pair of top nip radius arms 1404 and 1404L about the conveyor middle shaft 1331, to release excessive compressive forces thereupon. A pair of long springs 1448 restrains the pair of top nip radius arms 1404 and 1404L along with the top nip frame 1398 from excessive vertical movement. Each spring of the pair of long springs 1448 is stretched between an upper nip pin 1450 and an anchor bolt 1451. The upper nip pin 1450 is a shoulder bolt that is threadably mounted in the outboard side of, and at the upper end of, each member of the pair of top nip radius arms 1404 or 1404L. The anchor bolts 1451 are also threadably mounted in the outboard sides of, and at the output ends of, the pair of pack assembly side plates 1015.

The hold down tongue 1298 and its respective structure, to be herein described, is shown in FIGS. 2, 7, 11 and 14. The hold down tongue 1298 is a changeable part, each tongue cooperating with a particular size bottle carrier 106. The tongue 1298 is so shaped to bring a downward pressure upon the top of the case stack of carriers 1299 at a point not far removed from the case bottom 1302 as can be seen in FIG. 2. As shown in FIG. 3, the hold down tongue 1298 overlies the thickest portions of the bottle carriers to depress the bottle carriers at their thickest portions and to stabilize the stack 1299 as the stack is being formed. The hold down tongue 1298 exerts a significant hold down pressure on the stack. Referring to FIG. 11, a bend relief 1452A, 1452B and 1452C is provided along the extended portion of the tongue 1298 to insure that only the under surface of the turned up end 1452E is in contact with the top of the case stack of carriers 1299. This provides, upon retraction, that minimal friction forces are applied upon the case stack of carriers 1299 to prevent the dragging of several bottle carriers 106 back out of the case 1288.

Figure 14:
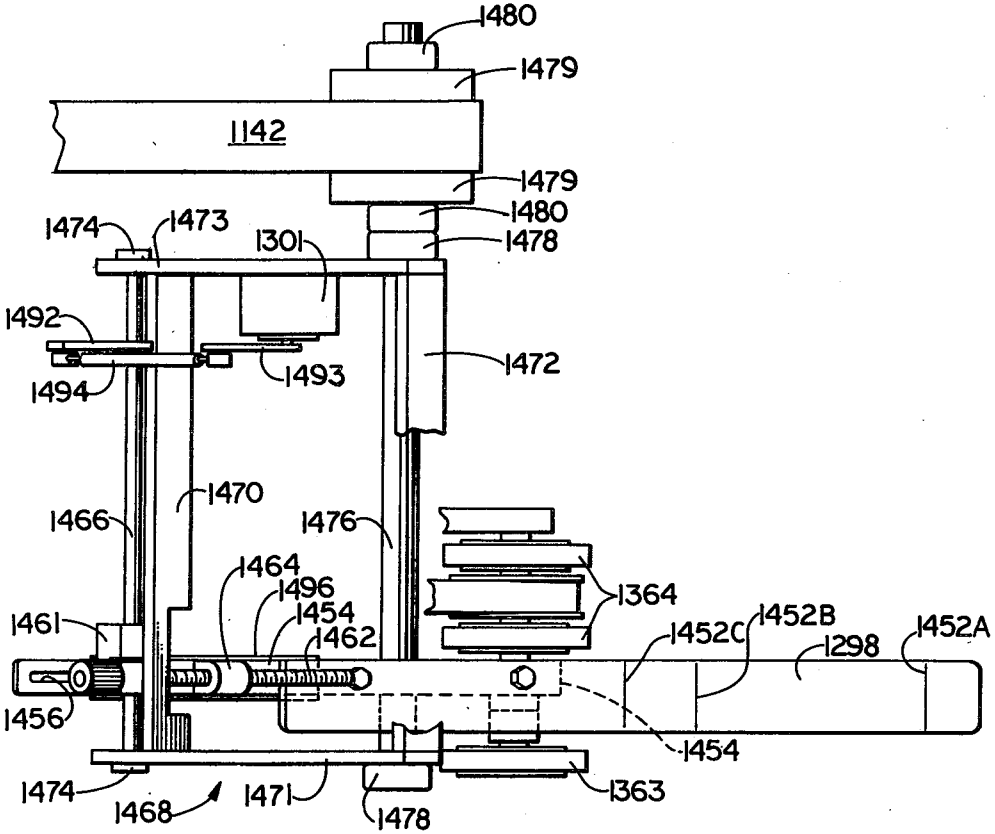
FIG. 14 is a fragmentary plan view of a modulating valve or microtorque assembly of the machine.

The hold down tongue 1298 (FIGS. 11 and 14) is fixedly attached to the top surface of, and extending from the input end of, a tongue mount 1454. As can be seen in FIG. 14, the input end of the tongue mount 1454 incorporates an adjustment slot 1456. A pair of clamping bolts 1458 (FIG. 11) passes through clear holes in a clamping plate 1460, then through the adjustment slot 1456, before threadably mounting into the lower surface of a tongue block 1461. The tongue block 1461 incorporates a clear longitudinal hole through which extends the stem of an adjustment knob 1463. A tongue adjustment screw 1462 is mounted on the end of the stem of the adjustment knob 1463, and is threadably mounted through a tongue lug 1464. The tongue lug 1464 is fixedly attached upon the top of the tongue mount 1454 so that when the adjustment knob 1463 is rotated, the tongue lug 1464, and consequently the hold down tongue 1298, is adjusted longitudinally, then locked into fixed position by the pair of clamping bolts 1458.

The tongue block 1461 is also fixedly attached to the right side of a torque rod 1466 that is in turn pivotally mounted in the lower end of a tongue retraction frame 1468. The tongue retraction frame 1468 is comprised of a bottom lateral brace 1470, a top lateral brace 1472, a right hand retraction arm 1471 and a left hand retraction arm 1473. The bottom lateral brace 1470 is rigidly affixed at each end near the lower extremities of the right and left hand retraction arms 1471 and 1473, respectively, and the top lateral brace 1472 is likewise rigidly affixed at both ends to the top extremities thereof to form the rigid and rectangular tongue retraction frame 1468.

The tonque rod 1466 is pivotally mounted in sleeve bearings (not shown) carried in clear holes in the lower extremities of the right and left hand retraction arms 1471 and 1473, respectively. The torque rod 1466 is laterally held in place by a pair of torque shaft collars 1474 fixedly attached upon the ends thereof. The right and left hand retraction arms 1471 and 1473 also incorporate at their upper ends a pair of clear holes that permit fixedly mounting the torque retraction frame 1468 upon a retraction spindle 1476. The tongue retraction frame 1468 is held thereupon in proper lateral placement by a pair of spindle collars 1478. The left end of the retraction spindle 1476 is pivotally mounted through a pair of retraction spindle bushings 1479 that is in turn rigidly affixed to both sides of, and at the output end of, the diverter stringer 1142. The retraction spindle 1476 passes through a clear hole in the diverter stringer 1142 and is retained in proper lateral placement in the pair of retraction spindle bushings 1479 by a pair of spindle retainer collars 1480.

As can be seen by reference to FIG. 2, retraction of the hold down tongue 1298 to the retracted position shown at 1298*a* requires that the tongue retraction frame 1468 and the retraction spindle 1476 rotate almost ninety degrees to the position at which the tongue retraction frame is indicated at 1468*a*. This is accomplished by a retraction torque arm 1482 and a retraction cylinder 1484 that is shown in FIGS. 6 and 7. The retraction torque arm 1482 is fixedly attached upon the left end of the retraction spindle 1476, and the lower extremity thereof pivotally accepts a retraction cylinder clevis 1486. The retraction cylinder clevis 1486 is fixedly attached upon the end of a retraction cylinder rod 1488 that is fully extended, as is shown in solid line in FIG. 7. The retraction cylinder 1484 is pivotally mounted to a standoff retraction cylinder mount 1490 (FIG. 6), a U-shaped bracket, that is in turn fixedly attached to the outboard surface of, and near the top of, the discard riser 1144. As the retraction cylinder rod 1488 withdraws into the retraction cylinder 1484, the retraction torque arm 1482 assumes the position indicated in double dot and dash lines in FIG. 7, thus withdrawing the hold down tongue 1298 from the case 1288.

The microtorque valve 1301 is fixedly attached to the inboard surface of the left hand retraction arm 1473, as is shown in FIGS. 7 and 14. Fixedly attached to the spindle of the microtorque valve 1301 is a microtorque arm 1493 that extends upwardly and transversely with respect to the left hand retraction arm 1473. Fixedly attached to the left hand side of the torque rod 1466 is a torque rod arm 1492 that is positioned upwardly, generally parallel to, and in longitudinal line with the microtorque arm 1493. Pivotally connecting the upper ends of the torque rod arm 1492 and the microtorque arm 1493 is a turnbuckle rod 1494 which allows for minor adjustments of the microtorque valve 1301. As the hold down tongue 1298 is forced upward by the growing case stack of carriers 1299, it rotates the torque rod 1466, which through the linkage just described, rotates the spindle of the microtorque valve 1301 counterclockwise with respect to FIG. 7, causing controlled lowering of the case 1288 to keep the top of the case stack of carriers 1299 in line with the nip wheel assembly 1294.

As the shingled stream of bottle carriers 977 moves through the carrier packing assembly 22 (see FIG. 2), it must negotiate a slight change in elevational angle as it passes over the middle pack conveyor roller 1320 of FIG. 11. The leading edges 115 of the bottle carriers 106 tend to "stand up", but are forced downward by a leaf spring 1496 that is mechanically shown in FIG. 50. The leaf spring 1496 is fixedly clamped under the clamping plate 1460 that secures the tongue mount 1454 to the tongue block 1461 that is mounted upon the tongue retraction frame 1468. Other leaf springs are used as necessary to hold the shingled stream of bottle carriers 1292 to their appropriate transport belts. Even in a nicely compressed shingle, the leading edges 115 of the bottle carriers 106 individually impact the bottom surface of the tongue mount 1454 as they pass from under the leaf spring 1496 to the nip wheel assembly 1294 and can cause the tongue mount 1454 to bounce. Any such bounce, particularly if resonant in nature, would interfere with the smooth operation of the microtorque valve 1301. To monimize such bounce, a hold down spring assembly 1498 is employed and is shown in FIGS. 11 and 13. The hold down spring assembly 1498 also serves to put pressure on the carton stack 1299 (FIG. 2) to stabilize the stack.

The hold down spring assembly 1498 (FIG. 11) is comprised of a tongue hold down spring 1500 and a pressure assembly 1501. The tongue hold down spring 1500 is fixedly clamped at its input end to the input surface of the top nip cross bar 1402 by an input clamp plate 1502 and bolt 1504. It is located upon the top nip cross bar 1402 to the right of the top nip frame 1398. The output end of the tongue hold down spring 1500 rests upon the top of the hold down tongue 1298.

Vertical pressure of the hold down tongue 1298 is governed by the pressure assembly 1501 that is comprised of an elevational yoke 1506 and an adjustment jack 1507. The elevation yoke 1506 incorporates an elevation yoke mount 1508 rigidly affixed across the top surface of a pressure assembly mount 1503. The pressure assembly mount 1503 is fixedly attached at its input end, and in a cantilever manner, to the top surface of the nip cross bar 1402, and its lateral position thereupon is directly above the tongue hold down spring 1500. A pair of elevation screws 1510 is fixedly inserted into the ends of a spring bar 1512 that passes under the tongue hold down spring 1500. The pair of elevation screws 1510 stands upwardly and passes through clear holes in the ends of the elevation yoke mount 1508 and is adjustably held therein by a set of four nuts 1514. The vertical height of the end of the tongue hold down spring 1500 can be controlled by the elevation yoke 1506 since the hold down spring 1500 has permanent set that would move it considerably downward if the elevation yoke 1506 did not hold it up. Appropriate end pressure is then achieved by turning an adjustment jack crank 1509 of the adjustment jack 1507 that rotates a jack screw 1516 to which it is fixedly attached. The jack screw 1516 is threadably mounted through the output end of the pressure assembly mount 1503 and fixedly incorporates a ram 1517 upon its lower end. The ram 1517 is rotated downward against the top of the tongue hold down spring 1500 and is held in set place by a jack spring 1518. The jack spring 1518 is compressively mounted between the pressure assembly mount 1503 and the adjustment jack crank 1509.

Figure 15:
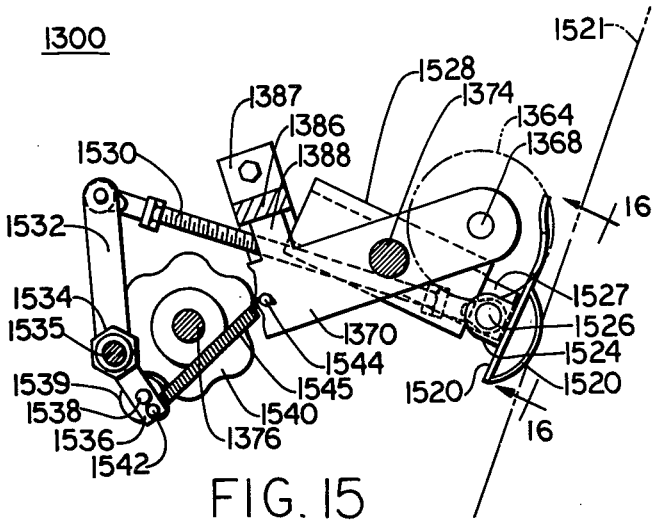
FIG. 15 is a fragmentary view in section of a pack patter assembly taken on the line 15—15 in FIG. 6, parts being cut away for exposition of the patter cam.
Figure 16:
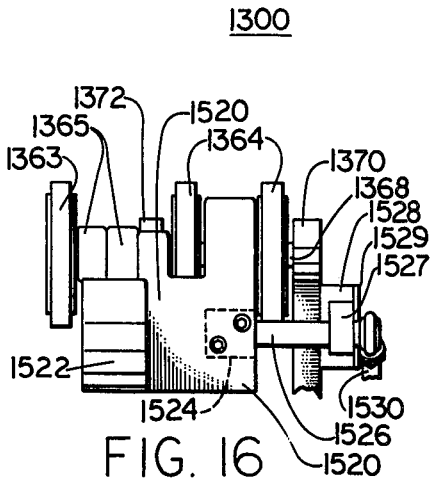
FIG. 16 is a front elevational view of the patter plate taken in the direction of the arows 16—16 in FIG. 15.

The pack patter 1300 is shown principally in FIGS. 6, 15 and 16 and in spaced relationship with the other subassemblies of the carrier packing assembly 22 in FIG. 11. A pack patter plate 1520 is held in nearly upright position and parallel to a case line 1521 as shown in FIG. 15. The case line 1521 is an imaginary line along which the top edge of all cases travel during the pack cycle. The case handling assembly 14, FIG. 1, is longitudinally adjusted to achieve this case positioning no matter what size case is being employed. The pack patter plate 1520 is of irregular shape (FIG. 16) to accommodate the right member of the pair of bottom pack nip wheels 1364. Right and left refer to the bottle carrier checker/packer 10, not to FIG. 16. The upper portion of the pack platter plate 1520 (FIG. 15) is backwardly curved to assure that the bottle carrier 106 is caught on the face thereof and urged into the case 1288 to form the case stack of carriers 1299. The right hand side of the pack patter plate 1520 rigidly incorporates a curved extension plate 1522 in a cantilever manner to insure that the bottle carriers 106 are urged into physical contact with the case bottom 1302, as shown in FIG. 2.

The pack patter plate 1520 is fixedly attached along its left edge to the output side of the patter lug 1524. The patter lug 1524 is fixedly attached to the right end of a patter bar 1526 that is also fixedly attached through the output end of a pack patter slide 1527. The pack patter slide 1527 is retained within a channel mount 1528 by a channel cover 1529. The left hand end of the patter bar 1526 extends slightly from the left side of the pack patter slide 1527, and pivotally incorporates the output end of a patter turnbuckle rod 1530 to the end thereof. The input end of the patter turnbuckle rod 1530 is pivotally attached to the upper extremity of, and upon the left hand side of, a pack oscillator arm 1532, FIGS. 48 and 54. The pack oscillator arm 1532 is in turn rigidly affixed to the top surface of a pivot collar 1534. The pivot collar 1534 is pivotally mounted upon a pack oscillator pin 1535 that is in turn rigidly affixed in a cantilever manner into the left side of the extended input end of the left side nip beam 1370 (FIG. 6). The lower portion of the pivot collar 1532 rigidly incorporates a pack cam roll mount 1536 that is slightly wider than the pivot collar 1532 and extends to the left thereof. A cam roll pin 1538 is rigidly affixed in a lateral disposition through the pack cam roll mount 1536 and extends from the left side therefrom to rotatably incorporate a pack cam roll 1539. The pack cam roll 1539 runs against a pack cam 1540 that incorporates a plurality of lobes, six in this configuration. The pack cam 1540 is rigidly affixed to slightly left of center of the lower nip mount shaft 1376 and in longitudinal alignment with the pack cam roll 1539. The lower extremity of the pack cam roll mount 1536 rigidly incorporates a pack spring pin 1542 that protrudes perpendicularly from the right side thereof. A pack spring anchor pin 1514 is rigidly affixed in a perpendicular manner into the right hand surface of the left side nip beam 1370 near the location of the left hand member of the pair of lower nip frame hangers 1388. A pack spring 1545 is streteched between the pack spring pin 1542 and the pack spring anchor pin 1544 and retained in grooves therein to keep the pack cam roll 1539 in rolling contact with the pack cam 1540.

Rotational power is provided by the lower nip mount shaft 1376, transmitted through the pack cam 1540 and the pack cam roll 1539 to oscillate the pack oscillator arm 1532. The patter turnbuckle rod 1530 being connected to the pack oscillator arm 1532 and the patter bar 1526, transmits the oscillating power to the pack patter slide 1527, which in turn oscillates the pack patter plate 1520 in an in-and-out manner. Consequently, the case stack of carriers 1299 is patted six times for each rotation of the pack cam 1540 to continuously urge the bottle carriers 106 to the case bottom 1302.

Figure 17:
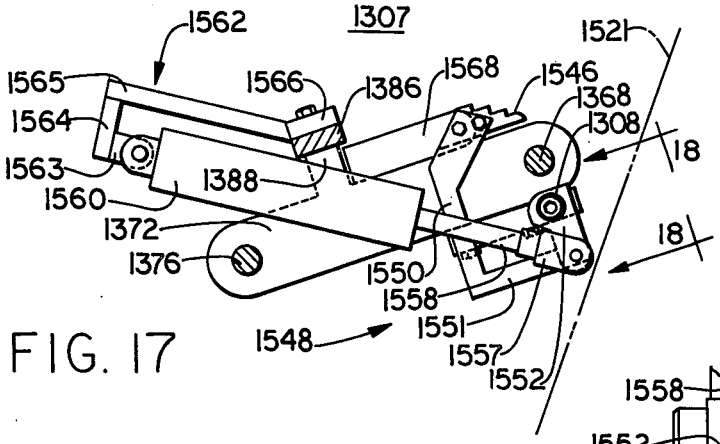
FIG. 17 is a fragmentary view in section of a nudger assembly taken on the line 17—17 in FIG. 6.
Figure 18:
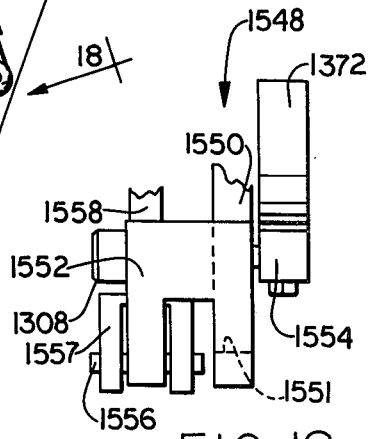
FIG. 18 is a fragmentary front elevational view of the nudger assembly and taken in the direction of the arrows 18—18 in FIG. 17.

The nudger assembly 1307 is shown in detail in FIG. 17 and in spaced relationship with neighboring assemblies in FIGS. 6 and 11. The working extremity of the nudger assembly 1307 is comprised of a quadruple detent hold down and pusher member 1546 that is fixedly attached to the left hand side of an offset arm 1548. The offset arm 1548 is shown in FIGS. 17 and 18, and is a one-piece weldment that is comprised of a detent vertical riser 1550, a detent horizontal bar 1551 and a detent clevis mount 1552. The detent vertical riser 1550 is rigidly affixed to the input end of the detent horizontal bar 1551 whose input end is in turn rigidly affixed to the lower input face of the left hand lug of the detent clevis mount 1552. The quadruple detent 1546 is fixedly attached to the upper inboard face of the detent vertical riser 1550, as was previously indicated. The offset arm 1548 is pivotally mounted upon the nudger pivot 1308 that is perpendicularly and rigidly affixed in the right hand face of, and at the output end of, a nudger mount 1554. The nudger mount is fixedly attached to the underside of, and at the output end of, the right side nip beam 1372.

The right hand lug of the detent clevis mount 1552 fixedly incorporates in a lateral orientation an offset clevis pin 1556 that pivotally accommodates a nudger cylinder clevis 1557. The nudger cylinder clevis 1557 is fixedly attached to the working end of a nudger cylinder rod 1558 that in turn is activated by a nudger cylinder 1560. The nudger cylinder 1560 is pivotally mounted to a cantilever cylinder mount 1562 that is comprised of a cylinder mount lug 1563, a vertical hanger mount 1564, a cantilever extension arm 1565, and an extension arm pad 1566. The extension arm pad 1566 is fixedly attached to the top surface of the lower nip stabilizer bar 1386 almost underneath the right hand extremity of the output pack conveyor roller 1322, as is shown in FIG. 6. The cantilever extension arm 1565 is rigidly affixed to the input edge of the extension arm pad 1566 at a slightly inclined angle with respect thereto. The vertical hanger mount 1564 is rigidly affixed to the lower surface of, and at the input end of, the cantilever extension arm 1565. The cylinder mount lug 1563 is rigidly affixed to the lower output face of the vertical hanger mount 1564. In this manner, the nudger cylinder 1560 is suspended below the lower nip stabilizer bar 1386, and in cycling the nudger cylinder rod 1558, swings the offset arm 1548 and the quadruple detent 1546 in an arc that nearly coincides with the path of travel of the shingled stream of bottle carriers 1292 as they pass through the nip wheel assembly 1294.

A carton guide 1568 (FIG. 17) is pivotally attached at its output end to the left hand side and input end of the quadruple detent 1546. The input end of the carton guide 1568 rides up and back upon the top of the right side nip beam 1372, and in its full back position clears the right member of the pair of lower nip frame hangers 1388. The leading edge 115 of the bottle carrier 106 is prevented from impacting the input side of the detent vertical riser 1550 or the quadruple detent 1546 by the upper surface of the carton guide 1568.

The nudger cylinder 1560 is contracted at the end of each pack cycle, withdrawing the nudger cylinder rod 1558 which rotates the offset arm 1548 about the nudger pivot 1308, and swings the quadruple detent 1546 into physical contact with the last few bottle carriers 106 that have entered the case 1288. The last two or three bottle carriers 106 have difficulty reaching the case bottom 1302 because the case 1288 is tightly packed, and consequently, might stop before entering fully. The quadruple detent 1546 receives the trailing edges 117 to the bottle carriers 106 in the successive notches of the quadruple detent 1546, and mechanically pushes them the rest of the way into the case 1288. This is accomplished because the quadruple detent 1546, in pivoting about the nudger pivot 1308, brings the notches of the quadruple detent 1546 into nearly parallel alignment with the input surface of the case stack of carriers 1299.

Figure 19:
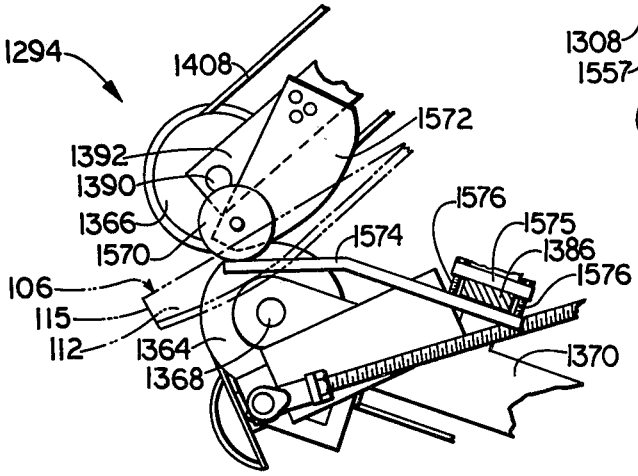
FIG. 19 is a fragmentary view in section showing a bottle carrier bottom bender in side elevation taken on the line 19—19 in FIG. 6.

The carrier bottom bender 1306 is shown in FIG. 19 and is partially shown in FIGS. 6 and 13. Referring to FIG. 19, a bender wheel 1570 is rotatably mounted upon the output end of a shoe mount 1572 that is fixedly but adjustably attached to the left side of the left hand nip beam 1392 of the top nip frame 1398. The shoe mount 1572 hangs downwardly at such an angle to bring the lower edge of the bender wheel 1570 to a point somewhat below the line of traverse of a bottle carrier 106 through the nip wheel assembly 1294. The bottom edge of the shoe mount 1572 is smoothly curved in order to capture the leading edge 115 of the bottle carrier 106 and guide it downwardly and under the bender wheel 1570. A bender bar 1574 extends in the output direction from the lower nip stabilizer bar 1386 and is fixedly but adjustably attached thereto by a clamp plate 1575 and a pair of spanner bolts 1576. The pair of spanner bolts 1576 passes through clear holes in the clamp plate 1575 and threadably mount into the input end of the bender bar 1574. The bender bar 1574 is so positioned along the left side of the lower nip stabilizer bar 1386 to bring the output end of the bender bar 1574 to bear up against the left side of the carrier bottom panel 120 so that when the carrier bottom 112 is forced downwardly by the bender wheel 1570, the bottle carrier 106 will be permanently bent along the line of intersection between the carrier top and bottom panels 118 and 120, respectively, and the carrier bottom 112, as is shown in FIG. 45. The downward bend of the carrier bottom 112 assists in keeping the case stack of carriers 1299 in an erect position, as has been previously described.

The case 1288 incorporates the left and right side flaps 1310 and 1312 (FIGS. 2 and 23), respectively, that are controlled or guided by the left side guide assembly 1313 and the right side flap guide 1314, respectively, as the case 1288 descends past the nip wheel assembly 1294. Referring to FIG. 6, the left side guide assembly 1313 is comprised of a left hand outside guide 1578 and a left hand inside guide 1580. The left hand outside guide 1578 is fixedly attached to an angle bracket 1582 that is in turn rigidly affixed to the output surface of a pack assembly chain guard 1584 that is also shown in FIG. 7. The pack assembly chain guard 1584 is fixedly attached to the output end of the left member of the pair of pack assembly side plates 1015. The left hand outside guide 1578 extends upwardly and in the output direction (FIG. 7), and the upper extremity thereof flares outwardly toward the left side of the carrier packing assembly 22 as is clearly shown in FIGS. 45 and 48. The left hand inside guide 1580 is shown in FIGS. 44, 45 and 48, and is fixedly attached to the outboard surface of, and at the top outboard corner of, the left hand carrier guide 1296, and is in near parallel alginment with the left hand outside guide 1578. The upper portion of the left hand inside guide 1580 flares inwardly toward the centerline of the carrier packing assembly 22. The left hand outside guide 1578 is not adjustable, while the left hand inside guide 1580 is laterally adjustable since it is connected to the left hand carrier guide 1296. For small cases, only the left hand inside guide 1580 is functional since the left side flap 1310 will not reach the left hand outside guide 1578. For large cases then, the left side flap 1310 will be trapped between and temporarily bent by the left side guide assembly 1313 to insure that it does not interfere with the surrounding mechanisms of the carrier packing assembly 22 as it descends therethrough.

The right side flap guide 1314 is clearly shown in side elevation in FIG. 12, and in end elevation in FIG. 3. The right side flap guide 1314 is comprised of a flat diagonal member 1585 and a flat vertical member 1587. The flat diagonal member 1585 is fixedly attached at its lower extremity to the outboard surface of, and at the upper output corner of, the right hand carrier guide 1295. The upper portion of the flat diagonal member 1585 flares toward the centerline of the carrier packing assembly 22. Rigidly affixed to the upper extremity of the flat diagonal member 1585 is the flat vertical member 1587, which descends vertically in the same plane as the flared upper portion of the flat diagonal member 1585. The right side flap guide 1314 will receive the lower extremity of the right side flap 1312 and guide it outwardly around the mechanisms of the nip wheel assembly 1294. As the case 1288 descends, the right side flap 1312 is thereby guided through the clear space provided between the standoff bearing mount 1381 and the standoff mount 1383 of the U-shaped bracket of the bottom nip wheel structure that has been previously described. The right side flap guide 1314 is laterally adjustable since it is connected to the right hand carrier guide 1295 and is therefore functional for all case sizes.

Referring now to FIGS. 6 and 7, a limit switch LS-15 is associated with the pair of top pack nip wheels 1366. The limit switch LS-15 is fixedly attached to the outboard surface of a switch mount plate 1586 that is in turn fixedly but adjustably attached to the outboard surface of the left member of the pair of pack assembly side plates 1015. The switch mount plate 1586 incorporates a vertical slot 1588 that permits it to be vertically adjusted. A top nip switch arm 1591 is fixedly but adjustably attached to the working extremity of the limit switch LS-15, and rotatably incorporates at its upper extremity a switch roller 1592. The switch roller 1592 of the limit switch LS-15 works against the lower surface of a trigger angle 1594 that is rigidly affixed to the outboard surface of the left hand top nip radius arm 1404L and in juxtaposition to the top nip transfer bearing 1411. As has been previously described, the pair of top pack nip wheels 1366 is rigidly connected to the left hand top nip radius arm 1404L. Therefore, if the shingled stream of bottle carriers 1292 would jam in the nip wheel assembly 1294, the pair of top pack nip wheels 1366 and, subsequently, the left hand top nip radius arm 1404L would be forced upward, permitting the top nip switch arm 1591 to pivot counterclockwise, thus making the appropriate circuit that will stop machine operations and advance of conveyor belts of the machine.

Again referring to FIGS. 6 and 7, a limit switch LS-16 is shown therein. The limit switch LS-16 is fixedly attached to a standoff block 1595 that is in turn rigidly affixed to the outboard surface of the diverter stringer 1142. A tongue switch arm 1596, extending in the output direction, is pivotally attached to the working head of the limit switch LS-16. The output extremity of the tongue switch arm 1596 rotatably incorporates a tongue roller 1598 that in turn comes in rolling contact with the input surface of the retraction torque arm 1482 that motivates the hold down tongue 1298. The retraction cylinder 1484 withdraws the retraction cylinder rod 1488 and the retraction torque arm 1482 to a retract position indicated by the double dot and dash outline shown in FIG. 7. In so doing, the tongue roller 1598 is moved upwardly to a retracted position, also shown in double dot and dash line, which in turn pivots the tongue switch arm 1596 upwardly, thus making the limit switch LS-16. The limit switch LS-16 indicates that all machinery has been withdrawn from the case 1288, and subsequently causes the case 1288 to descend rapidly in preparation for another pack cycle.

Figure 1A:
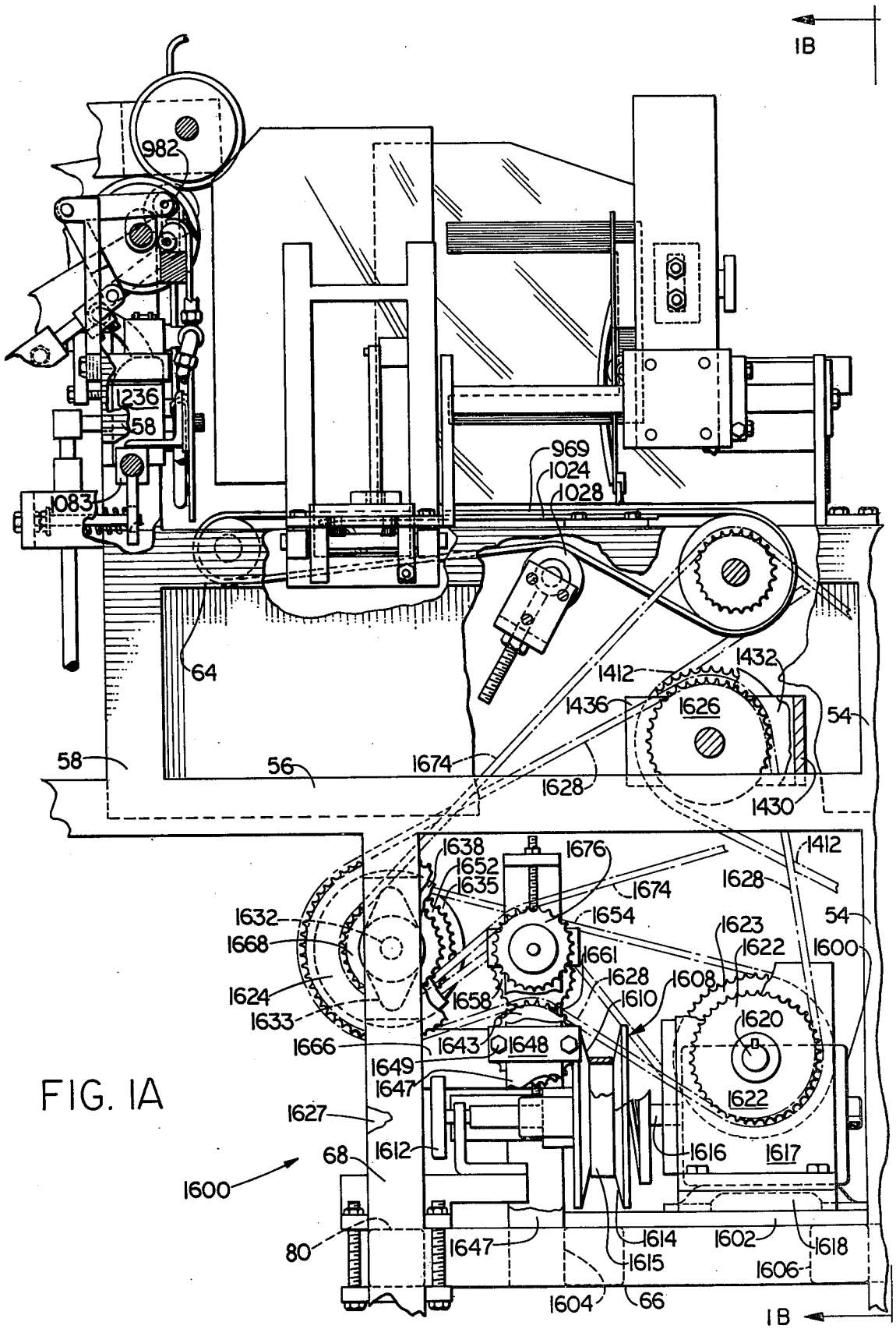
FIG. 1A is a side elevational view of a surge hopper assembly and a power assembly for the surge hopper assembly and a pack assembly section, parts being partially cut away to expose pertinent machinery.
Figure 1B:
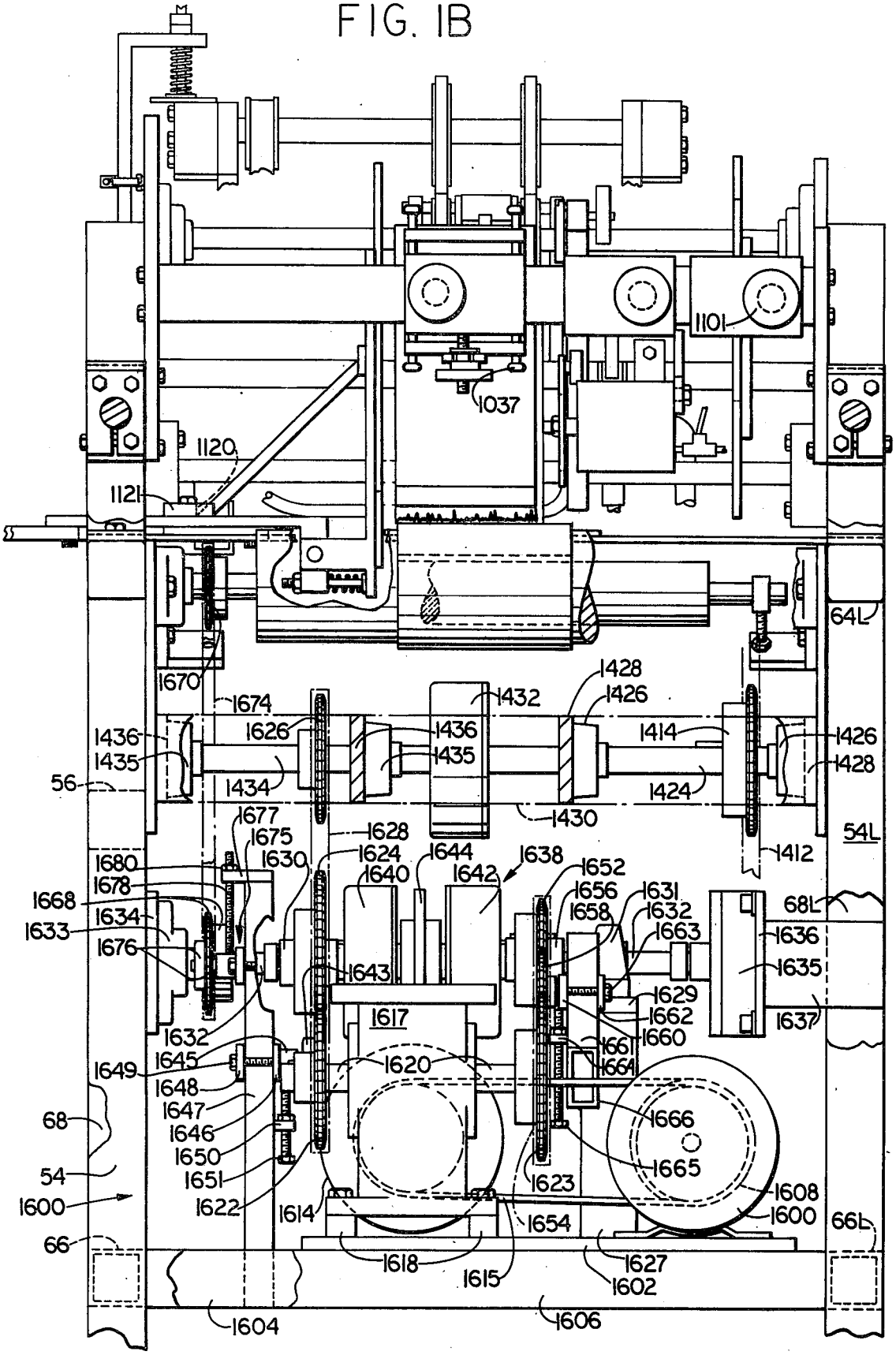
FIG. 1B is a view of the surge hopper in section taken on the line 1B–1B in FIG. 1A.

The surge-pack drive assembly 26 is shown in FIGS. 1A, 1B and 12, with some additional details shown in the plan view of FIG. 6. A pack motor 1600 is fixedly attached upon the top of, and to the left output side of, a drive assembly plate 1602 (FIG. 1B). The drive assembly plate 1602 is rigidly affixed across an input plate support 1604 and an output plate support 1606, both being lateral stiffeners that are rigidly affixed between the pair of short mounting members 66 and 66L, as in FIGS. 1A and 1B. The shaft of the pack motor 1600 is fitted with a variable width pulley 1608 that incorporates a movable disc 1610. The width of the variable width pulley 1608 can be set manually by a knob 1612 that in turn controls the radius about which a pack drive belt 1615 runs. A variable speed follower pulley 1614 is fixedly mounted upon a gear box input shaft 1616 of a reduction gear box 1617. The discs of the variable speed follower pulley are spring loaded and are consequently free to expand or contract according to the amount of transverse pressure applied by the pack drive belt 1615. As the knob 1612 is turned in one direction, the movable disc 1610 is moved toward its mate, thus forcing the pack drive belt 1615 to a larger radius. As the pack drive belt 1615 expands its circumference about the variable width pulley 1608, it must consequently decrease its circumference about the variable speed follower pulley 1614, forcing the discs of the variable speed follower pulley 1614 apart in opposition to spring pressure. In so doing, the speed of the gear box input shaft 1616 is adjusted downwardly, permitting the speed of the surge hopper belt 969 and the carrier packing assembly 22 to be synchronized with the speed of the bottle carrier inspection section 18. The reduction gear box 1617 is fixedly attached to the top surface of, and near the right hand output corner of, the drive assembly plate 1602, and physically elevated thereabove by the interspacing auspices of a pair of spacer bars 1618.

A gear box output shaft 1620 extends laterally from both sides of the reduction gear box 1617 and fixedly incorporates upon its right end a low speed transfer sprocket 1622 and upon its left end a high speed transfer sprocket 1623. The low speed transfer sprocket 1622 transmits power to a low speed sprocket 1642 and a pack clutch drive sprocket 1626 through a low speed pack chain 1628 as is shown in FIGS. 1A and 1B. The pack clutch drive sprocket 1626 is fixedly attached to the right side pack clutch shaft 1434, adjacent to the outboard face of the left member of the pair of right side bearing mounts 1436. Power is thereby delivered into the right side pack clutch shaft 1434, through the pack clutch 1432, the left side pack clutch shaft 1424, the distribution sprocket 1414, to the distribution chain 1412 of the nip wheel assembly 1294, as has been previously described.

The low speed sprocket 1624 is fixedly attached to a low speed coaxial shaft 1630 (FIG. 1B) that is in turn rotatably mounted upon a conveyor speed shaft 1632. The conveyor speed shaft 1632 is rotatably mounted in a right side speed shaft bearing 1633 and a middle speed shaft bearing 1631. The right side speed shaft bearing 1633 is fixedlby mounted to a bearing pad 1634 that is in turn affixed to the inboard surface of the right hand short vertical hanger 68 somewhat below the intersection of the right hand short stringer 56. The middle speed shaft bearing 1631 is fixedlby attached upon the top of a bearing pad 1629 that is in turn rigidly affixed upon the top of a short bearing riser 1627. The short bearing riser 1627 is rigidly affixed upon the top of the drive assembly lateral stiffener 80 somewhat left of center of the surge-pack drive assembly 26. The conveyor speed shaft 1632 extends through the middle speed shaft bearing 1631 to extend to the left thereof, where it is coupled to a belt drive brake 1635. The belt drive brake 1635 is fixedly attached to the inboard surface of the standoff brake mount 1636. The standoff plate 1637 is rigidly affixed in a perpendicular manner to the center of the outboard surface of the standoff brake mount 1636, and rigidly mounted at its other end to the output surface of the left hand short vertical hanger 68L. A two speed pack clutch 1638 is mounted upon the center of the conveyor speed shaft 1632 and is comprised of a low speed pack clutch 1640, a high speed pack clutch 1642 and a pack clutch armature assembly 1644. The left hand extremity of the low speed coaxial shaft 1630 is fixedly attached within the low speed pack clutch 1640, and is engageably connected to the conveyor speed shaft 1632 by the pack clutch armature assembly 1644. In this manner, the right side pack clutch shaft 1434 and the low speed coaxial shaft 1630 are driven continuously from the low speed side of the reduction gear box 1617, while the conveyor speed shaft 1632 is selectively driven when the low speed pack clutch 1640 is engaged to the pack clutch armature assembly 1644.

The low speed pack chain 1628 (see FIG. 1A), passes in the clockwise direction about the low speed transfer sprocket 1622, the low speed sprocket 1624 and the pack clutch drive sprocket 1626. Tension is maintained in the low speed pack chain 1628 by a low speed idler 1643 that is rotatably mounted upon the inboard face of an idler block 1645. The idler block 1645 is rigidly affixed to the inboard surface of a spanner plate 1646 that is in turn fixedly but adjustably clamped to the inboard face of a right side idler riser 1647 by a spanner back plate 1648 and a pair of spanner bolts 1649. A stop lug 1650 is rigidly attached to the inboard face of the right side idler riser 1647 just below the idler block 1645 of the low speed idler 1643. The riser screw 1651 is threadably mounted through the stop lug 1650 from the bottom and rises to exert a lifting pressure against the bottom of the idler block 1645 to forcefully raise the low speed idler 1643 into pressure contact against the bottom of the low speed pack chain 1628, thereby producing tension therein. The right side idler riser 1647 is rigidly affixed in a vertical disposition to the input side of the input plate support 1604.

The high speed transfer sprocket 1623 (FIG. 1B) transmits power from the left side of the gear box output shaft 1620 to a high speed sprocket 1652 by a high speed pack chain 1654. The high speed sprocket 1652 is fixedly attached to a high speed coaxial shaft 1656 that is in turn rotatably mounted upon the conveyor speed shaft 1632, to the left of, the two speed pack clutch 1638. The right extremity of the high speed coaxial shaft 1656 is fixedly attached within the high speed pack clutch 1642, and is selectively engaged to the conveyor speed shaft 1632 through the pack clutch armature assembly 1644. Referring to FIG. 34, the high speed pack chain 1654 passes about the high speed transfer sprocket 1623 and the high speed sprocket 1652 in the clockwise direction. Tension is maintained in the high speed pack chain 1654 by a high speed idler sprocket 1658. The high speed idler sprocket 1658 is rotatably attached to a spanner mount 1660 that is in turn fixedlby but adjustably attached to the right hand face of a short idler riser 1661 by a spanner back mount 1662 and a pair of spanner bolts 1663, as shown in FIG. 1B. An adjustment lug 1664 is rigidly affixed across the right hand face of the short idler riser 1661 just below the spanner mount 1660, and threadably incorporates a long adjustment screw 1665 vertically disposed therethrough to bring an upward pressure against the bottom of the spanner mount 1660. Consequently, the high speed idler sprocket 1658 is brought to bear against the bottom of the lower portion of the high speed pack chain 1654, raising it as in FIG. 34, and producing tension therein. The short idler riser 1661 is rigidly affixed upon the top output end of a short cantilever tube 1666 that is in turn rigidly affixed to the output face of the short bearing riser 1627.

The pack clutch armature assembly 1644 of the two speed pack clutch 1638 can be engaged to the low speed pack clutch 1640, or to the high speed pack clutch 1642, or to neither. With this facility, the conveyor speed shaft 1632 will receive either high or low speed power, or neither, at which time the belt drive brake 1635 is engaged to stop it abruptly. Power is taken from the conveyor speed shaft 1632 by means of a conveyor power sprocket 1668 that is fixedly attached to the right side thereof and adjacent to the right side speed shaft bearing 1633. Referring to FIGS. 34, 48 and 51, power is transferred from the conveyor power sprocket 1668 (FIG. 1A) to a surge conveyor input sprocket 1670 (FIG. 12) and a pack conveyor input sprocket 1672 by a conveyor chain 1674 that runs in clockwise manner thereabout. The surge conveyor input sprocket 1670 (FIG. 6) is fixedly attached to the right hand side of the surge output shaft 1020 and the pack conveyor input sprocket 1672 is fixedly attached to the right hand side of the pack conveyor drive shaft 1326. A conveyor chain tension idler 1676 (FIG. 1B) is rotatably mounted to the upper portion of the right side idler riser 1647 by an idler mount fixture 1675 in the same way as the low speed idler 1643 of the low speed pack chain 1628, but in reverse lateral position. A top adjustment lug 1677 is rigidly affixed in an overhung manner to the top extremity of the right side idler riser 1647 so that a lifter screw 1678, that is rigidly affixed in a vertical manner in the top of the idler mount fixture 1675, can pass vertically upward through a clear hole in the overhung portion thereof. An adjustment nut 1680 is run down the lifter screw 1678 and against the top surface of the top adjustment lug 1677 to forcefully raise the conveyor chain tension idler 1676 into contact with the bottom surface of the bottom portion of the conveyor chain 1674, thereby providing tension therein.

In consequence then, power is continuously supplied by the pack motor 1600 to the variable width pulley 1608, to the pack drive belt 1615, to the variable speed follower pulley 1614, and to the reduction gear box 1617. The speed of the reduction gear box 1617 is manually adjustable through the function of the variable width pulley 1608 and the variable speed follower pulley 1614, as previously described. Power is then continuously supplied from the reduction gear box 1617 to the low speed pack chain 1628 and the high speed pack chain 1654. Subsequently, the low speed pack chain 1628 delivers power to the pack clutch drive sprocket 1626 and makes power available in the low speed pack clutch 1640, while the high speed pack chain 1654 makes power available in the high speed pack clutch 1642. Assuming that the surge hopper 20 is empty, then the pack clutch armature 1644 is not engaged to either the low or high speed pack clutch 1640 and 1642, respectively, leaving the conveyor speed shaft 1632 without power and fixedly held from rotation by the belt drive brake 1635.

As bottle carriers 106 begin to fill the surge hopper 20, they begin to form the stack of carriers 973. As the stack of carriers 973 reaches a minimum height, the first pole of the limit switch LS-9 is made, activating the proper circuit that simultaneously disengages the belt drive brake 1635 and engages the pack clutch armature 1644 to the low speed pack clutch 1640, thus putting the surge hopper belt 969 and the packing belt 1290 into low speed operation. The stack of carriers 973 will continue to rise in the surge hopper 20 until the second pole of the limit switch LS-9 is made, which activates the proper circuit that causes the pack clutch armature 1644 to disengage the low speed pack clutch 1640 and engage the high speed pack clutch 1642. Thus the surge hopper belt 969 and the packing belt 1290 is transferred into high speed operation which will gradually lower the stack of carriers 973 in the surge hopper 20. As the stack of carriers 973 reaches its minimum height, the first pole of the limit switch LS-9 is again made, low speed operation resumes and the cycle repeats itself until it is interrupted by the count switch 1309 of the carrier packing assembly 22.

Figure 8:
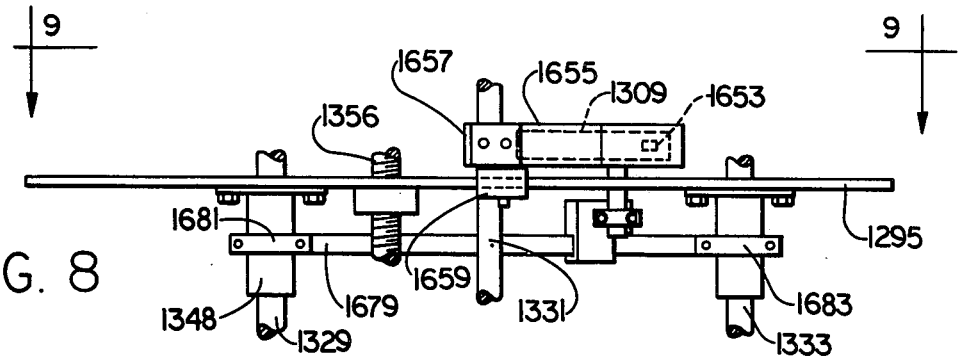
FIG. 8 is a fragmentary plan view showing a side guide, a count switch and a count switch spring.
Figure 9:
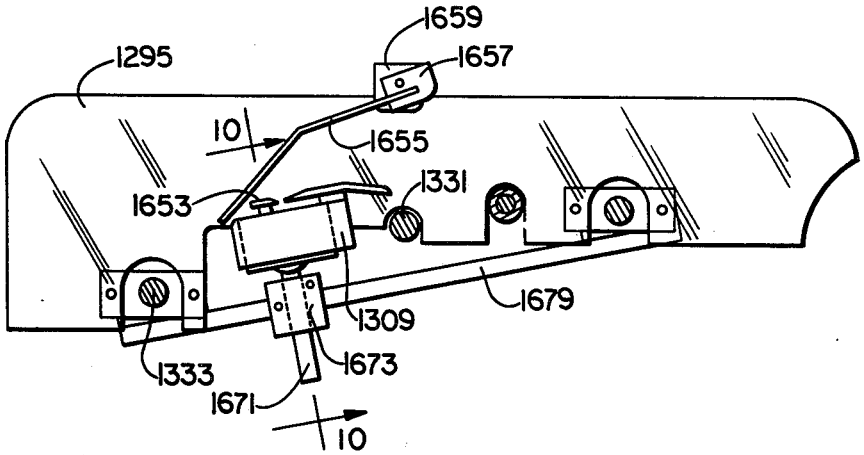
FIG. 9 is a fragmentary view in section taken in the direction of the arrows 9—9 in FIG. 8.
Figure 10:
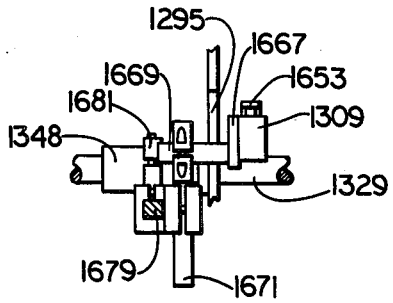
FIG. 10 is a view in section taken on the line 10—10 in FIG. 9.

As has been previously described, the count switch 1309 governs the number of bottle carriers 106 entering each case 1288 in normal operation. As shown in FIGS. 8, 9 and 10, the count switch 1309 is mounted to move with the right hand carrier guide 1295. The count switch can be of the type shown in Lloyd patent No. 3,715,529, and a push-button 1653 thereof is depressed by the trailing edge of each carton and is released when the trailing edge has passed to record the passage of each carton. A leaf spring 1655 holds the cartons in position for engagement with the push-button 1653. The spring 1655 is mounted in a spring bracket 1657. The spring bracket 1657 is supported by a clamp bracket 1659 which is mounted on the upper edge of the right hand carrier guide 1295. The count switch 1309 is mounted on a bracket 1667 having a shank 1669 adjustably mounted in an upright split ring eyebolt 1671. The shank of the eyebolt 1671 is mounted in a slide member 1673, which is carried by a rod 1679. The rod 1679 is supported on clamp fittings 1681 and 1683 mounted on the right hand slide mounts 1348. As the count switch reaches its preset number, it makes the appropriate circuit that disengages the pack clutch solenoid 1644 (FIG. 1B) from both the low and high speed pack clutch 1640 and 1642, respectively, and engages the belt drive brake 1635, stopping the surge hopper belt 969 and the packing belt 1290 abruptly. The pack clutch drive sprocket 1626 ordinarily runs continuously, as does the nip wheel assembly 1294, unless the limit switch LS-15 is released. Release of the limit switch LS-15 indicates a build-up of cartons at the nip wheel assembly 1294. When the limit switch LS-15 is released, the operation of the machine and the advance of conveyor belts is arrested, as already pointed out. The case fill cycle can be synchronized with the surge hopper cycle so that when the count switch goes off, the stack of carriers in the surge hopper 22 will be near its low point, so that while the surge hopper discharge is stopped, a sufficient length of time is available to allow the surge hopper to fill, but not overfill, until the next case 1288 is in place and filling.

CASE HANDLING ASSEMBLY

Figure 20:
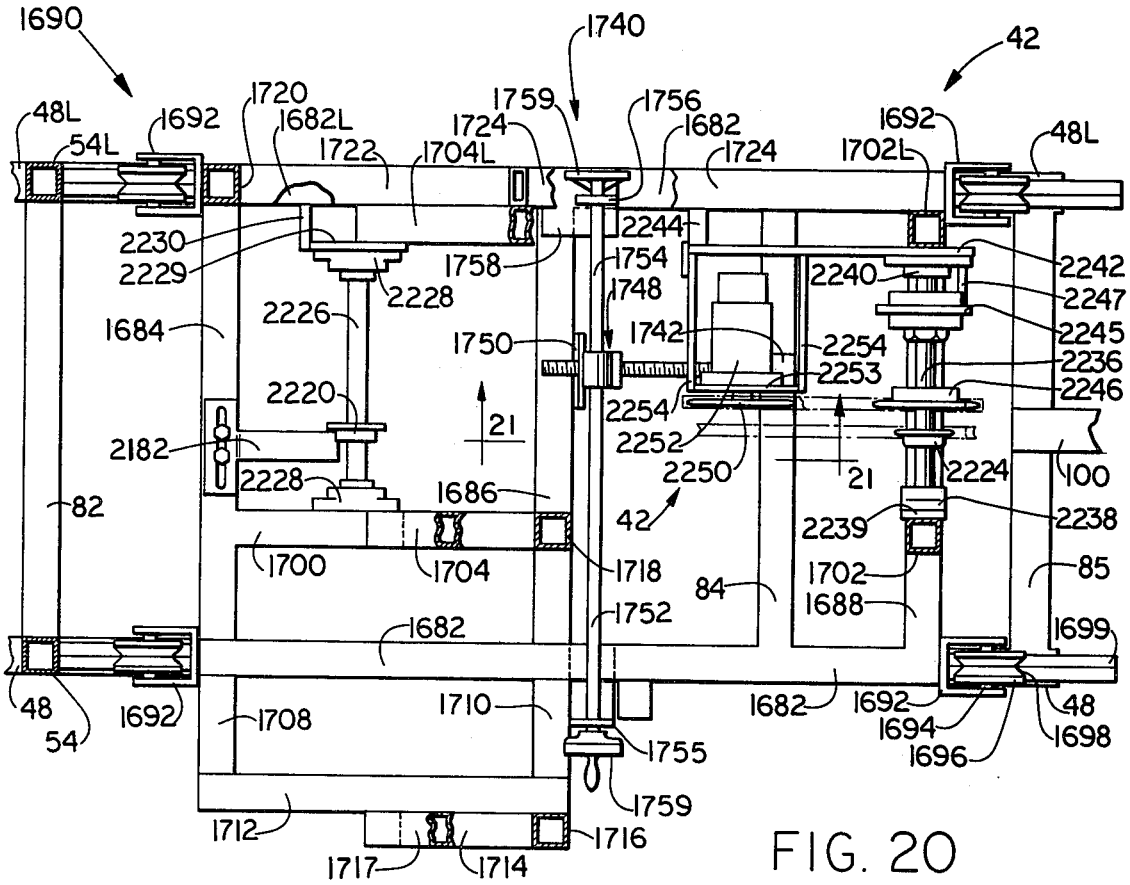
FIG. 20 is a view of the lower extremity of a case handling assembly and taken in section generally along the line 20—20 in FIG. 1.

Referring to FIGS. 1 and 20, the case section frame assembly 44 incorporates a pair of base stringers 1682 and 1682L that is rigidly held in lateral and parallel spaced relationship by an input lateral brace 1684, a middle lateral brace 1686 and an output lateral brace 1688 to form a base rectangle 1690. Rigidly affixed at each corner of the base rectangle 1690 is a wheel yoke 1692 that incorporates a wheel axle 1694 and a wheel 1696. The four wheels 1696 of the base rectangle 1690 each incorporate a V-shaped groove 1698 that cooperates with an inverted angle iron 1699 that functions as a guide rail. The input pair of inverted angle irons 1699 is rigidly affixed upon the top of the pair of bottom stringers 48 and 48L, and butt against the output side of the pair of output posts 54 and 54L, while the remaining two inverted angle irons 1699 are rigidly affixed upon the pair of bottom stringers 48 and 48L at the output end thereof, and somewhat overhung therefrom. In this manner, the four inverted guide rails 1699 allow the mobile base rectangle 1690 of the case handling assembly 14 enough longitudinal freedom to accommodate a full range of sizes of the case 1288. A secondary longitudinal beam 1700 is rigidly affixed between the output face of the input lateral brace 1684 and the input face of the middle lateral brace 1686, and appropriately spaced to the left side of the right hand base stringer 1682 so it will serve as base mounting structure for the elevator incline 36 and the output tipover assembly 40.

The structure of the elevator incline 36 of the case section frame assembly 44 incorporates a pair of tall risers 1702 and 1702L rigidly affixed upon the top surface of the output lateral brace 1688. The left hand tall riser 1702L is located at the left end of the output lateral brace 1688 but not upon the left hand base stringer 1682L. The right hand tall riser 1702 is longitudinally aligned with the secondary longitudinal beam 1700. The top extremities of the pair of tall risers 1702 and 1702L are finished at an acute angle to accommodate a pair of incline risers 1704 and 1704L that is rigidly affixed thereto. The bottom extremity of the left hand incline riser 1704L is rigidly affixed to the inboard surface of the left hand base stringer 1682L approximately halfway between the input and middle lateral braces 1684 and 1686, respectively. The bottom extremity of the right hand incline riser 1704 is rigidly affixed to the top surface of the secondary longitudinal beam 1700 and in lateral alignment with the left hand incline riser 1704L. The right and left sides of the elevator incline 36 are held in fixed lateral and parallel alignment by an incline brace 1706 (FIG. 1).

The structure of the output tipover assembly 40 of the case section frame assembly 44 incorporates an input lateral brace extension 1708 (FIG. 20) that extends rigidly outward in a cantilever manner to the right of the case handling assembly 14. A middle lateral brace extension 1710, of equal dimension to the input lateral brace extension 1708, is likewise rigidly affixed to the outboard surface of the right hand base stringer 1682 and in lateral alignment with the middle lateral brace 1686. Rigidly affixed to the outboard extremities of the input and middle lateral brace extensions 1708 and 1710, respectively, is an outboard longitudinal beam 1712, which in turn rigidly incorporates upon its outboard surface, and adjacent its output end, a short base doubler 1714. Rigidly affixed in an upright position upon the output end of the short base doubler 1714 is an output tipover riser 1716, the top end of which is finished at an acute angle that receives a short incline riser 1717 to which it is rigidly affixed. The short incline riser 1717 is also rigidly affixed upon the input end of the short base doubler 1714. The short incline riser 1717 and the right hand incline riser 1704 are in parallel alignment. A left hand output tipover riser 1718 is rigidly affixed between the top surface of the middle lateral brace 1686 and the lower surface of the steeply angled right hand incline riser 1704.

The structure of the case pushoff assembly 38 of the case handling assembly 14 is comprised of a pushoff riser 1720, a top longitudinal beam 1721 and a lower longitudinal beam 1722 as is also shown in FIGS. 1 and 20. The pushoff riser 1720 is rigidly affixed in an upright position upon the left hand input corner of the base rectangle 1690 of the case section frame assembly 44. The input end of the top longitudinal beam 1721 is rigidly affixed upon the top of the pushoff riser 1720 and extends horizontally in the output direction therefrom to be rigidly affixed upon the outboard surface of the left hand incline riser 1704L. The top longitudinal beam 1721 lies in the same vertical plane as the left hand short stringer 56L of the carrier handling assembly 12. As previously described, the left hand member of the pair of pack assembly side plates 1015 is rigidly affixed to the inboard surface of the left hand short stringer 56L. Therefore, the top longitudinal beam 1721 of the case handling assembly 14 lies just underneath, and to the outboard side of, the left hand member of the pair of pack assembly side plates 1015, causing no interference between the case handling assembly 14 and the bottle carrier handling assembly 12. The input end of the lower longitudinal beam 1722 of the case handling assembly 14 is rigidly affixed to the output surface of the pushoff riser 1720 and extends horizontally in the output direction to be rigidly affixed upon the outboard surface of the left hand incline riser 1704L, as is specifically shown in FIGS. 1 and 20. A power assembly mount beam 1724 is rigidly and horizontally affixed upon the outboard surfaces of the left hand incline riser 1704L and the left hand tall riser 1702L at a somewhat higher elevation than the lower longitudinal beam 1722, as is also shown in the Figures.

Figure 22:
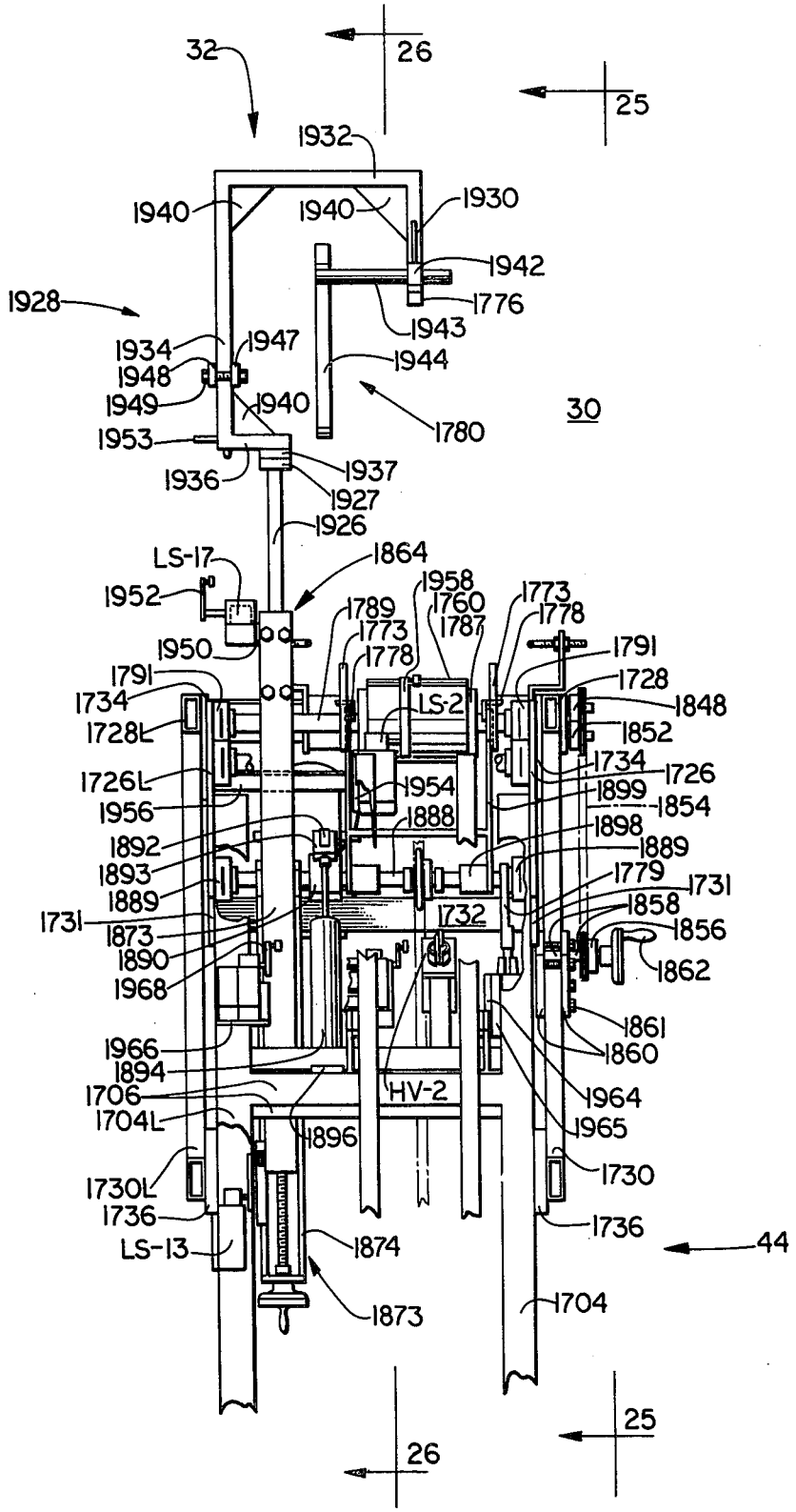
FIG. 22 is a front elevational view of a case input conveyor, case tipover assembly and upper portion of an elevator incline assembly.

The structure of the case input conveyor 30 of the case handling assembly 14 is shown in FIGS. 1 and 22, and incorporates a pair of pivot plates 1726 and 1726L, a pair of horizontal rails 1728 and 1728L, and a pair of diagonal stiffeners 1730 and 1730L. The pair of pivot plates 1726 and 1726L is rigidly affixed to the outboard surfaces of, and at the upper extensions of, the pair of incline risers 1704 and 1704L, respectively, in such manner that the pair of pivot plates 1726 and 1726L extend in a cantilever manner toward the output end of the bottle carrier checker/packer 10. The bottom output corners of each plate of the pair of pivot plates 1726 and 1726L integrally incorporate a vertical hanger 1731 that functions as a mounting bracket for a lateral pivot stiffener 1732. The lateral pivot stiffener 1732 functions to keep the pair of pivot plates 1726 and 1726L in rigid and lateral spaced relationship, as well as providing a structural mounting means for a cantilever motor mount 1733. The pair of horizontal rails 1728 and 1728L is rigidly affixed to the outboard surfaces of the pair of pivot plates 1726 and 1726L, respectively, through the interspacing auspices of a pair of spacing plates 1734. The pair of spacing plates 1734 is of rectangular shape and is centrally located at the upper edge of the pair of pivot plates 1726 and 1726L. The output ends of the pair of horizontal rails 1728 and 1728L are rigidly held in horizontal disposition by the pair of diagonal stiffeners 1730 and 1730L that is in turn rigidly affixed to the outboard surfaces of the pair of incline risers 1704 and 1704L through the interspacing auspices of a pair of spacer blocks 1736. Lastly, the output extremity of the pair of horizontal rails 1728 and 1728L is rigidly held in lateral spaced relationship by a stabilizer bar 1738 (FIG. 1).

Figure 21:
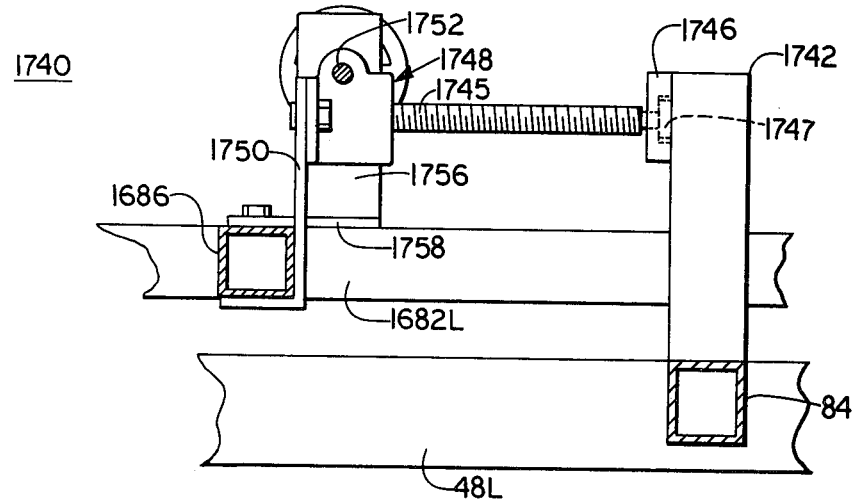
FIG. 21 is a fragmentary view in section showing a case handling section adjustment and lock assembly taken on the line 21—21 in FIG. 20.

Referring to FIGS. 1, 20 and 21, the case section frame assembly 44 is moved and fixedly held upon the output extension of the carrier section frame assembly 28 by a jack screw adjustment and holding assembly 1740. The jack screw adjustment and holding assembly 1740 incorporates a jack screw anchor 1742 that is rigidly affixed in an upright position upon the top surface of the case lateral stiffener 84. The output end of a longitudinal jack screw 1745 is attached to the input face of, and at the upper end of, the jack screw anchor 1742 by a retainer pad 1746 and retaining lug 1747. The shaft of the retaining lug 1747 is held in a socket of the retainer pad 1746. The shaft of the retaining lug 1747 is rigidly affixed within the output end of the longitudinal jack screw 1745. A jack 1748 is in turn fixedly attached to the upper output surface of a jack mount 1750. The jack mount 1750 is an L-shaped bracket whose lower extremity is fixedly attached to the under surface of the middle lateral brace 1686 while its upper extension lies against the output face thereof.

A shaft of the jack 1748 incorporates a right side shaft extension 1752 and a left side shaft extension 1754. The right side shaft extension 1752 extends laterally to the right, its right end being rotatably held in the vertical flange of an angle mount 1755 (FIG. 20). The horizontal extremity of the angle mount 1755 extends inboardly and is rigidly affixed to the bottom surface of the right hand base stringer 1682. The vertical flange of the angle mount 1755 is laterally displaced to the right of the right hand base stringer 1682 to make allowance for a cylinder and mount of the output tipover assembly 40 to be discussed hereinafter. The left side shaft extension 1754 extends laterally to the left and is rotatably held through the upper end of a left side shaft mount 1756 that is rigidly affixed in a perpendicular orientation to the upper surface of a shaft mount base plate 1758. The shaft mount base plate 1758 is fixedly attached to the upper surface of the middle lateral brace 1686 and the left hand base stringer 1682L. The outboard extremities of the right and left side shaft extensions 1752 and 1754 respectively are fixedly fitted with a pair of crank wheels 1759. In this manner, the case section frame assembly 44 can be moved by manual rotation of either one of the pair of crank wheels 1759 that requires only a small torque for rotation thereof. Since the longitudinal jack screw 1745 is greatly geared down with respect to the right and left side shaft extensions 1752 and 1754, respectively, the frame assembly 44 will also be held in fixed longitudinal placement.

Figure 23:
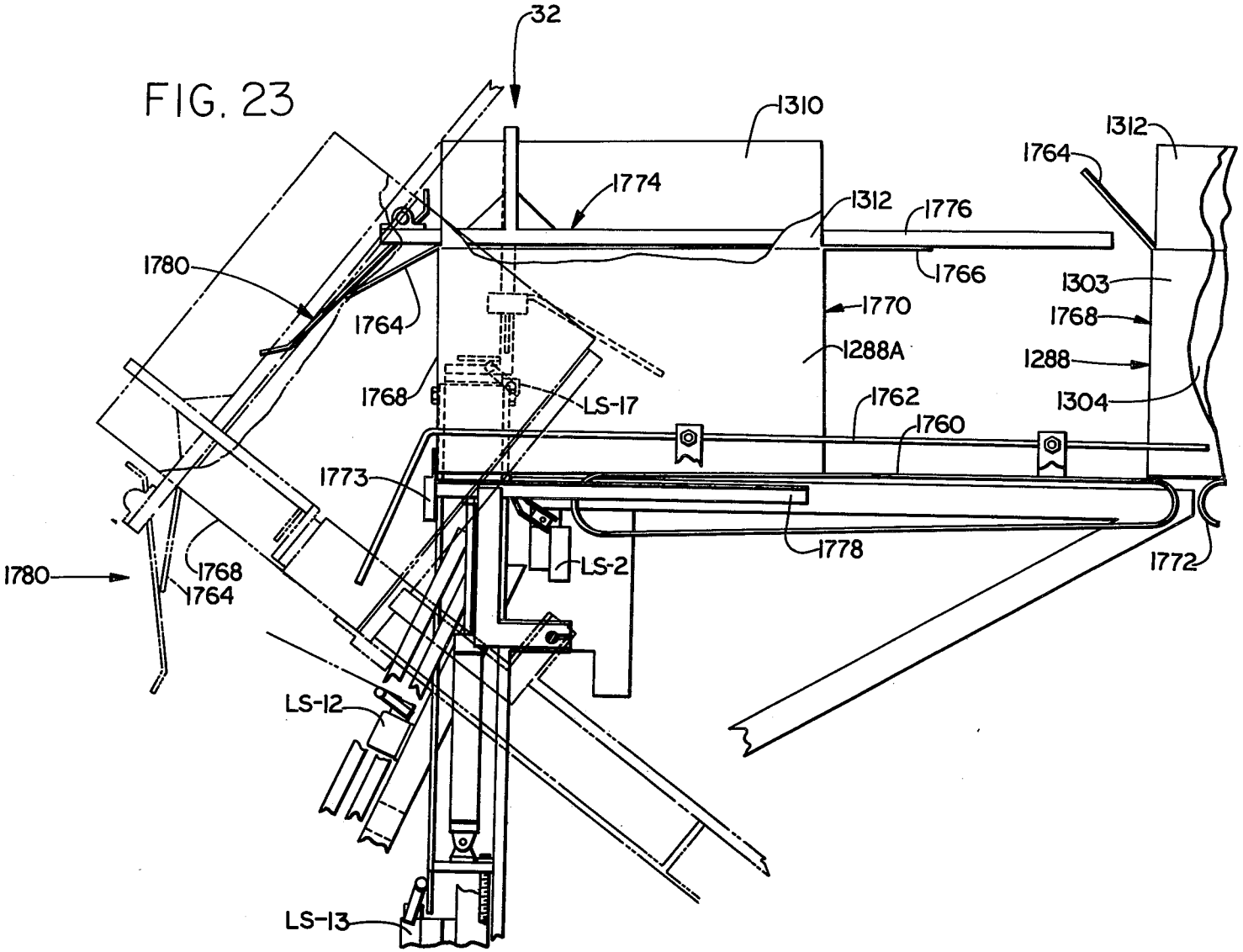
FIG. 23 is a schematic view in side elevation of the machinery shown in FIG. 22 showing the corrugated case as it is processed in the case input section, a partially processed case and associated machine parts being shown in double-dot-dash lines.

The upper portion of the case handling assembly 14 is shown in schematic form in FIG. 23. The corrugated case 1288 is manually or mechanically placed upon a case conveyor 1760 and between a pair of side guide rails 1762. The case 1288 is pre-assembled with its top flaps left open. More specifically, the left side flat 1310 and the right side flap 1312 are not bent or broken inwardly, and therefore remain in stiff and aligned relationship with the case left side 1304 and case right side 1303, respectively. An input end flap 1764 and an output end flap 1766 are broken outwardly to a horizontal position, and upon release, spring upward to assume a somewhat outwardly angled relationship with a case input end 1768 and a case output end 1770.

If the cases 1288 are delivered mechanically, they are received from a customer input conveyor 1772 as is indicated in FIG. 62. Referring now to FIGS. 22 and 23, the case conveyor 1760 runs in a counterclockwise direction when a limit switch LS-13 is engaged by the lower extremity of the input tipover assembly 32, thus carrying the case 1288 in the direction of the input end of the bottle carrier checker/packer 10. When the leading portion of the case 1288 is extended beyond the input end of the case conveyor 1760, its forward motion is halted by a pair of retainer tines 1773. At the same time, the case 1288 depresses a limit switch LS-2 that turns off the case conveyor 1760 and makes the appropriate circuit which causes a compressor 1774 to move downward upon the top of the case 1288, thereby trapping the case 1288 between a top compressor bar 1776 and a pair of tipover rails 1778. The top compressor bar 1776 incorporates upon its input end a flap bender assembly 1780 that serves to sufficiently depress the input end flap 1764 downwardly past the horizontal plane so that the input end flap 1764 is properly positioned to be received by a flap retainer 1998 (FIG. 36) of the elevator 34. As the compressor 1774 (FIG. 23) reaches the bottom of its travel, a limit switch LS-17 is depressed as is also indicated in FIGS. 61 and 62.

Figure 26:
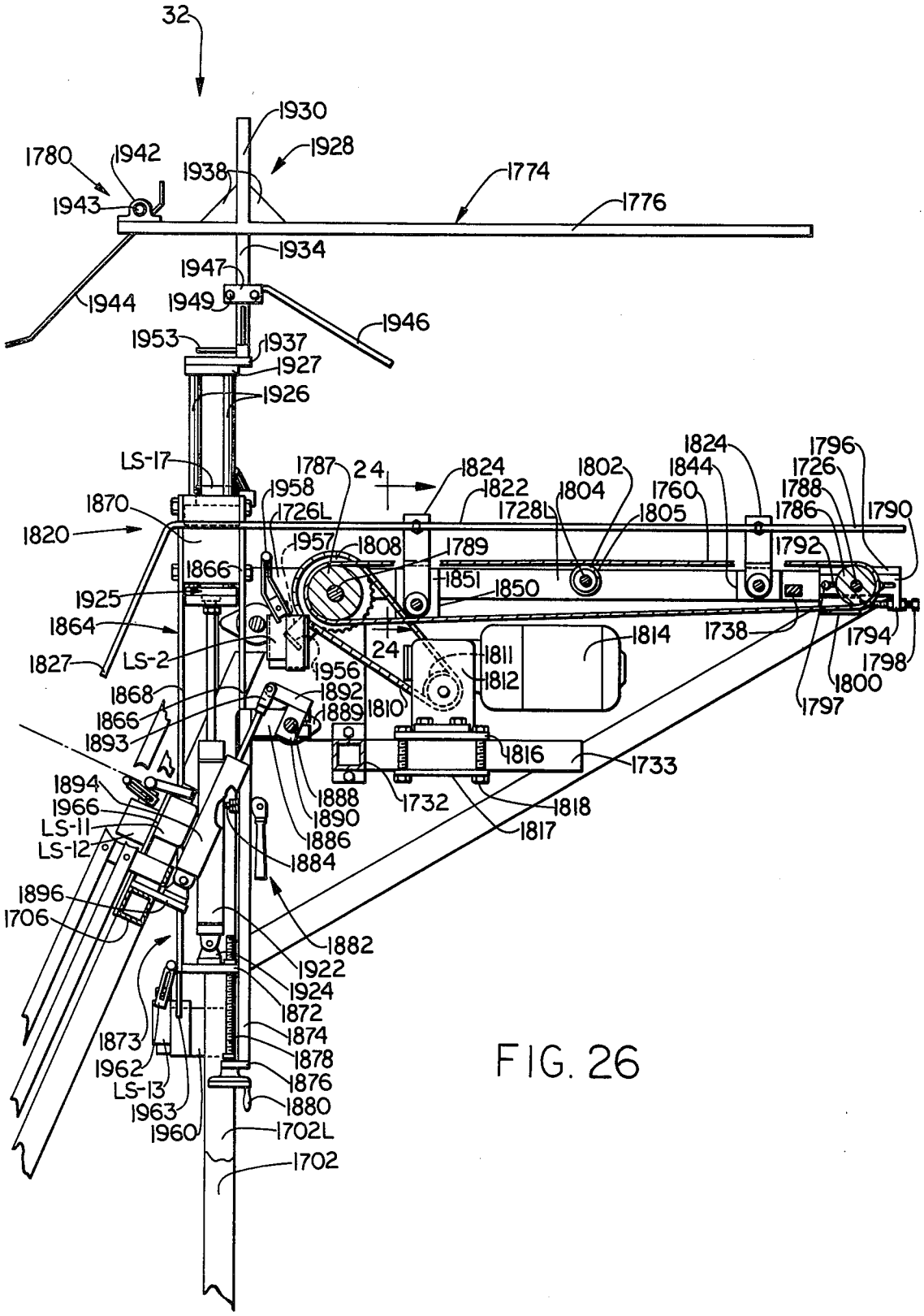
FIG. 26 is a sectional view of the case input section taken on the line 26—26 in FIG. 22.

As LS-17 is made, the input tipover assembly 32 raises the case 1288 off the case conveyor 1760 and tips it counterclockwise with respect to FIG. 23 to a position indicated in double dot-dash lines in the Figure. This position is considered to be approximately eighty percent of full tip, when full tip infers that the case 1288 is in parallel alignment with the elevator incline 36. The input tipover assembly 32 is stopped in the 80% tip position when a hydraulic valve HV-1 is depressed by a tip cam 1779 of the input tipover assembly 32, as is shown in FIGS. 22 and 25. The input tipover assembly 32 will remain in this position until the packing elevator 34 (FIG. 1) moves up the elevator incline 36 and operates a limit switch LS-11 and a hydraulic valve HV-2 that are shown in FIGS. 22, 25 and 26. The limit switch LS-11 stops the packing elevator 34 in its upward travel and resets the entire control circuitry thereof for downward movement and then waits for the tip operation to be completed. The hydraulic valve HV-2 is a release valve that permits the input tipover assembly 32 to complete its tip, bringing the case 1288 into parallel alignment with, and upon the top of, the packing elevator 34.

The pair of retainer tines 1773 are subsequently rotated counterclockwise with respect to FIG. 23, releasing the case 1288 from the tipover assembly 32. As the tip is completed, the input tipover assembly 32 depresses a limit switch LS-12, that is shown in FIGS. 22 and 23. The limit switch LS-12 makes the appropriate circuit that releases the compressor 1774, and also satisfies a dual condition with the limit switch LS-11 (FIG. 31) that, after a slight delay, sends the packing elevator 34 and the case 1288 down the elevator incline 36 in fast traverse.

Figure 29:
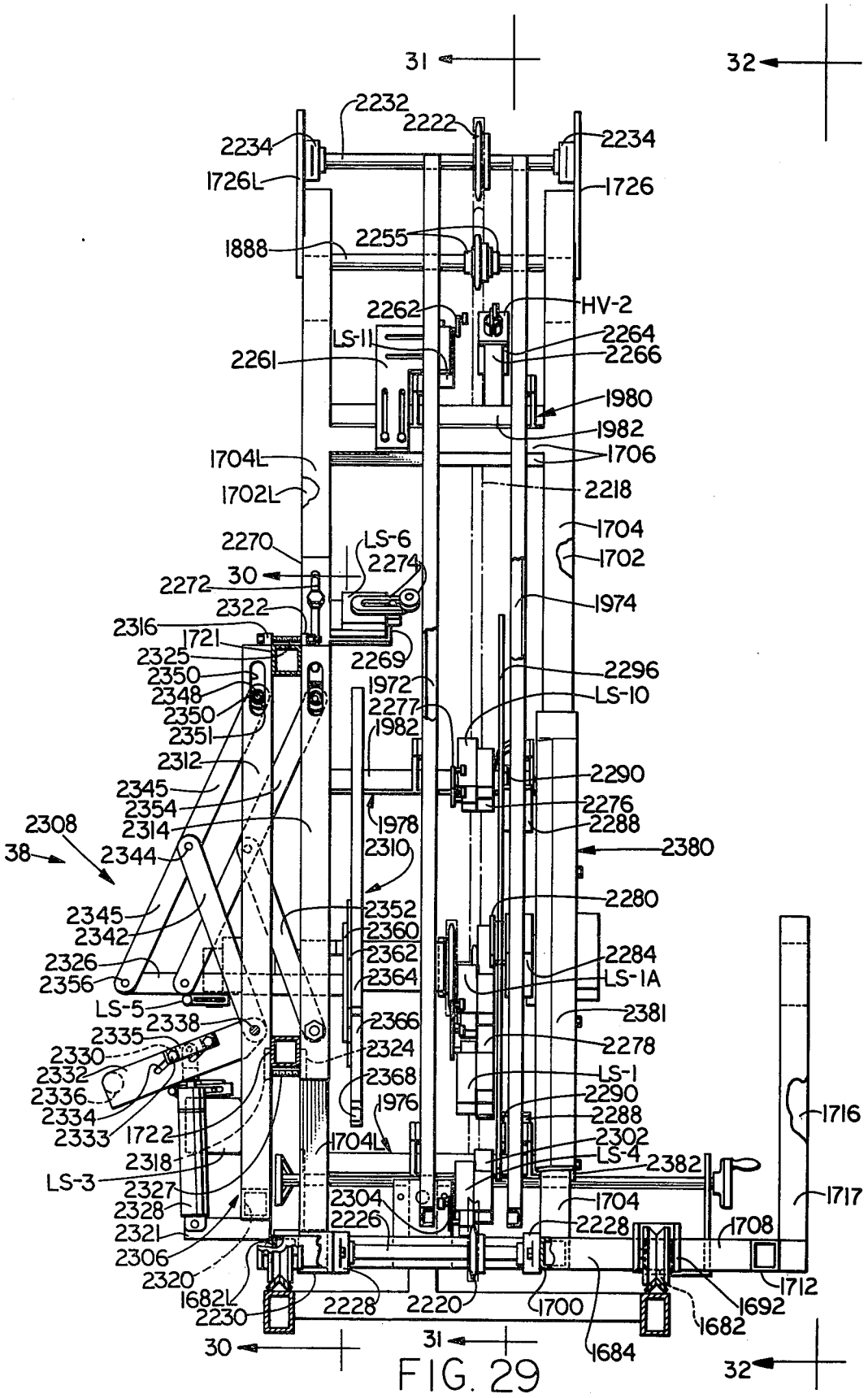
FIG. 29 is a front elevational view of the elevator incline of the bottle carrier checker/packer machine including a case pushoff assembly, some parts having been cut away for clarity, some frame elements being shown in section.

As is shown in FIGS. 29 and 31, the packing elevator 34 trips a limit switch LS-6 as it descends which causes four other functions to follow. First, the fast traverse of the packing elevator 34 is terminated. Second, and as can be seen in FIGS. 1A, the appropriate circuit is made that permits the packing belt 1290 and the surge hopper belt 969 to run, thereby bringing bottle carriers 106 from the surge hopper 20 to the case 1288. Third, the limit switch LS-6 also makes the appropriate circuit that causes the hold down tongue 1298 to be inserted into the case 1288 and, finally, it energizes the hydraulic servo system that is governed by the microtorque valve 1301, so that the packing elevator 34 will descend in concert with the number of bottle carriers 106 entering the case 1288.

As the case 1288 is filling, the packing elevator 34 trips a toggle-action limit switch LS-10 that is shown in FIGS. 29 and 31. As this circuit is made, the input tipover assembly 32 is returned to its upright position and receives another case 1288. The packing elevator 34 continues to fill and descend, and subsequently contacts the limit switch LS-1A near the end of the fill cycle. As previously described, the limit switch LS-1A energizes the counter circuit, and if all is normal, the fill cycle will terminate on count. If not, the limit switch LS-1 will terminate the fill cycle based on physical dimensions as the packing elevator 34 trips it. The packing elevator 34 halts until the limit switch LS-16 (FIG. 7) of the carrier packing assembly 22 is actuated, indicating that the hold down tongue 1298 is clear of the case 1288, thereupon the packing elevator 34 (FIG. 31) is energized to move down fast.

As the packing elevator 34 reaches the bottom of the elevator incline 36, it trips a limit switch LS-4 that is shown in FIGS. 29 and 31, that in turn makes the appropriate circuit that stops the packing elevator 34. The limit switch LS-4 also energizes the case pushoff assembly 38, that is shown in FIGS. 29, 30 and 31, and that extends laterally to the right of the bottle carrier checker/packer 10 to push the full case 1288 off the packing elevator 34 and onto the output tipover assembly 40.

Before the case 1288 translates to the right, the input end flap 1764 has assumed a position 1764A as a result of being downwardly bent by the compressor 1774 as was previously described and is seen in the lower portion of FIG. 33. As the case 1288 is translating to the right, a folding rod 1782, that extends inboardly and downwardly in a smooth curve, catches underneath the input end flap 1764A and folds it to a position 1764B.

Figure 38:
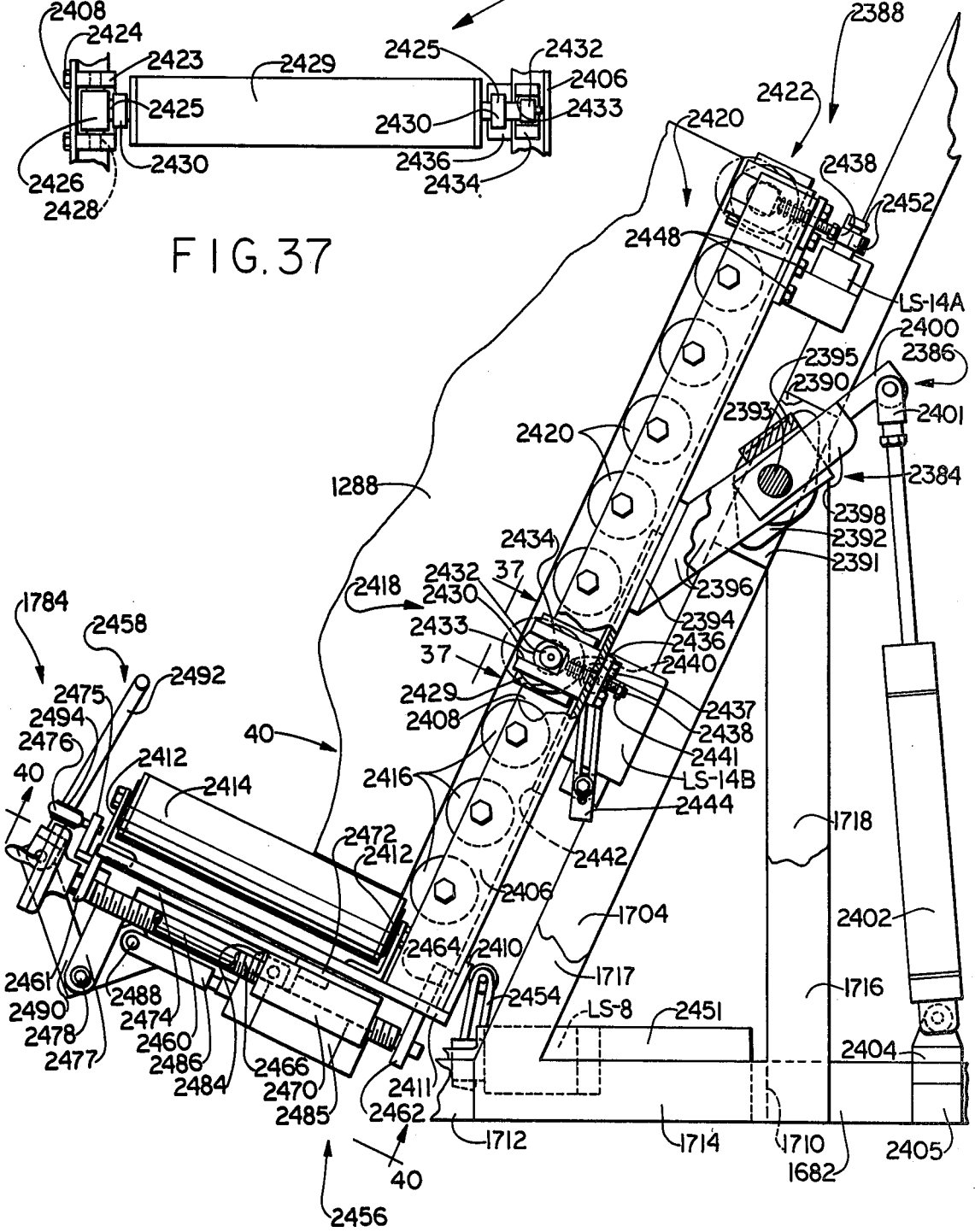
FIG. 38 is a side elevational view of the output tipover assembly, parts of the supporting structure being cut away to expose the tipover mechanism.
Figure 39:
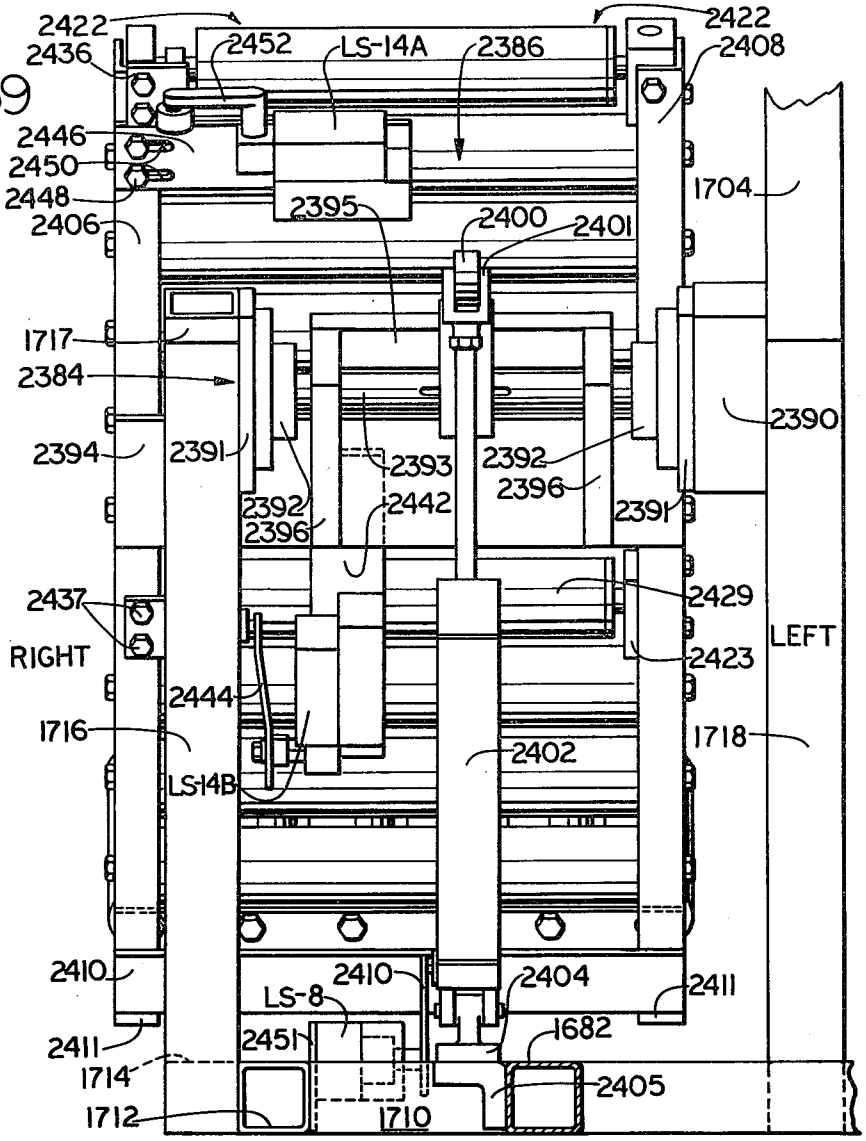
FIG. 39 is a back elevational view of the output tipover assembly of FIG. 38.

As the case 1288 slides upon the output tipover assembly 40, it depresses a limit switch LS-14A and a limit switch LS-14B that are shown in FIGS. 38 and 39, respectively. At this point, the case pushoff assembly 38 has reached its full extension, and the actuator of a limit switch LS-5 (FIGS. 29 and 30) is engaged by one of a pair of primary actuation arms 2332 to make the appropriate circuit to return the case pushoff assembly 38 to its original position. Upon reaching its original position, the case pushoff assembly 38 depresses a limit switch LS-3 that in turn causes the packing elevator 34 to move up the elevator incline 36 in rapid traverse. The limit switches LS-14A and LS-14B make a circuit which, when the limit switch LS-3 (FIG. 29) is actuated, activates a flap folding assembly 1784 of the output tipover assembly 40, moving the input end flap 1764B to a folded position 1764C (FIG. 33). On its way up, the packing elevator 34 contacts a second trip of the toggle-action limit switch LS-10 (FIG. 31) that resets this switch for the next pack cycle. The second function of the limit switch LS-3 makes the appropriate circuit that permits the output tipover assembly 40 to rotate clockwise with respect to FIGS. 33 and 38, bringing the full case 1288 up past horizontal so that gravity will cause the case 1288 to roll in the output direction onto the output conveyor 46.

The left side flap 1310 of the case 1288 passes to the left side of the right hand member of the pair of pack assembly side plates 1015 as the case 1288 rotates up to the customer output conveyor 46 upon the output tipover assembly 40. More specifically, the left side flap 1310 passes through the lateral clearance provided between the standoff bearing mount 1381 and the standoff mount 1383 (FIG. 6) of the carrier packing assembly 22. As the case 1288 rotates, the output end flap 1766 comes into contact with an output flap folder 1785 (FIG. 33) that folds it inwardly and down between the right side flap 1312 and the left side flap 1310.

The output flap folder 1785 is appropriately weighted to bring the output end flap 1766 inward, as well as to hold it and the folded input end flap 1764C in place as the case 1288 rolls off the output tipover assembly 40. Subsequent flap folding functions that close and seal the case 1288 are accomplished in the customer machine associated with the customer output conveyor 46. As the case 1288 exits the output tipover assembly 40, it releases the limit switch LS-14B and then the limit switch LS-14A. The limit switch LS-14B indicates that a case of any size is in place upon the output tipover assembly 40, while the limit switch LS-14A indicates that the full case 1288 has exited therefrom. As the limit switch LS-14A is released, the appropriate circuit is made that causes the output tipover assembly 40 to return to its receiver position and is indicated so by the making of a limit switch LS-8 that is shown in FIGS. 38 and 39. The structural attributes of the individual assemblies will now be discussed.

The case conveyor 1760 of the case input conveyor 30 is mounted about a case input roller 1786 and a case drive roller 1787 as is shown in FIG. 65. The case drive roller 1787 is fixedly attached, upon the right side of a case drive shaft 1789 as is shown in FIG. 22. The case drive shaft 1789 is rotatably mounted in a pair of case drive shaft bearings 1791 that is in turn fixedly attached to the upper inboard surfaces of the pair of pivot plates 1726 and 1726L that is mounted at the top of the case section frame assembly 44 as previously described. The case input roller 1786 (FIG. 26) is rotatably mounted upon a case input shaft 1788 and held in longitudinal alignment with the case input roller 1786 by a pair of shaft collars not shown. The case input shaft 1788 is fixedly held at each end by a pair of adjustable slide plates 1790, each one incorporating a pair of adjustment slots 1792 and an adjustment lug 1794. Each member of the pair of adjustable slide plates 1790 is fixedly but adjustably attached to the inboard surface of an input slide mount 1796 by a pair of slide bolts 1797 that passes through the pair of adjustment slots 1792 and threadably mounts into the face of the respective input slide mount 1796. The two input slide mounts 1796 are rigidly affixed to the inboard surface of, and at the output end of, the pair of horizontal rails 1728 and 1728L. The adjustment lug 1794 threadably incorporates an adjustment bolt 1798 that bears against an adjustment stop 1800 that is in turn rigidly affixed to the lower inboard surface of the input slide mount 1796. As the two adjustment bolts 1798 are turned inwardly, the pair of adjustable slide plates 1790 move in the output direction with respect to the bottle carrier checker/packer 10 as does the case input shaft 1788 and the case input roller 1786, thereby bringing tension into the case conveyor 1760.

A middle support roller 1802 (FIG. 26) longitudinally located at the middle of the case conveyor 1760 is rotatably mounted upon a middle support shaft 1804 and is held in longitudinal alignment with the case conveyor 1760 by a pair of shaft collars 1805. The middle support shaft 1804 is fixedly attached between the pair of horizontal rails 1728 and 1728L by a pair of middle shaft bolts 1806, as is shown in FIG. 25. The middle support roller 1802 maintains the elevational stability of the upper span of the case conveyor 1760.

Continuing with FIG. 26, a power input sprocket 1808 is fixedly attached upon the left side of the case drive shaft 1789 to cooperate with a case conveyor power chain 1810. The case conveyor power chain 1810 receives power from a power output sprocket 1811 of a case conveyor gear box 1812. A case conveyor motor 1814 is cantilever mounted to the output side of the case conveyor gear box 1812 and supplies motive power thereto to rotate the power output sprocket 1811 and subsequently the case conveyor 1760 in a counterclockwise direction. The case conveyor gear box 1812 is fixedly attached upon a case gear box mount plate 1816 that overhangs both sides of the cantilever motor mount 1733. A bottom spanner plate 1817 and a set of four spanner bolts and nuts 1818 cooperate with the case gear box mount plate 1816, to fixedly clamp it to the upper surface of the cantilever motor mount 1733.

The case 1288 is held in lateral alignment upon the top of the case conveyor 1760 by a case side guide assembly 1820 that is shown in FIGS. 24, 25 and 26, and incorporates a pair of slide rails 1822. The case input end 1826 of the pair of guide rails 1822 is flaired outboardly a small amount to accommodate some lateral misalignment of the incoming case 1288 while the case output end 1827 thereof is bent sharply downward to laterally control the case 1288 as it is manipulated by the input tipover assembly 32.

Referring to FIG. 24, each of the pair of guide rails 1822 rigidly incorporates a pair of threaded lateral studs 1823 that passes through clear holes in the top of a pair of offset rail risers 1824. The pair of threaded lateral studs 1823 is fixedly but adjustably clamped within the pair of offset rail risers 1824 by a set of four adjustment nuts 1825. The case input members of each pair of offset rail risers 1824 are rigidly affixed to the outboard ends of a pair of case input collars 1828, and the case output members thereof are likewise affixed to a pair of case output collars 1830. The left hand member of the pair of case input collars 1828 is threadably mounted upon a left hand input traverse shaft 1832, while the right hand member thereof is likewise mounted upon a right hand input traverse shaft 1834. The left hand member of the pair of case output collars 1830 is threadably mounted upon a left hand output traverse shaft 1836, while the right hand member thereof is likewise mounted upon a right hand output traverse shaft 1838. The inboard ends of the left and right hand input traverse shafts 1832 and 1834, respectively, are rigidly affixed to a case input shaft coupler 1840 so that they perform as one input adjustment shaft 1841. In identical manner, the left and right hand output traverse shafts 1836 and 1838, respectively, are rigidly coupled by a case output shaft coupler 1842 so that they perform as one output adjustment shaft 1843. The left hand input and output traverse shafts 1832 and 1836, respectively, incorporate left hand threads, while the right hand input and output traverse shafts 1834 and 1838, respectively, incorporate right hand threads so that when the input and output adjustment shafts 1841 and 1843, respectively, are rotated in unison, the left and right hand members of the pair of guide rails 1822 will either move apart or toward each other to accommodate various sizes of cases 1288.

The left hand extremity of the input adjustment shaft 1841 is rotatably mounted in an input channel bushing 1844 (FIG. 24) that is in turn rigidly carried by the inboard surface of the left hand horizontal rail 1728L through the interspacing auspices of a bushing spacer (not shown); while the right hand end thereof extends through the right hand horizontal rail 1728 and is rotatably held in a spacer bushing 1846 (FIG. 25) that is rigidly affixed to the outboard side thereof. An input adjustment sprocket 1848 is fixedly attached to the right hand extremity of the input adjustment shaft 1841.

The left hand extremity of the output adjustment shaft 1843 is rotatably mounted in an output channel bushing 1850 (FIGS. 24 and 26), that is in turn rigidly carried by the inboard surface of the left hand horizontal rail 1728L through the interspacing auspices of a bushing hanger spacer 1851; while the right hand end thereof extends under the right horizontal rail 1728 and is rotatably held in a right hand bushing hanger spacer 1853 (FIGS. 24 and 25) that is rigidly affixed to the outboard side thereof. An output adjustment sprocket 1852 is fixedly attached to the right hand extremity of the output adjustment shaft 1843.

Referring now to FIGS. 22 and 25, the rotation of the input and output adjustment sprockets 1848 and 1852 respectively is synchronized by a side rail chain 1854 that circumscribes the two sprockets and a crank sprocket 1856 (FIG. 22). The crank sprocket 1856 is fixedly attached to a short crank shaft 1858 that is in turn rotatably mounted at and through the top of a pair of bushing plates 1860. The pair of bushing plates is fixedly clamped to opposing sides of the right hand diagonal stiffener 1730 by a set of four spanner bolts 1861. The outboard extremity of the short crank shaft 1858 is fixedly fitted with a side guide crank handle 1862 for manual adjustment of the pair of guide rails 1822.

The input tipover assembly 32 is shown structurally in FIGS. 22 and 26, and is comprised of a tip body 1864 and the compressor 1774. The tip body 1864 incorporates an input plate 1866, an output plate 1868, a top slide block 1870 and a bottom plate 1872. The bottom plate 1872 is rigidly affixed to the bottom inside surfaces of the input and output plates 1866 and 1868, respectively, while the top slide block 1870 is fixedly attached between the upper ends thereof, to form a rectangular framework 1873. The input plate 1866 of the rectangular framework 1873 is slidably mounted within the inner confines of a slide channel 1874 whose flanges extend in the case output direction to substantially envelop three sides of the input plate 1866.

The bottom end of the slide channel 1874 is rigidly fitted with a jack base plate 1876 that incorporates a bearing bushing in the output end thereof. Vertically and rotatably retained in the jack base plate 1876 is an input tipover jack screw 1878 whose lower extremity is fixedly fitted with a compressor adjustment handle 1880. The input tipover jack screw 1878 is threadably mounted through the bottom plate 1872 of the rectangular framework 1873. The rectangular framework 1873 is adjustably retained and locked in parallel relationship to the slide channel 1874 by a cam lock handle 1882 and a retainer pin 1884. The retainer pin 1884 fits through a clear hole in the slide channel 1874 and an elongated slot, not shown, in the input plate 1866 and incorporates a head on the output end thereof for retention of washers and the input plate 1886. When the cam lock handle 1882 is in the horizontal position, the cam thereof is in a released position, retaining the rectangular framework 1873 in parallel alignment with the slide channel 1874, but not clamping it thereto. Manual rotation of the compressor adjustment handle 1880 will raise or lower the rectangular framework 1873 in relation to the slide channel 1874. Subsequently, the cam lock handle 1882 is pulled down to the vertical position, the cam pulls the retainer pin 1884 and washers against the output side of the input plate 1866, thereby locking the rectangular framework 1873 in fixed relationship to the slide channel 1874.

The upper input extremity of the slide channel 1874 rigidly incorporates a tipover pivot block 1886. The input end of the tipover pivot block 1886 is fixedly mounted about the left side of a tipover pivot shaft 1888. The tipover pivot shaft 1888 (FIG. 22) is pivotally mounted in a pair of input tipover bearings 1889 that is in turn fixedly attached to the lower inboard surfaces of the pair of pivot plates 1726 and 1726L. As is seen in FIGS. 22 and 26, a pivot block 1890 is fixedly attached to the tipover pivot shaft 1888 and laterally adjacent to the right hand side of the tip body 1864. Rigidly affixed to the top of, and extending in the output direction from the pivot block 1890, is a tip lug 1892. The free end of the tip lug 1892 pivotally incorporates a tip cylinder clevis 1893 that is fixedly attached to the working end of an input tipover cylinder 1894. The base of the input tipover cylinder 1894 is pivotally attached to an input tipover cylinder mount 1896 that is in turn rigidly affixed to the upper surface of the incline brace 1706 of the case section frame assembly 44.

As is shown in FIGS. 22 and 25, the tip cam 1779 is fixedly attached to the tipover pivot shaft 1888 and at a lateral position that is adjacent to the right hand member of the pair of input tipover bearings 1889, and extends in the case output direction and somewhat downwardly. Symmetrically located on the tipover pivot shaft 1888 between the pivot block 1890 and the tip cam 1779 is a pair of rail mounts 1898, that is of rectangular shape as seen in FIG. 25. Rigidly affixed to the outboard surfaces of the pair of rail mounts 1898 is a pair of L-shaped risers 1899 that extend in the case output direction and then upwardly, as is best shown in FIGS. 66 and 67. A lateral stiffener bar 1901 is rigidly affixed between the vertical portions of the pair of L-shaped risers 1899 to keep them in fixed lateral spaced relationship.

Figure 27:
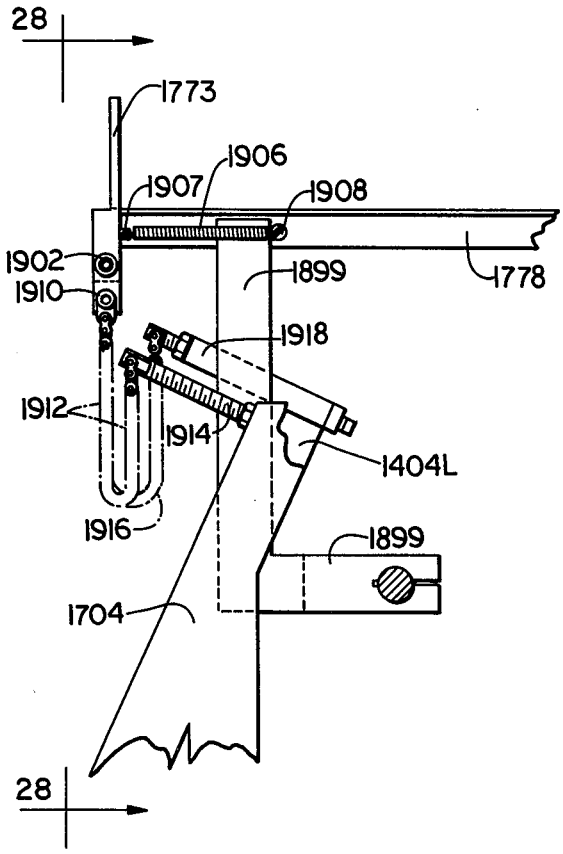
FIG. 27 is a fragmentary view of the top of the elevator incline in side elevation showing details of a pair of trip chains associated with the case input tipover assembly.
Figure 28:
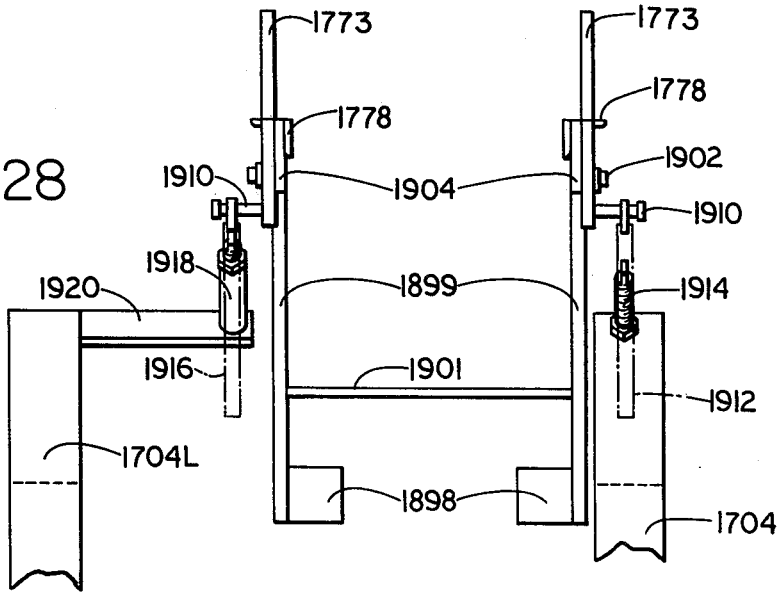
FIG. 28 is a fragmentary front elevational view looking in the direction of the arrows 28—28 in FIG. 27.

Rigidly affixed in a horizontal and longitudinal dispostion across the upper extremities of the pair of L-shaped risers 1899, is the pair of tipover rails 1778, as is shown specifically in FIGS. 27 and 28. The pair of tipover rails 1778 extends a small distance in the case output direction from the upper extremities of the L-shaped risers 1899 and pivotally supports the pair of retainer tines 1773. The upper flange of the pair of angle rails 1778 is partially cut away to accommodate the pair of retainer tines 1773 that is pivotally mounted by a pair of shoulder bolts 1902 to a pair of tine mounts 1904. The pair of tine mounts 1904 is rigidly affixed to the outboard surfaces of the vertical flanges of the angle rails 1778 in such position that the upright pair of retainer tines 1773 will rest against the foreshortened end of the upper rail flange, thereby preventing any clockwise rotation of the pair of retainer tines 1773 beyond the vertical.

Rotational force in the clockwise direction is provided by a pair of tine reset springs 1906 that is hooked between a pair of spring lugs 1907 and a pair of spring pins 1908 that is shown in the upper position of FIG. 27. The pair of spring lugs 1907 is rigidly affixed to the case input side of the pair of retainer tines 1173 and just below the horizontal flange of the pair of angle rails 1900. The pair of spring pins 1908 is rigidly affixed in the outboard face of the vertical flange of the pair of angle rails 1900 and adjacent the case input side of the intersection between the pair of angle rails 1900 and the pair of L-shaped risers 1899.

Again referring to FIGS. 27 and 28, the lower extremity of the pair of retainer tines 1773 fixedly incorporates a pair of chain shoulder bolts 1910 that extends in cantilever manner from the outboard surfaces thereof. The right hand member of the pair of chain shoulder bolts 1910 pivotally accommodates a right hand restraining chain 1912 that hangs vertically downward and then is looped upward and toward the case input end to be pivotally retained upon the upper end of a right hand chain pin 1914. The right hand chain pin 1914 is fixedly attached in the carrier input side of, and at the top extremity of, the right hand incline riser 1704. The left hand member of the pair of chain shoulder bolts 1910 likewise pivotally accommodates a left hand restraining chain 1916 that hangs vertically downward and then is looped upward and toward the case input end to be pivotally retained upon the upper end of a left hand chain pin 1918. The left hand chain pin 1918 is somewhat longer than the right hand chain pin 1914 so that it can be fixedly attached in the inboard end of a left side pin mount 1920. The left side pin mount 1920 is rigidly affixed in a cantilever manner to the carrier output side of, and at the upper extremity of, the left hand incline riser 1704L. When the input tipover cylinder 1894 contracts, the tip lug 1892 and the pivot block 1890 rotate the tipover pivot shaft 1888 counterclockwise with respect to FIG. 26. Consequently, the tipover pivot block 1886 and the tip body 1864, along with the pair of rail mounts 1898 (FIG. 25), the pair of L-shaped risers 1899 and the pair of angle rails 1900, rotate with the tipover pivot shaft 1888 until the tip cam 1779 rotates into physical contact with the hydraulic valve HV-1. The hydraulic valve HV-1 stops the input tipover cylinder 1894, thus placing the input tip assembly 32 in the 80% tipped position as previously described. When the hydraulic valve HV-2 is operated, the tip process is completed, and in so doing the right and left hand restraining chains 1912 and 1916, respectively, are drawn taut, causing the pair of retainer tines 1773 to rotate about the pair of shoulder bolts 1902. When the pair of retainer tines 1773 becomes parallel with the pair of angle rails 1900, the case 1288 is released therefrom and placed in the retaining elements of the packing elevator 34 which thereafter moves the case 1288 down the elevator incline 36. When the input tipover assembly 32 is released, the left and right hand restraining chains 1916 and 1912 respectively relax, permitting the pair of tine reset springs 1906 to return the pair of retainer tines 1773 to their upright position in preparation for another case 1288.

Mounted within the rectangular framework 1873 is a compressor cylinder 1922, as shown in FIG. 65. More specifically, the base of the compressor cylinder 1922 is pin mounted to a base lug 1924 that is in turn rigidly affixed to the top surface of the bottom plate 1872. The compressor cylinder 1922 stands upright, and its working end is fixedly retained within a bottom slide retainer 1925. The bottom slide retainer 1925 also functions as a base retainer for a pair of compressor slide rods 1926 that is fixedly attached therein. The pair of compressor slide rods 1926 is slidably retained in parallel holes in the top slide block 1870 and its top extremity is fixedly attached within a top slide retainer 1927.

Referring now to FIGS. 22 and 26, the top compressor bar 1776 is fixedly attached to the top slide retainer 1927 by a compressor bar mount assembly 1928. The compressor bar mount assembly 1928 is comprised of a short hanger 1930, a lateral arm 1932 (FIG. 22), a side riser 1934, a short lateral arm 1936 and a compressor bar mount assembly pad 1937. The short hanger 1930 is rigidly affixed upon the upper surface of the top compressor bar 1776 with the greater portion thereof extending in the case input direction. A pair of gussets 1938 is rigidly affixed at the intersection of the short hanger 1930 and the top compressor bar 1776 to provide a degree of elevational stability along the length of the top compressor bar 1776. The upper extremity of the short hanger 1930 is rigidly affixed to the inboard end of the lateral arm 1932 (FIG. 22), the outboard end of the lateral arm 1932 is rigidly affixed to the top extremity of the side riser 1934, the bottom inboard end of the side riser 1934 is rigidly affixed to the outboard extremity of the short lateral arm 1936, and the short lateral arm 1936 is rigidly affixed across the top of, and at the case input end of, the compressor bar mount assembly pad 1937 to form the rectangularly shaped compressor bar mount assembly 1928. The intersections of the compressor bar mount assembly 1928 are strengthened by a set of three gussets 1940 that is figidly affixed in the corners thereof.

The compressor bar mount assembly 1928 is fixedly attached upon the top surface of the top slide retainer through the auspices of the compressor bar mount assembly pad 1937. Consequently, when the compressor cylinder 1922 withdraws, it moves the slide rod assembly and the compressor bar mount assembly 1928 downward, so that the top compressor bar 1776 comes down to rest upon the top of the corrugated case 1288 with a small compressive force.

The case output end of the top compressor bar 1776 incorporates the flap bender assembly 1780. Referring to FIGS. 22 and 26, the flap bender assembly 1780 is comprised of a mount bushing 1942, a depresser shaft 1943, and a depresser leaf spring 1944. The depresser leaf spring 1944 is rigidly affixed to the left end of the depresser shaft 1943, that is in turn fixedly and adjustably mounted, at its right hand extremity, in the mount bushing 1942 so that the depresser leaf spring 1944 angles appropriately downward in the case output direction.

Also shown in FIGS. 22 and 26, is a flap lifter rod 1946 that is rigidly affixed to the outboard side of, and at the input end of, a rod bracket 1947. The rod bracket 1947 overhangs the edges of the side riser 1934, and is fixedly but adjustably clamped thereto by a clamp bracket 1948 and a pair of spanner bolts 1949. The flap lifter rod 1946 is bent downwardly in the case input direction to receive the outside surface of the left side flap 1310 of the case 1288 to insure that it passes the side riser 1934 without interference.

Consequently, when the compressor cylinder 1922 contracts, the working end thereof retracts the pair of compressor slide rods 1926, the compressor bar mount assembly 1928, and therefore the top compressor bar 1776 downwardly upon the top of the case 1288 (FIG. 23) with sufficient pressure to secure it upon the pair of angle rails 1778 of the input tipover assembly 32 during the tipover operation. The case input end of the top compressor bar 1776 folds the output end flap 1766 downwardly to a horizontal position, while the input end flap 1764 is bent downwardly beyond the horizontal by the flap bender assembly 1780. This additional bending of the input end flap 1764 is so adjusted that the input flap 1764 will be captured by the flap retainer 1998 (FIG. 36) of the packing elevator 34, as disclosed more fully hereinafter.

Using FIGS. 22 and 25, it can be seen that the limit switch LS-17 is fixedly mounted to the upper output side of the tip body 1864 of the input tipover assembly 32 through the interspacing auspices of a mount spacer 1950. A trip arm and roller 1952 of the limit switch LS-17 extends to the left side of the input tipover assembly 32 and is so positioned as to be depressed by a switch trip 1953 that is rigidly affixed to the lower outboard surface of the side riser 1934 of the compressor bar mount assembly 1928.

The limit switch LS-2 is fixedly mounted upon a mount plate 1954 that is in turn rigidly affixed to the unsupported end of a long cantilever mount 1956. The long cantilever mount 1956 rigidly incorporates a mount foot 1957 (FIG. 26) at the left end thereof, which is in turn fixedly attached to the upper inboard surface of the left hand pivot plate 1726L. The limit switch LS-2 incorporates a switch arm and roller 1958 that extends to the right side therefrom, and upwardly so that the roller is laterally centered with respect to the case conveyor 1760, and extends slightly thereabove. In this manner, the incoming case 1288 will rotate the switch arm and roller 1958 counterclockwise with respect to FIG. 63, as has been previously described (FIG. 23).

The limit switch LS-13 is fixedly attached to a switch mount plate 1960 that is in turn rigidly affixed to the outboard surface of the left hand tall riser 1702L and adjacent the bottom end of the input tipover assembly 32. The switch mount plate 1960 extends in the carrier input direction to hold the limit switch LS-13 and an associated switch arm and roller 1962 in lateral and longitudinal alignment with a trip lip 1963 that is rigidly affixed in a vertical disposition to the bottom case output corner of the rectangular framework 1873.

The hydraulic valve HV-1 that is mechanically shown in FIGS. 61 and 64 is fixedly attached to the outboard surface of a cantilever mount plate 1964, that is in turn rigidly affixed to the left hand surface of the right hand tall riser 1702 through the interspacing auspices of a spacer block 1965. The cantilever mount plate 1964 extends in the case input direction and holds the hydraulic valve HV-1 in lateral and longitudinal alignment with the tip cam 1779 as it swings downward to a vertical disposition during the tip operation.

The limit switch LS-12, shown in FIGS. 22 and 26, is fixedly attached near the top of, and to the carrier input face of, the left hand incline riser 1704L through the interspacing auspices of a mounting bracket 1966. A trip arm and roller 1968 extends to the right of the limit switch LS-12 which is so positioned to bring it in longitudinal alignment with the output plate 1868 of the input tipover assembly 32. As the input tipover assembly 32 rotates from its 80% tip position (FIG. 23) to its full tip position, the trip arm and roller 1968 comes in contact with the upper portion of the output plate 1868 and is rotated counterclockwise and terminates the tip process as has been previously described.

Figure 36:
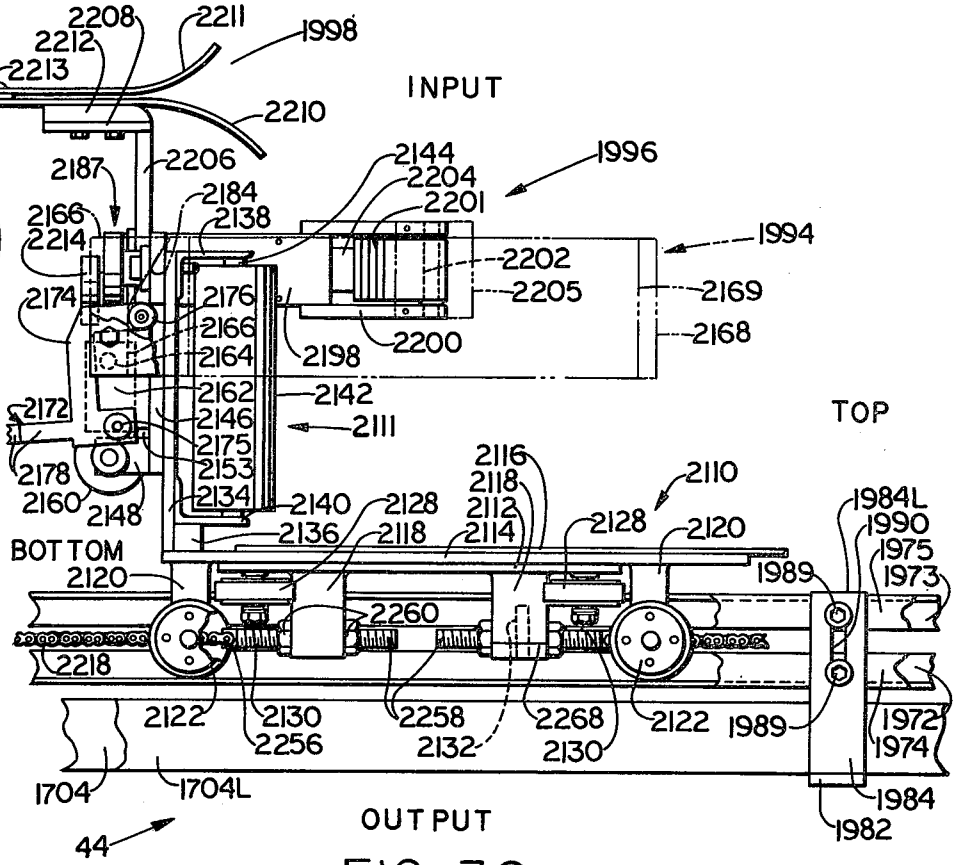
FIG. 36 is a side elevational view showing the packing elevator and its mounting upon the elevator incline.
Figure 35:
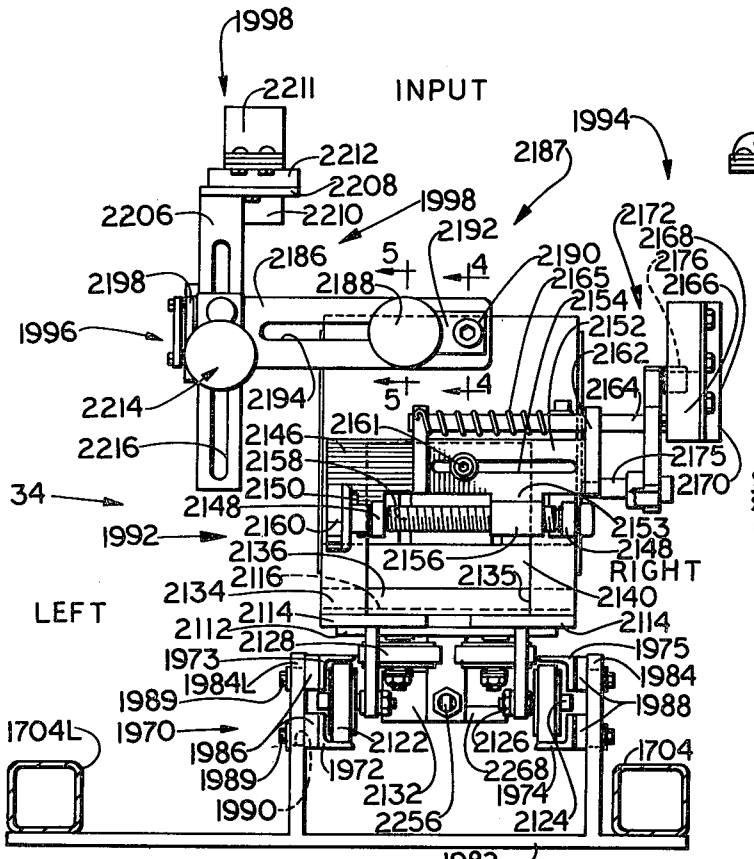
FIG. 35 is a bottom view of a packing elevator and its mounting upon the elevator incline, frame elements being shown in section, looking in the direction of the arrows 35—35 in FIG. 3.

The method of attachment of the elevator incline 36 to the case section frame assembly 44 is shown in FIGS. 35 and 36. The packing elevator 34 traverses up and down the elevator incline 36 within the confines of a rail assembly 1970 that is comprised of a left hand rail 1972, a right hand rail 1974, a left hand retainer rail 1973, and a right hand retainer rail 1975. As can be seen in FIG. 31, the rail assembly 1970 is fixedly but adjustably attached to the pair of incline risers 1704 and 1704L by a bottom rail mount assembly 1976, a middle rail mount assembly 1978, and a top rail mount assembly 1980. The bottom, middle and top rail mount assemblies 1976, 1978 and 1980, respectively, are similar in structure and each incorporates, as shown in FIGS. 35 and 36, a lateral mount bar 1982, a pair of rail risers 1984 and 1984L, a pair of left hand mount blocks 1986, and a pair of right hand mount blocks 1988. With respect to FIG. 35, the upper member of the pair of left hand mount blocks 1986 is rigidly affixed to the outboard side of the left hand retainer rail 1973, while the lower member of the pair of left hand mount blocks 1986 is likewise attached to the left hand rail 1972. The pair of left hand mount blocks 1986 is fixedly and adjustably attached to the inboard face of the left hand rail riser 1984L by a pair of cap screws 1989 that passes through a clear slot 1990 in the upper portion thereof, and threadably mount in the pair of left hand mount blocks 1986. The left hand rail riser 1984L is rigidly and perpendicularly affixed to the top of the lateral mount bar 1982.

The right hand retainer rail 1975 and the right hand rail 1974 are mounted to the lateral mount bar 1982 in the same manner as, but in a mirror image to, the left hand rail 1972 and the left hand retainer rail 1973 as just described. The pair of rail risers 1984 and 1984L is laterally located upon the lateral mount bar 1982 in such position to bring the packing elevator 34 in proper lateral alignment with the carrier packing assembly 22. Consequently, the left and right hand rails 1972 and 1974, respectively, and the left and right hand retainer rails 1973 and 1975, respectively, can be appropriately aligned with respect to each other and also with respect to the pair of incline risers 1704 and 1704L upon the bottom, middle and top rail mount assemblies 1976, 1978 and 1980, respectively. The packing elevator 34 is thereby confined within the adjustable space between the right hand rail 1974 and the right hand retainer rail 1975, and the left hand rail 1972 and the left hand retainer rail 1973.

The packing elevator 34 is mechanically shown in FIGS. 3, 35 and 36 and is comprised of a body assembly 1992, a right hand case retainer 1994, a left hand case retainer 1996 and the flap retainer 1998.

The body assembly 1992 incorporates a back assembly 2110 and a base assembly 2111 as is most clearly shown in FIG. 74. The back assembly 2110 incorporates a side guide mount plate 2112 (FIGS. 35 and 36), a pair of long mount plates 2114, a back plate 2116, a pair of chain lugs 2118, and a set of four wheel struts 2120. In discussing the packing elevator 34, the directional terminology of the bottle carrier handling assembly 12 will be followed, making the top of FIG. 74 the input side; the bottom, the output side; the left hand side of the figure is the bottom; and the right hand side the top. The back plate 2116 is rigidly affixed to the input face of the pair of long mount plates 2114 and slightly overhangs the top end thereof, while the bottom ends of the pair of long mount plates 2114 extend beyond the lower extremity of the back plate 2116. The side guide mount plate 2112 is rigidly affixed in laterally centered position to the output surface of the pair of long mount plates 2114. The side guide mount plate 2112 is located somewhat closer to the bottom extremity of the pair of long mount plates 2114. The set of four wheel struts 2120 is rigidly affixed in a perpendicular disposition to the output surface of the pair of long mount plates 2114, and positioned thereupon adjacent to the top and bottom extremities of the side guide mount plate 2112.

The set of four wheel struts is laterally placed so as to coincide with the center lines of each member of the pair of long mount plates 2114. A set of four wheels 2122 is rotatably mounted upon a set of four shoulder bolts 2124, the threads of which pass through clear holes in the unsupported end portions of the set of four wheel struts 2120 and are fixedly held therein by a set of four nuts 2126 (FIG. 35). The set of four wheels 2122 extends outwardly from the set of four wheel struts 2120 to cooperate with the lateral flanges of the left and right hand rails 1972 and 1974, respectively, but not to interfere with the side flanges thereof.

A set of four side guide wheels 2128 is rotatably mounted on a set of four shoulder studs 2130, that is in turn threadably mounted into the output face of the side guide mount plate 2112 so that the top and bottom pairs thereof are adjacent to the top and bottom pair of the set of four wheel struts 2120. The set of four shoulder studs 2130 is laterally placed so that the set of four side guide wheels 2128 can cooperate with the inboard edges of the lateral flanges of the left and right hand retainer rails 1973 and 1975, respectively, (FIG. 35), to insure that the packing elevator 34 retains a sound lateral alignment with the carrier packing assembly 22. The pair of chain lugs 2118 is also perpendicularly and rigidly affixed to the output face of the side guide mount plate 2112, each being adjacent to the top and bottom pair of the set of four side guide wheels 2128. The top chain lug rigidly incorporates a limit switch trip plate 2132 that extends laterally from the left side thereof to cooperate in contacting the switch arm and rollers of limit switches LS-11, LS-10, LS-1A and LS-1 that are shown in FIGS. 29 and 31.

The base assembly 2111 of the body assembly 1992 of the packing elevator 34 is comprised of a base plate 2134, a square bar 2136, an input angle 2138, an output angle 2140 and a set of three base rollers 2142, as shown in FIGS. 3, 35 and 36. The base plate 2134 incorporates a square cutout 2135 (FIG. 35) that enters from the output edge thereof, making the base plate 2134 appear as an inverted "U" in the Figure as is indicated by the dashed lines. The base plate 2134 is then rigidly affixed in this position to the lower input surface of the pair of long mount plates 2114, and their perpendicular relationship is assured by the square bar 2136 that is rigidly affixed in the intersection therebetween. The upright flange of the output angle 2140 is rigidly affixed to the input surface of the square bar 2136 and the other flange is rigidly affixed to the upper surfaces of the base plate 2134. The output angle 2140 and the square bar 2136 extend laterally across the width of the body assembly 1992, to span the square cutout 2135 of the base plate 2134. The input angle 2138 is rigidly affixed across the upper input edge of the base plate 2134 so that its upright flange is opposite the upright flange of the output angle 2140. The set of three base rollers 2142 is rotatably mounted upon a set of three shafts 2144 that is in turn fixedly attached in a uniform distribution between the upright flanges of the input and output angles 2138 and 2140, respectively.

The right hand case retainer 1994 is also shown in FIGS. 3, 35 and 36, and is a laterally adjustable device that must fold its side guide from an upright to the transverse position to permit the case 1288 to exit therefrom. The right hand case retainer 1994 incorporates a slide mount plate 2146 that is rigidly affixed in a lateral orientation across the central portion of, and upon the lower surface of, the base plate 2134 of the body assembly 1992. A pair of adjustment screw mounts 2148 is perpendicularly and rigidly affixed to the lower surface of a pair of output lugs 2150 that is an integral part of the slide mount plate 2146.

A right side slide plate 2152 incorporates an integral output lug 2153 and a lateral slide slot 2154. An adjustment lug 2156 is rigidly affixed upon the lower surface of the integral output lug 2153 and extends downwardly between the pair of adjustment screw mounts 2148. The adjustment lug 2156 is threadably mounted upon an adjustment screw 2158 that is in turn rotatably mounted in and between the pair of adjustment screw mounts 2148. The left extremity of the adjustment screw 2158 extends laterally and outwardly beyond the left hand member of the pair of adjustment screw mounts 2148 to fixedly incorporate an adjustment handle 2160. The right side slide plate 2152 is fixedly but adjustably attached to the lower surface of the slide mount plate 2146 by a cap screw 2161 that extends through the clear lateral slide slot 2154 to threadably mount in the slide mount plate 2146.

The lateral extremities of the right side slide plate 2152 rigidly incorporate in a vertical disposition a pair of retainer shaft mounts 2162 that extends downwardly sufficiently to pivotally incorporate a retainer shaft 2164. The right hand extremity of the retainer shaft 2164 extends beyond the right hand member of the pair of retainer shaft mounts 2162 to fixedly incorporate a right hand retainer mount 2166. As positioned in the Figures, the output extremity of the right hand retainer 2166 is mounted upon the retainer shaft 2164 so that it functions as a torque arm to rotate the shaft against a torque spring 2165. The right hand extremity of the torque spring 2165 is fixedly attached to the retainer shaft 2164 while the other end is retained upon the top of the left hand member of the pair of retainer shaft mounts 2162. A right hand retainer plate 2168 is fixedly attached to the outboard surface of the right hand retainer mount 2166. The right hand retainer plate 2168 is constructed of spring steel and incorporates an outwardly extending lip 2169 at the upper end thereof to facilitate the entry of the case 1288. A relief bend 2170 is incorporated at the lower extremity of the right hand retainer plate 2168 to insure that excessive friction is not applied to the entering case 1288.

An actuation arm 2172 incorporates a "C" shaped upper member, when viewing FIG. 36, the output leg of the "C" being pivotally mounted upon a pivot stud 2175 that is in turn rigidly affixed in the outboard face of, and at the output edge of, the right hand member of the pair of retainer shaft mounts 2162. The input leg of the "C" shaped upper member 2174 of the actuation arm 2172, incorporates a cam roll 2176, rotatably mounted in the right hand side thereof. The actuation arm 2172 is also comprised of a downwardly extending offset arm 2178 (FIG. 3), whose upper extremity is fixedly attached in upright alignment with the output leg of the C-shaped upper member 2174. The lower extremity of the offset arm 2178 rigidly incorporates a cantilever shaft 2181 that extends to the left therefrom. The cantilever shaft 2181 rotatably incorporates a set of three rollers 2180 that is so positioned laterally so as to come in contact with a trip ramp 2182 (FIGS. 59 and 70) when the packing elevator 34 reaches the bottom of its travel upon the elevator incline 36. The trip ramp 2182 is laterally adjustable (FIG. 20), but fixedly attached to the upper surface of the input lateral brace 1684 of the case section frame assembly 44.

The cam roll 2176 that is rotatably attached to the input leg of the C-shaped upper member 2124 of the actuation arm 2172 works against an incline ramp 2184 (FIG. 36) that is an integral part of the upper surface of the right hand retainer mount 2166. When the set of three rollers 2180 comes downward into contact with the trip ramp 2182, the lower extremity of the offset arm 2178 is forced to move in the output direction, thereby pivoting the C-shaped upper member 2174 in the counterclockwise direction (FIG. 36) about the pivot stud 2175. As the cam roll 2176 swings down, its interaction with the incline ramp 2184 forces the right hand retainer mount 2166 to pivot in concert with the retainer shaft 2164 and against the restoring force of the torque spring 2165. The right hand retainer plate 2168 will therefore rotate approximately 90° from its upright position to a transverse position, pointing in the carrier input direction. The case 1288 can then leave the packing elevator 34. As the packing elevator 34 begins to move up the elevator incline 36, the torque spring 2165 will restore the right hand retainer plate 2168 to its original position and secures it there, while gravity holds the actuation arm 2172 in proper relationship thereto in preparation for the next cycle. The right hand retainer plate 2168 is laterally adjustable by rotation of the adjustment handle 2160 of the adjustment screw 2158 to accommodate various sizes of cases 1288.

The case left side 1304 is gripped and restrained from sliding out of position upon the packing elevator 34 by a left hand case retainer 1996 that is shown in FIGS. 3, 35 and 36. The left hand case retainer 1996 incorporates a lateral extension arm mount 2186. The lateral extension arm mount 2186 is fixedly but adjustably mounted to the lower surface of, and along the input side of, the base plate 2134 by a clamp adjustment assembly 2187. The clamp adjustment assembly 2187 is comprised of a hand lock 2188, a stop slide pin 2190, and a pressure plate 2192.

Figure 4:
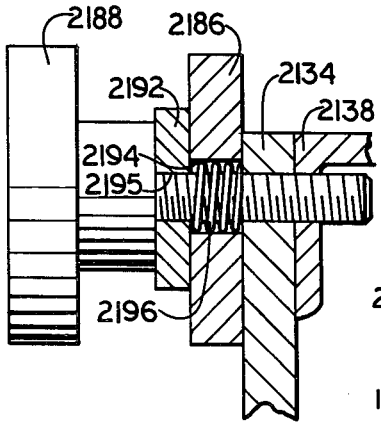
FIG. 4 is an enlarged fragmentary sectional view of a clamp assembly taken along line 4—4 in FIG. 35.
Figure 5:
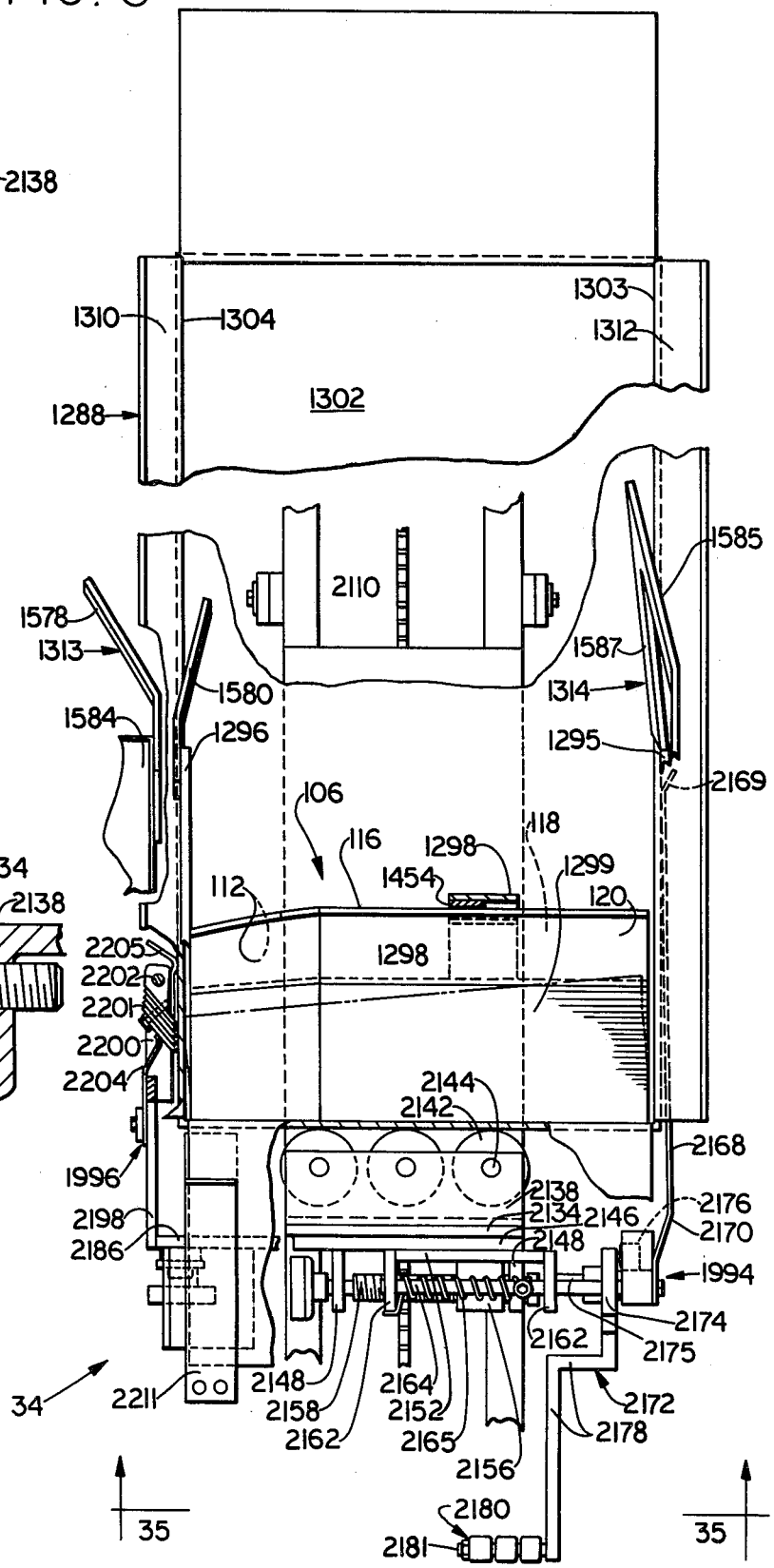
FIG. 5 is an enlarged fragmentary sectional view of a hand lock assembly taken along line 5—5 in FIG. 35.

As can be seen in FIG. 4, the stop slide pin 2190 is a short shoulder bolt that fits closely through a clear hole 2193 in the pressure plate 2192 as well as a clear long slot 2194 in the lateral extension arm mount 2186. The stop slide pin 2190 is threadably mounted in the base plate 2134 at its approximate lateral center (FIG. 35). Referring now to FIG. 5, the threaded shank of the hand lock 2188 passes closely through a small clear hole 2195 in the left end of the pressure plate 2192 and also through the clear long slot 2194 of the lateral extension arm mount 2186 to threadably mount through the base plate 2134 and the input angle 2138. A lock spring 2196 fits closely over the threaded shank of the hand lock 2188 and also closely within the confines of the clear long slot 2194.

When both the stop slide pin 2190 and the hand lock 2188 are loosened, the lateral extension arm mount can be adjusted laterally within the limits of the clear long slot 2194 (FIG. 35) without rotating downward out of position. The lock spring 2196 and the pressure plate 2192 cooperate to provide a measure of frictional pressure to facilitate the adjustment. After the lateral position has been chosen, the stop slide pin 2190 is tightened with a wrench, while the hand lock 2188 is tightened manually, compressing the lock spring 2196 between the pressure plate 2192 and the base plate 2134. The lock spring 2196 will prevent the clamp adjustment assembly 2187 from vibrating loose, while the hand lock 2188 permits periodic check tightening by hand.

The left hand extremity of the lateral extension arm mount 2186 rigidly incorporates a left holder mount 2198 that stands upwardly therefrom, as shown clearly in FIGS. 3 and 36. The upper extremity of the left holder mount 2198 rigidly incorporates a pair of parallel extension mounts 2200, that is rigidly affixed to the upper sides thereof. A gripper assembly 2201 is pivotally mounted upon a gripper shaft 2202 that is in turn pressed into clear holes in the upper ends of the pair of parallel extension mounts 2200. The gripper assembly 2201 is then capable of pivoting in a pendulum like manner about the gripper shaft 2202, but is urged into contact with the case 1288 by a pressure spring 2204. The pressure spring 2204 is fixedly clamped at its bottom edge to the left hand surface of the left holder mount 2198. Its upper edge is so formed so that when the gripper assembly 2201 is forced outbroadly by the case 1288, the upper end of the pressure spring 2204 will be bent outboardly away from the left holder mount 2198, thereby applying a gripping force against the case 1288. The upper inboard extremity of the pair of parallel extension mounts 2200 is fixedly fitted with a deflector spring 2205 that facilitates the entry of the case 1288 to the inboard side of the left hand case retainer 1996.

The flap retainer 1998 of the packing elevator 34 is shown in FIGS. 3, 35 and 36. The flap retainer 1998 is comprised of a longitudinal adjustment bar 2206, a gripper mount 2208, an output gripper slide 2210 and an input gripper slide 2211. The gripper mount 2208 is rigidly affixed upon the input end of the longitudinal adjustment bar 2206 and extends downward therefrom. The output gripper slide 2210 is fixedly attached to the gripper mount 2208 through the interspacing auspices of a gripper spacer 2212 while the lower extremity of the input gripper slide 2211 is fixedly attached to the output gripper slide 2210 through the interspacing auspices of a flap spacer 2213. As can be seen in FIG. 36, the upper portions of the input and output gripper slides 2211 and 2210, respectively, diverge from each other to be capable of receiving the input end flap 1764 of the case 1288 that is not always in perfect perpendicular relationship with the case input end 1768. The flap retainer 1998 is adjustable to cooperate with the flaps of various sizes of cases by virtue of the longitudinal adjustment bar 2206 and a clamp assembly 2214. The clamp assembly 2214 cooperates with a longitudinal slot 2216 (FIG. 35) in the longitudinal adjustment bar 2206, and fixedly but adjustably clamps it to the lower surface of, and at the left end of, the lateral extension arm mount 2186 in the same way as the clamp adjustment assembly 2187. The clamp assembly 2214 is slightly shorter than the clamp adjustment assembly 2187 to cooperate with the width of the lateral extension arm mount 2186.

Figure 32:
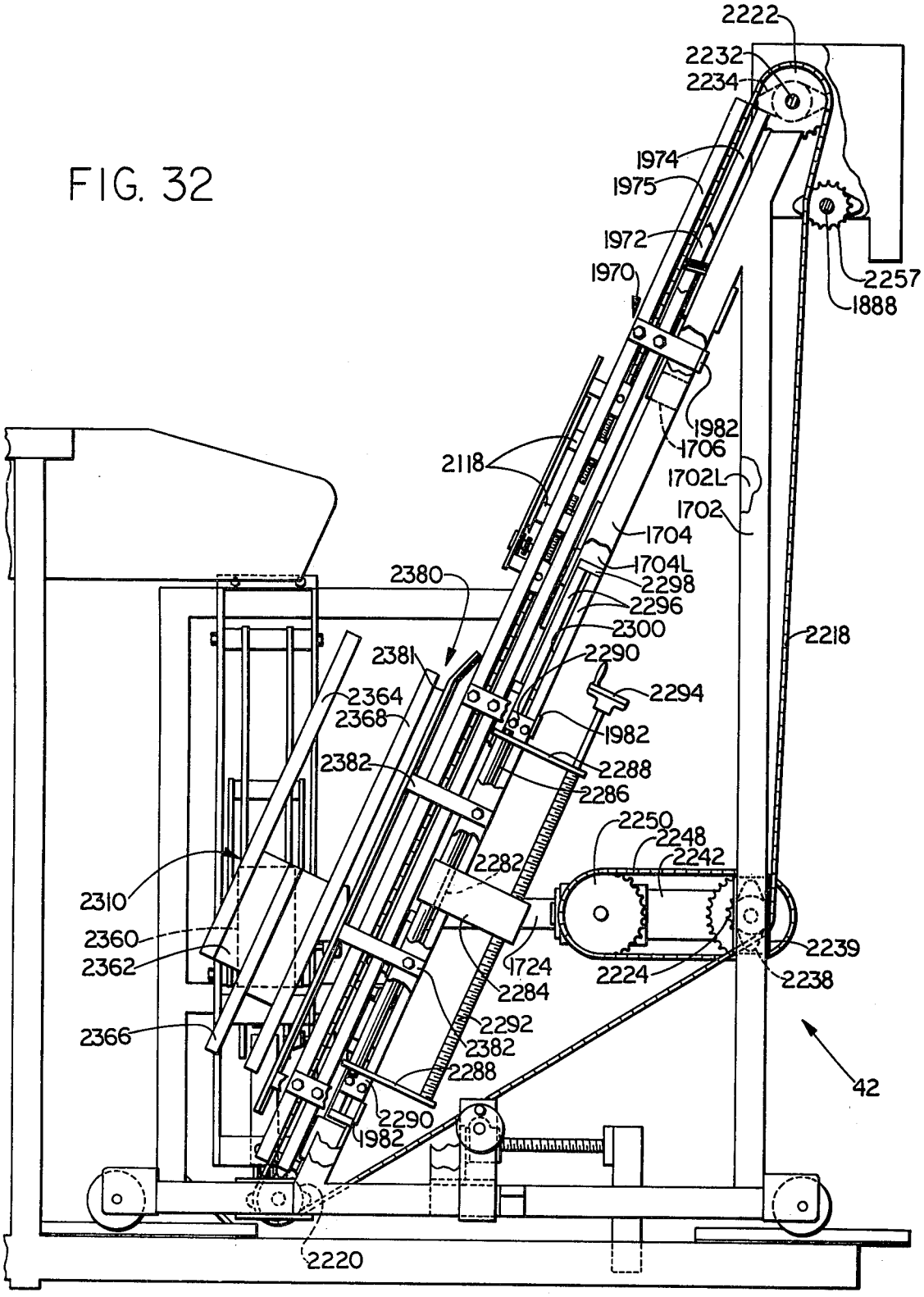
FIG. 32 is a fragmentary side elevational view showing the relative relationships of the pushoff assembly, a packing elevator and the elevator incline looking in the direction of arrows 32—32 in FIG. 29, structure for a tipover assembly being cut away for exposure of machinery in the lower portion of the elevator incline.

The packing elevator 34 is moved up and down the elevator incline 36 by means of an elevator chain 2218 that is shown in FIGS. 29, 31 and 32. The elevator chain 2218 is mounted upon a bottom elevator sprocket 2220, a top elevator sprocket 2222, and a power input sprocket 2224. Referring specifically to FIGS. 20, 29 and 31, the bottom elevator sprocket 2220 is fixedly attached upon a bottom elevator shaft 2226 that is in turn rotatably mounted in a pair of bottom shaft bearings 2228. The right hand member of the pair of bottom shaft bearings 2228 is fixedly attached to the left hand surface of the secondary longitudinal beam 1700 and adjacent to the intersection of the right hand incline riser 1704. The left hand member of the pair of bottom shaft bearings 2228 is fixedly attached to a rectangular plate mount 2229 that is in turn rigidly affixed at its input end to a mount standoff plate 2230 and along its output edge to the lower inboard surface of the left hand incline riser 1704L. The mount standoff plate 2230 is rigidly affixed in a perpendicular orientation to the inboard surface of the left hand base stringer 1682L. The bottom elevator sprocket 2220 is laterally placed upon the bottom elevator shaft 2226 so as to place the elevator chain 2218 in the middle of the elevator incline 36.

Referring to FIGS. 29, 31 and 32, the top elevator sprocket 2222 is fixedly attached to a top elevator shaft 2232 that is in turn rotatably mounted in a pair of top shaft bearings 2234. The pair of top shaft bearings 2234 is fixedly attached to the inboard surfaces of the pair of pivot plates 1726 and 1726L and is located thereupon near the upper end of the elevator incline 36, so that the elevator chain 2218 remains parallel to the left and right hand rails 1972 and 1974, respectively. The top elevator sprocket 2222 is laterally placed upon the top elevator shaft 2232 so that it will be in the same vertical plane as the bottom elevator sprocket 2220.

The power input sprocket 2224 is an integral part of the case handling system drive assembly 42 which will be described herein and is shown in FIGS. 20 and 32. The power input sprocket 2224 is fixedly attached upon a brake shaft 2236 that is in turn rotatably mounted in a right hand brake shaft bearing 2238 and a left hand brake shaft bearing 2240. As can be seen in FIG. 32, the right hand brake shaft bearing 2238 is fixedly attached to a right hand bearing mount plate 2239 that is in turn rigidly affixed in a parallel relationship to the left hand surface of the right hand tall riser 1702 at a vertical height to be horizontally aligned with the power assembly mount beam 1724. The left hand brake shaft bearing 2240 (FIG. 20) is fixedly attached in a horizontal disposition to the right hand surface of, and at the output end of, a power assembly mount plate 2242. The power assembly mount plate 2242 is rigidly affixed at its output end to the inboard surface of the left hand tall riser 1702L and at its input end to the left end of a standoff power assembly bracket 2244. The standoff power assembly bracket 2244 is rigidly affixed in a perpendicular orientation to the inboard surface of the power assembly mount beam 1724. A brake assembly 2245 is appropriately mounted upon the brake shaft 2236 and adjacent to the left hand brake shaft bearing 2240. A brake arm 2247 mounted on the housing of the brake assembly 2245 is attached to the power assembly mount plate 2242. The brake assembly 2245 provides a drag on the brake shaft. An input brake shaft sprocket 2246 is fixedly attached upon the brake shaft 2236 and laterally located between the brake assembly 2245 and the power input sprocket 2224. The input brake shaft sprocket 2246 cooperates with a short power chain 2248 that in turn communicates with a hydraulic motor sprocket 2250.

The hydraulic motor sprocket 2250 is fixedly attached to the output shaft of a hydraulic motor 2252. The hydraulic motor 2252 is fixedly attached to a face plate mount 2253 that incorporates a clear hole in the center threrof, and which provides for clear passage of the shaft of the hydraulic motor 2252. The input and output edges of the face plate mount 2253 are rigidly affixed between the right hand extremities of a pair of motor box side plates 2254 (FIG. 20) that is in turn rigidly affixed in a perpendicular orientation upon the right hand face of the power assembly mount plate 2242. The mount box of the hydraulic motor 2252 is positioned at the input end of the power assembly mount plate 2242. Therefore, as the hydraulic motor is operated, in either direction, power is transferred to the brake shaft 2236.

Referring now to FIG. 32, the portion of the elevator chain 2218 that extends vertically between the power input sprocket 2224 and the top elevator sprocket 2222 would interfere with the tipover pivot shaft 1888, but is prevented from doing so by an elevator idler sprocket 2257. The elevator idler sprocket 2257 is rotatably mounted upon the tipover pivot shaft 1888 and is held in proper lateral alignment by a pair of shaft collars 2255, as is shown in FIG. 29.

The elevator chain 2218 begins and terminates its circuit about the top, power and bottom sprockets 2222, 2224 and 2220, respectively, within the pair of chain lugs 2118 of the packing elevator 34 as is shown in FIG. 36. Each end of the elevator chain 2218 is affixed to its respective member of the pair of chain lugs 2118 in identical manner but in opposing directions. The free extremity of the lower portion of the elevator chain 2218 is pinned to a flat end 2256 of a threaded rod 2258 in the same manner as each link of the chain is pinned together. The flat end 2256 is formed by grinding away material from each side of the threaded rod 2258 until the end thereof appears as is shown in FIG. 35, and is narrow enough to accept the end of the open chain link. Each of the threaded rods 2258 passes through a clear hole in the lower extremity of the associated one of the pair of chain lugs 2118 and is fixedly and adjustably held therein by a pair of chain adjustment nuts 2260. By adjusting the two threaded rods 2258 in opposition to each other, proper tension can be produced in the elevator chain 2218.

The mechanical mountings of the limit switches that are associated with the packing elevator 34 and the elevator incline 36 are shown in FIGS. 29 and 31. The limit switch LS-11 is fixedly attached to, but laterally adjustable upon, the output surface of a dual function mount plate 2261. The lower end of the dual function mount plate 2261 is fixedly attached to, but vertically adjustable upon, the input face of the incline brace 1706 of the case section frame assembly 44. A switch arm and roller 2262 extends to the right from, and in the input direction from, the head of the limit switch LS-11 to be actuated by the limit switch trip plate 2132 of the packing elevator 34 as previously described.

The hydraulic valve HV-2 is shown in FIGS. 25 and 29 and is fixedly attached upon the upper surface of a valve mount plate 2264 that is in turn rigidly affixed along its input end upon the top edge of a cantilever valve mount 2266. The lower end of the cantilever valve mount 2266 is rigidly affixed to the output surface of the lateral mount bar 1982 of the top rail mount assembly 1980 at a lateral location so that the working end of the hydraulic valve HV-2 can cooperate with a hydraulic valve trip 2268 (FIGS. 35 and 36) of the packing elevator 34. Referring to FIGS. 35 and 36, the hydraulic valve trip 2268 is rigidly affixed in a perpendicular orientation along the right hand output edge of the upper member of the pair of chain lugs 2118.

The limit switch LS-6 (FIGS. 29 and 31) is fixedly attached upon the input surface of a lateral mount plate 2269, that is in turn rigidly affixed along its left hand edge to the central portion of the right hand edge of an incline slide plate 2270. The incline slide plate 2270 incorporates a lengthy slot 2272 that permits it to be fixedly but adjustably attached to the input face of the left hand incline riser 1704L at a point adjacent to the top longitudinal beam 1721 of the case pushoff assembly framework. The lengthly slot 2272 also permits the limit switch LS-6 a considerable degree of adjustment along the length of the left hand incline riser 1704L. A switch arm and roller 2274 of limit switch LS-6 extends laterally to the right therefrom to cooperate with the lower left hand edge of the left hand member of the pair of long mount plates 2114 (FIG. 35) of the packing elevator 34.

The limit switch LS-10 (FIGS. 29 and 31) is fixedly attached upon a small mount plate 2276 that is in turn fixedly attached across the input surface of the lateral mount bar 1982 of the middle rail mount assembly 1978. The small mount plate 2276 is laterally positioned so as to place the limit switch LS-10 in the middle of the elevator incline 36 so that the dual switch arm and roller 2277 thereof can cooperate with the limit switch trip plate 2132 of the packing elevator 34.

The limit switches LS-1 and LS-1A are opposedly and fixedly mounted upon the input surface of a long cantilever mount plate 2278, as shown in FIGS. 68 and 70. The upper end of the long cantilever mount plate 2278 rigidly incorporates along its right hand edge a small vertical plate 2280 that is in turn rigidly affixed to the left hand edge of a plate spacer 2282. The plate spacer 2282 extends a small distance to the right of the small vertical plate 2280 and is rigidly affixed to the left hand side of a large slide block 2284 as can be seen in FIG. 32.

The large side block 2284 is slidably mounted upon a switch slide rod 2286 that passes through a clear hole in the input end thereof. The switch slide rod 2286 is fixedly held at each end between the upper ends of a pair of swtich jack screw mounts 2288. Each member of the pair of switch jack screw mounts 2288 incorporates an outwardly extending tab 2290 that is rigidly affixed thereto. The pair of switch jack screw mounts 2288 extends downwardly and in the output direction to rotatably incorporate at the lower end therebetween, a switch jack screw 2292. The switch jack screw 2292 is threadably mounted through the lower end of the large slide block 2284. The upper end of the switch jack screw 2292 extends upwardly through the upper member of the pair of switch jack screw mounts 2288 to fixedly incorporate a crank handle 2294.

The two outwardly extending tabs 2290 are fixedly attached to the right side of a pair of incline mounts 2296. Each member of the pair of incline mounts 2296 is rigidly affixed in parallel and spaced alignment with each other by a pair of end spacers 2298 so as to form a slot 2300 along its entire length. The output member of the pair of incline mounts 2296 is rigidly affixed across the input surfaces of the lateral mount bars 1982 of the bottom and middle rail mount assemblies 1976 and 1978, respectively, as is seen in FIG. 31. Referring to FIG. 29, the pair of incline mounts 2296 is laterally positioned to the left side of the right hand rail 1974 so that the working extremities of the limit switches LS-1 and LS-1A cooperate with the limit switch trip plate 2132 of the packing elevator 34.

Therefore, rotation of the crank handle 2294 (FIG. 32) of the switch jack screw 2292 will cause the large slide block 2284 to move appropriately along the switch slide rod 2286, thus carrying with it the plate spacer 2282, the small vertical plate 2280, the long cantilever mount plate 2278, and finally the limit switches LS-1 and LS-1A. The plate spacer 2282 extends through the slot 2300 so that interference with a lateral mount bar 1982 does not occur. This affords a large degree of vertical adjustment to these switches that is necessary to compensate for considerable variation in the sizes of the various cases 1288 that can be handled in this machine.

The limit switch LS-4 (FIGS. 29 and 31) is fixedly attached to a short cantilever mount 2302 that is in turn rigidly affixed to the input surface of the lateral mount bar 1982 of the bottom rail mount assembly 1976. The limit switch LS-4 is laterally aligned so that the long switch arm and roller 2304 thereof (FIG. 29) can cooperate with the lower edge of the left hand member of the pair of long mount plates 2114 of the packing elevator 34 (FIG. 35).

The case pushoff assembly 38 is shown in FIGS. 29, 30 and 32. The case pushoff assembly 38 is comprised of a pusher mounting assembly 2306, pusher arm assembly 2308, and a pusher plate assembly 2310. The pusher mounting assembly 2306 is shown specifically in FIGS. 29 and 30 and is mounted upon the top longitudinal beam 1721, the pushoff riser 1720, and the lower longitudinal beam 1722 of the case section frame assembly as was previously described.

The pusher mounting assembly 2306 is comprised of a pair of outboard risers 2312 and a pair of inboard risers 2314. The individual members of the vertically disposed pair of outboard risers 2312 are rigidly held in longitudinal spaced relationship with each other by a top mount bar 2316, a middle mount plate 2318, and a bottom box beam 2320. A cylinder cantilever mount plate 2321 is rigidly affixed to the bottom surface of the bottom box beam 2320, and extends outboardly from the center thereof. The individual members of the vertically disposed pair of inboard risers 2314 are rigidly held in longitudinal and parallel spaced relationship with each other by an upper mount bar 2322 and a lower mount bar 2324. The pair of outboard risers 2312 is fixedly clamped to the left hand surfaces of the top longitudinal beam 1721 and the lower longitudinal beam 1722 by a pair of top spacer bolts 2325 and a pair of bottom spanner bolts 2327, that reach laterally across the beams to fixedly clamp the pair of inboard risers 2314 to the right hand surfaces of the top and lower longitudinal beams 1721 and 1722, respectively. Each bolt of the pair of top spanner bolts 2325 passes through clear holes in the top and upper mount bars 2316 and 2322, respectively. Each bolt of the pair of bottom spanner bolts 2327 passes through clear holes in the middle mount plate 2318 and the lower mount bar 2324.

The pusher arm assembly 2308 incorporates a ram 2326 that is moved horizontally and laterally across the lower end of the elevator incline 36. The ram 2326 is actuated by a pusher cylinder 2328 that is pivotally mounted at its lower extremity to the unsupported end of the cylinder cantilever mount plate 2321. The upper end of, or the working end of, the pusher cylinder 2328 is pivotally mounted to the connecting member of a cylinder mount 2330 (FIG. 30). The cylinder mount 2330 is fixedly but adjustably mounted between the pair of primary actuation arms 2332 by a set of four bolts 2333 (FIG. 29) that passes through a pair of washer plates 2335, then through a set of four slanted slots 2334 in the primary actuation arms 2332 to threadably mount into the extremities of the cylinder mount 2330. The individual members of the pair of primary actuation arms 2332 are held in spaced parallel relationship by a pair of cross tubes 2336 that is rigidly affixed between the ends thereof. The inboard end of the pair of primary actuation arms 2332 is pivotally mounted on a primary pivot shaft 2338 that is fixedly attached between the pair of outboard risers 2312 just above the lower longitudinal beam 1722, as is shown in FIG. 29, but not shown explicitly in FIG. 30. Rigidly affixed to the outer surfaces of, and at the inboard end of, the pair of primary actuation arms 2332 and concentric with the primary pivot shaft 2338, is a pair of secondary arm spacers 2340.

Also pivotally mounted upon the primary pivot shaft 2338 is a pair of secondary actuation arms 2342, that is in turn rigidly affixed to the outer surfaces of the pair of secondary arm spacers 2340. A pair of spacer bushings 2343 is rigidly affixed to the outer surfaces of the pair of secondary actuation arms 2342 and in axial alignment with the pair of secondary arm spacers 2340 to provide proper alignment of a rigid right angle assembly upon the primary pusher shaft 2338 (FIG. 30). The pair of primary actuation arms 2332 and the pair of secondary actuation arms 2342 form the rigid right angle assembly (FIG. 29), so that when the working end of the pusher cylinder 2328 rises, the assembly will pivot clockwise about the primary pivot shaft 2338. This swings the upper end of the pair of secondary actuation arms 2342 in an arc about the primary pivot shaft 2338.

The upper end of the pair of secondary actuation arms 2342 is rigidly affixed about the ends of a primary pusher shaft 2344 (FIG. 29), that is in turn pivotally mounted through the center of a pair of primary pusher arms 2345. The individual elements of the pair of primary pusher arms 2345 are held in rigid parallel alignment with each other by a pair of cross members 2346 (FIG. 30) of tubular nature. Rigidly affixed to the outer surfaces of, and in axial alignment with the lower member of the pair of cross members 2346, is a pair of short spacers 2347, and in the same manner, a pair of long spacers 2349 is rigidly affixed in relationship to the upper member of the pair of cross members 2346. The lower member of the pair of cross members 2346 and the pair of short spacers 2347 are in concentric communication with the primary pusher shaft 2344 and serve to hold the pair of primary pusher arms 2345 in centered relationship between the pair of secondary actuation arms 2342. Similarly, the upper member of the pair of cross members 2346 and the pair of long spacers 2349 are in fixed concentric communication with an outboard riser shaft 2348 (FIG. 29), and serve to hold the upper ends of the pair of primary pusher arms 2345 in centered relationship between the pair of outboard risers 2312.

The ends of the outboard riser shaft 2348 are fitted with a pair of cam rolls 2351 that is in turn fixedly held thereupon by a pair of nuts 2353 (FIG. 30). The pair of cam rolls 2351 runs vertically within the confines of a pair of outboard riser slots 2350. Therefore, as the upper end of the pair of secondary actuation arms 2342 swings through its arc toward the elevator incline 36, the pair of cam rolls 2351 will rise within the pair of outboard riser slots 2350 until the pair of primary pusher arms 2345 has swung past the pair of outboard risers 2312, then they will move downward. This cyclic motion of the upper ends of the pair of primary pusher arms 2345 permits the lower extremity thereof to move along a substantially straight and horizontal line.

The lower extremity of the pair of primary pusher arms 2345 fixedly incorporates a ram shaft 2356, that is in turn pivotally mounted through the left hand extremity of the ram 2326. The ram 2326 incorporates a pair of shaft spacers 2358, that is rigidly affixed to both sides thereof and concentric with the ram shaft 2356, to maintain its centered position with respect to the pusher arm assembly 2306.

A pair of stabilizer actuation arms 2352 and a pair of stabilizer pusher arms 2354 are mounted to the pair of inboard risers 2314, to the ram 2326, and to each other in substantially the same manner as, but in parallel relation to, the pair of secondary actuation arms 2342 and the pair of primary pusher arms 2345, except for the following difference. The lower extremity of the pair of stabilizer actuation arms 2352 is pivotally attached to the lower extremity of the pair of inboard risers 2314, and is not attached to an actuation assembly. This stationary attachment plus the parallel nature of the pusher arm assembly 2308 requires that the ram 2326 remain in a horizontal attitude.

The pusher plate assembly 2310 is shown in FIGS. 29 and 32 and is comprised of a back plate 2360, a face plate 2362, an input box brace 2364, a middle box brace 2366 and an output box brace 2368. The inboard extremity of the ram 2326 is rigidly affixed in a perpendicular orientation to the center of the back plate 2362. The face plate 2362 is rigidly affixed to the right hand face of the back plate 2362 in a skewed orientation so as to be aligned parallel and perpendicular to the elevator incline 36. The input box brace 2364 is of bar stock and is rigidly affixed across the input side of the right hand surface of the face plate 2362. The input brace extends upwardly beyond the face plate 2362 to accommodate the dimensions of the largest cartons that can be processed in the case handling assembly 14, but does not extend downwardly therefrom since it would interfere with portions of the output tipover assembly 40 to be described hereinafter. The middle box brace 2366 is rigidly affixed across the middle of the face plate 2362 and parallel to the input box brace 2364. The middle box brace 2366 extends downwardly a short distance beyond the face plate 2362 to accommodate the input end of the case 1288. The output box brace 2368 is rigidly affixed across the right hand face of, and along the output side of, the face plate 2362 and extends upwardly and downwardly beyond the face plate 2362 to accommodate the entire length of any size case 1288. In this manner, the case 1288 receives a uniform lateral push that translates it off the set of three base rollers 2142 and the back plate 2116 of the packing elevator 34.

The structural mounting of the limit switch LS-5 is shown primarily in FIG. 30 and secondarily in FIG. 29. The limit switch LS-5 is fixedly attached to a switch mount plate 2370 that is in turn rigidly affixed to the output surface of the output member of the pair of outboard risers 2312, and just above the lower longitudinal beam 1722. Pivotally attached to the working end of the limit switch LS-5 is an extension shaft 2372. Fixedly attached to the unsupported end of the extension shaft 2372 is a switch arm and roller 2374 that cooperates with one of the primary actuation arms 2332. When the ram 2326 is fully advanced, the limit switch LS-5 is actuated, thereby making the proper circuit to return the pushoff as previously described.

The limit switch LS-3 is fixedly attached to a mount plate 2376 that is in turn rigidly affixed to the output surface of the output member of the pair of outboard risers 2312. The mount plate 2376 holds the limit switch LS-3 outboardly in such a position so that a switch arm and roller 2378 thereof can cooperate with the bottom edge of the output member of the pair of primary actuation arms 2332. As the pair of primary actuation arms 2332 moves up and down, it operates the limit switch LS-3.

As the case 1288 translates laterally to the right, it leaves the packing elevator 34 by means of the pushoff assembly 38 and passes over a ramp assembly 2380 before coming to rest upon the output tipover assembly 40. The ramp assembly 2380 is shown in FIGS. 29 and 32, and comprises a ramp 2381 and a set of three risers 2382. The ramp 2381 is rigidly affixed upon the input, or upper extremities of the set of three risers 2382, the lower extremities of which are rigidly affixed to the outboard surface of the right hand incline riser 1704. The set of three risers 2382 extends in the input direction and upwardly in a perpendicular orientation to the input surface of the right hand incline riser 1704. The set of three risers 2382 are rigidly affixed to the output surface of, and along the right side of, the ramp 2381 so that the left edge thereof is unsupported. The left edge of the ramp 2381 incorporates a downward bend to insure that the case 1288 will ride up on the top thereof and not jam against its left hand edge. The top end of the ramp 2381 also incorporates a bend in the output direction that insures that wide cases 1288 coming down the packing elevator 34 do not jam against the top edge of the ramp 2381.

Figure 40:
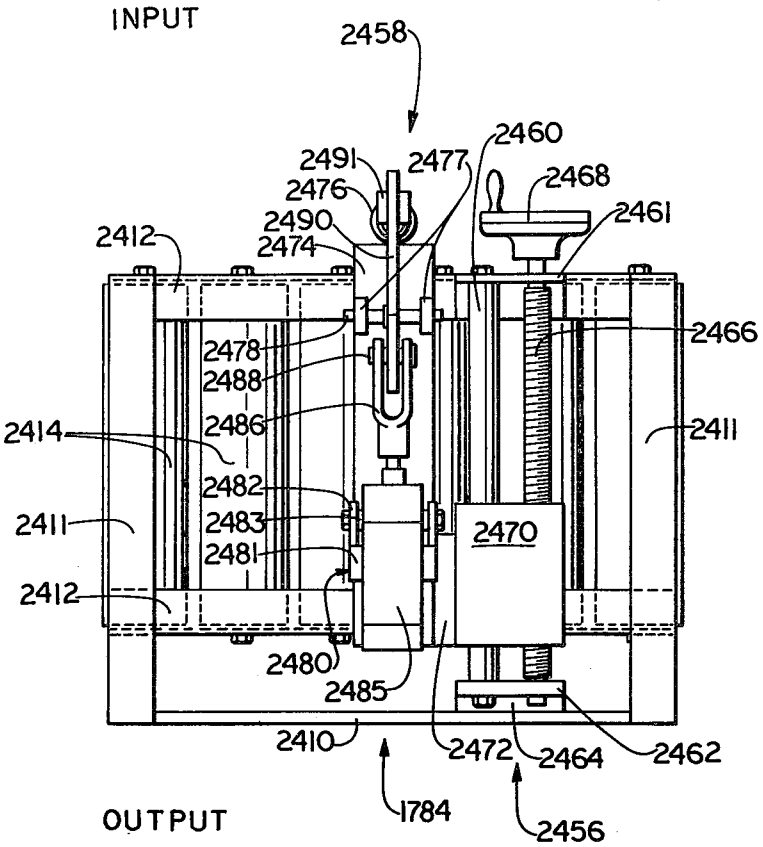
FIG. 40 is a bottom view of the output tipover assembly looking in the direction of the arrows 40—40 in FIG. 38.

The output tipover assembly 40 is shown in FIGS. 78 to 40 inclusive, and is comprised of a pivot mounting assembly 2384, a tipover mechanism 2386, an output tipover frame assembly 2388, and the output flap folder assembly 1784.

The pivot mounting assembly 2384 (FIGS. 38 and 39) is comprised of a standoff box mount 2390, a pair of tipover bearing mount plates 2391, a pair of output tipover bearings 2392, and an output tipover shaft 2393. The tipover shaft 2393 is pivotally mounted in the pair of output tipover bearings 2392 that is in turn fixedly attached to the inboard surfaces of the pair of tipover bearing mount plates 2391. The right hand member of the pair of tipover bearing mount plates 2391 is rigidly affixed to the inboard surface of the short incline riser 1717 and adjacent to the intersection of the output tipover riser 1716, as is shown in FIG. 39. The left hand member of the pair of tipover bearing mount plates 2391 is rigidly affixed to the right hand surface of the standoff box mount 2390 that is in turn rigidly affixed to the right hand surface of the right hand incline riser 1704 and adjacent to the intersection of the left hand output tipover riser 1718.

The output tipover frame assembly 2388 is rigidly affixed to the tipover mechanism 2386 that is in turn rigidly affixed to the output tipover shaft 2393. More specifically, the output tipover frame assembly 2388 is rigidly affixed to a tipover mount plate 2394 that is in turn rigidly affixed to the input edges of a pair of tip arms 2396. Referring to FIGS. 38 and 39, the pair of tip arms 2396 extend upwardly and in the output direction to the output tipover shaft 2393, to which it is fixedly attached. Each one of the pair of tip arms 2396 is laterally spaced upon the output tipover shaft 2393 so that they are adjacent to each one of the pair of output tipover bearings 2392. The upper extremity of the pair of tip arms 2396 is held in rigid spaced relationship by a lateral stiffener plate 2395, fixedly attached to the upper input edge thereof. A cylinder torque arm 2398 is fixedly attached to the center of the output tipover shaft 2393 and rigidly incorporates at its output end, a cylinder lug 2400. The cylinder lug 2400 pivotally cooperates with a cylinder clevis 2401 that is fixedly attached to the working end of an output tipover cylinder 2402. The lower extremity of the output tipover cylinder 2402 is pivotally attached to a base lug 2404 that is in turn rigidly affixed to the horizontal flange of a heavy angle mount 2405. The heavy angle mount 2405 is rigidly affixed to the right hand side of the right hand base stringer 1682. As can be seen by comparing FIGS. 1 and 76, room has been left for the jack screw adjustment and holding assembly 1740 that is not shown in FIG. 38.

The output tipover frame assembly 2388 incorporates a right hand angle support 2406 and a left hand angle support 2408 that are rigidly affixed to the input surface of, and along the ends of, the tipover mount plate 2394, as is shown in FIGS. 38 and 39. Rigidly affixed across the lower output surfaces of the right and left hand angle supports 2406 and 2408 respectively, is a base brace 2410. Referring now to FIGS. 38 and 40, the bottom of the output tipover frame assembly 2388 incorporates a pair of bottom braces 2411, that is longitudinally disposed and rigidly affixed at its output end to the bottom extremity of the right and left hand angle support 2406 and 2408, respectively, and the base brace 2410. A pair of roller mount angles 2412 is rigidly affixed across the pair of bottom braces 2411, one member at the input end thereof, the other near the output end thereof. The mostly upright flanges of the pair of roller mount angles 2412 are widely spaced while the transverse flanges thereof extend toward each other. The mostly upright flanges of the pair of roller mount angles 2412 provide mounting structure for a set of six bottom rollers 2414 that is rotatably mounted therebetween to provide, upon entry, a substantially frictionless receiving surface to the filled case 1288.

The flanges of the right and left hand angle supports 2406 and 2408 (FIGS. 38 and 39) are also widely spaced to provide mounting structure for sets of rollers that provide a substantially frictionless surface for the filled case 1288 that is leaving the output tipover assembly 40. Referring to FIG. 38, a set of three lower back rollers 2416 is rotatably mounted between the outer flanges of the right and left hand angle supports 2406 and 2408, respectively, and is located at the lower ends thereof and adjacent to the output ends of the set of six bottom rollers 2414. Directly above the set of three lower back rollers 2416 and also mounted between the right and left hand angle supports 2406 and 2408, respectively, is a LS-14B switch roller assembly 2418 to be described hereinafter. Directly above the LS-14B switch roller assembly 2418 is a set of five upper back rollers 2420, each roller thereof being evenly spaced and rotatably mounted between the upper portions of the right and left hand angle supports 2406 and 2408, respectively. Mounted between the upper extremities of the right and left hand angle supports 2406 and 2408 respectively is a LS-14A switch roller assembly 2422 that is substantially similar to the structure of the LS-14B switch roller assembly 2418 to be described herein.

Figure 37:
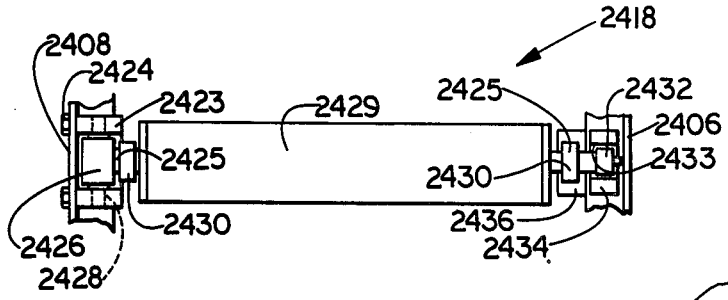
FIG. 37 is a view of a switch roller looking in the direction of the arrows 37—37 in FIG. 38.

The LS-14B switch roller assembly 2418 is shown in FIGS. 37 and 38 and incorporates a yoke mount 2423 that is fixedly attached to the inside surfaces of the left hand angle support 2408 by a pair of bolts 2424 that in turn passes through clear holes in the vertical flange of the left hand angle support 2408 and threadably mount into the side of the lower portion of the yoke mount 2423. The left extremity of a switch roller shaft 2425 is rigidly affixed within a pivot mount 2426. The pivot mount 2426 fixedly incorporates, at right angles to the switch roller shaft 2425, short pivot shaft portions 2428 that extend from both sides thereof. The short pivot shaft portions 2428 are pivotally mounted between the tines of the yoke mount 2423 and provides a pivotal degree of freedom for the switch roller shaft 2425 that permits the right end thereof to raise and lower as necessary. A switch roller 2429 is rotatably mounted upon the switch roller shaft 2425 and is held in lateral place thereupon by a pair of shaft collars 2430 that is fixedly attached thereto.

The right extremity of the switch roller shaft 2425 incorporates a bearing 2432 that cooperates with an open end slot 2433 of a right hand bearing retainer 2434. A spring plate 2436 is fixedly attached to the output surface of the right hand angle support 2406, directly opposite the right hand bearing retainer 2434, by a pair of bolts 2437. The pair of bolts 2437 passes through clear holes in the spring plate 2436 and the lateral flange of the right hand angle support 2406 to threadably mount into the lower end of the right hand bearing retainer 2434, thereby securing both at the same time. The spring plate 2436 extends inwardly under the right hand member of the pair of shaft collars 2430 and incorporates a clear hole in vertical line therewith. As seen in FIG. 38, a spring pin 2438 passes through the clear hole of the spring plate 2436 and is rigidly affixed in the right hand member of the pair of shaft collars 2430. A reset spring 2440 is coaxially mounted upon the spring pin 2438, between the right hand member of the pair of shaft collars 2430 and the spring plate 2436 to forcefully push the switch roller 2429 outwardly. The spring pin 2438 is prevented from leaving the confines of the spring plate 2436 by a detent nut 2441.

The limit switch LS-14B is fixedly suspended from the output face of a cantilever mount plate 2442 whose upper end is rigidly affixed to the input surface of the tipover mount plate 2394 and adjacent to the right hand member of the pair of tip arms 2396 (FIG. 39). A switch arm and roller 2444 of the limit switch LS-14B extends upwardly (FIG. 38) so that the roller thereof is in rolling contact with the output side of the right hand end of the switch roller 2429. In this way, the switch roller 2429 is depressed when the case 1288 is in place, rotating the switch arm and roller 2444 of the limit switch LS-14B clockwise. As the case 1288 leaves the output tipover assembly 40, the reset spring 2440 raises the switch roller 2429 permitting the switch arm and roller 2444 to reset in the counterclockwise direction.

The limit switch LS-14A is fixedly attached to the output surface of a lateral switch mount 2446, that is in turn fixedly and adjustably attached to the output surface of the right hand angle support 2406 by a pair of cap screws 2448 that passes through a pair of clear slots 2450 in the right end thereof, and threadably mount in the right hand angle support 2406. The lateral switch mount 2446 is attached adjacent to the spring plate 2436 of the LS-14A switch roller assembly 2422 so that a laterally disposed switch arm and roller 2452 of the limit switch LS-14A can communicate with the output end of the spring pin 2438 of the LS-14A switch roller assembly 2422. Both the LS-14B and LS-14A switch roller assemblies 2418 and 2422, respectively, provide for actuation of the limit switches LS-14B and LS-14A no matter how wide or narrow the case 1288 may be.

The limit switch LS-8 is fixedly attached to the left side of a vertically disposed limit switch mount plate 2451 (FIGS. 38 and 39) that is in turn rigidly affixed to the inboard surface of the outboard longitudinal beam 1712. The limit switch LS-8 is longitudinally positioned so that a switch arm and roller 2454 of the limit switch LS-8 can be engaged by the output surface of the base beam 2410 to signal that the output tipover assembly 40 is in the untipped position.

The flap folder assembly 1784 is shown in FIGS. 38 and 40 and is comprised of a jack screw slide rod mount assembly 2456 and a folder assembly 2458. The jack screw slide rod mount assembly 2456 incorporates a short slide rod 2460 that is fixedly attached between an input angle bracket 2461 and an output plate bracket 2462. The input angle bracket 2461 is rigidly affixed to the lower surface of the input member of the pair of roller mount angles 2412 and located toward the right side thereof (FIG. 40). The output plate bracket 2462 is rigidly affixed to a plate spacer 2464 that is in turn rigidly affixed to the input surface of the base brace 2410 and laterally aligned with the input angle bracket 2461. The short slide rod 2460 is fixedly attached between the left sides of the input angle bracket 2461 and the output plate bracket 2462, while a short jack screw 2466 is rotatably mounted through their right sides. The input end of the short jack screw 2466 fixedly incorporates a crank handle 2468 for manual adjustment of a slide mount block 2470 that is slidably mounted on the short slide rod 2460 and threadably mounted upon the short jack screw 2466.

Rigidly affixed to the upper surface of the slide mount block 2470 is a lateral extension plate 2472 that extends toward the center of the output tipover assembly 40. Rigidly affixed along the left hand edge of the lateral extension plate 2472 is a folder base plate 2474 that extends toward the input end of the output tipover assembly 40. When the slide mount block 2470 is fully retracted, the folder base plate 2474 just overhangs the input member of the pair of roller mount angles 2412 and there incorporates an eyelet mount 2475 (FIG. 38) that extends upwardly therefrom. The eyelet mount 2475 threadably incorporates a rod eyebolt 2476 that extends in the input direction therefrom. Rigidly affixed to the lower surface of the folder base plate 2474 is a pair of pivot mount arms 2477 that is located toward the input end thereof and extend downwardly to fixedly incorporate a folder pivot pin 2478 at the bottom thereof. Also rigidly affixed across the lower surface of the folder base plate 2474 is a cylinder pivot mount 2480, that is located near the output end thereof.

The cylinder pivot mount 2480 is comprised of a lateral brace 2481, a pair of pin lugs 2482 and a cylinder mount pin 2483. The pair of pin lugs 2482 is vertically disposed and rigidly affixed to the input edge of, and at the corners of, the lateral brace 2481 in such position that the cylinder pivot mount 2480 will lay flush against the folder base plate 2474. The cylinder mount pin 2483 is fixedly attached between the pair of pin lugs 2482 with clearance to accommodate a side mount lug 2484 of a folder cylinder 2485. The folder cylinder 2485 is free to pivot a certain degree in the vertical plane.

The working end of the folder cylinder 2485 fixedly incorporates a deep yoke 2486 that fixedly incorporates through the end thereof, a yoke pin 2488 (FIG. 40). The yoke pin 2488 is pivotally mounted through the output end of an L-shaped actuator bracket 2490 (FIG. 38). The vertex of the L-shaped actuator bracket 2490 is pivotally mounted to the folder pivot pin 2478, and the input end thereof pivotally incorporates a rod yoke 2491. A folder rod 2492 is fixedly attached to the rod yoke 2491 and extends upward through a universal bushing 2494 that is inserted within the eye of the rod eyebolt 2476. In this manner, the folder cylinder 2485 retracts, which swings the L-shaped actuator bracket 2490 in a clockwise direction (FIG. 38), which pushes the folder rod 2492 upward against the input flap 1764 of the case 1288 and closes it. The bushing 2494 of the rod eyebolt 2476 permits the folder rod 2492 to change its angle of alignment therewith as the rod yoke 2491 moves through the arc defined by the motion of the input end of the L-shaped actuator bracket 2490.

Referring to FIG. 33, the output flap folder 1785 is comprised of a plate belt 2496 that is suspended from a packing assembly bracket 2498 to an elevator incline bracket 2500. The packing assembly bracket 2498 is comprised of a mount foot 2501 and a lateral standoff bar 2502. The left extremity of the lateral standoff bar 2502 is rigidly affixed to the mount foot 2501 in a perpendicular orientation. The mount foot 2501 is fixedly attached to the outboard surface of, and near the top edge of, the right hand member of the pair of pack assembly side plates 1015. The outboard extremity of the lateral standoff bar 2502 incorporates a pin lug 2504 to which is pivotally mounted the input end of the plate belt 2496. The output end of the plate belt 2496 is pivotally mounted upon a standoff rod 2506 (FIG. 34) that is cantilever mounted in the lateral direction from the input end of a pair of spanner mounts 2507. The pair of spanner mounts 2507 is fixedly clamped to the right and left hand surfaces of the right hand incline riser 1704 by a pair of spanner bolts 2508. The elevator incline bracket 2500 is located just below the incline brace 1706 of the case section frame assembly 44. The belt 2496 is thereby disposed laterally to the right a sufficient distance so that it will coincide with the centerline of most of the various size cases 1288 that are processed in the case handling assembly 14. The plate belt 2496 is formed of a plurality of plates 2510 hinged together. A weight 2509 is fixedly attached upon the plate belt 2496 by fasteners 2512 which are threaded in bores 2513 in the weight 2509 and extend through bores 2514 in the plates 2510. The weight 2509 causes the portions of the belt on either side of the weight to assume nearly straight lines, with that portion thereof from the weight to the packing assembly bracket 2498 assuming a very slight arc. The weight 2509 is the low point of the belt, which provides that the free end of the output end flap 1766 of the case 1288 will be gradually rotated closed by sliding down the belt to the weight 2509. The end flaps 1764 and 1766 stay in place to a degree that will permit subsequent automatic case sealing as the case 1288 leaves the output tipover assembly 40. The underside of the belt 2496 is substantially smooth so that it does not catch and open the closed input end flap 1764C as is shown in FIG. 33.

For additional details of structure and operation, reference is made to the aforementioned U.S. Pat. No. 4,064,675 of which this is a division.

The machine which has been described above and which is illustrated in the drawings is subject to structural modification without departing from the spirit and scope of the appended claims.

Having described our invention, what we claim as new and desire to secure by letters patent is:

1. In combination, a case elevator, means for supporting a case on the case elevator with an open side of the case sloping and exposed, means for directing flat articles into the case transversely of the open side to form a stack inside the case, a tongue engaging the stack as the stack increases in size, means controlled by the tongue for lowering the case as the articles are projected into the case so that the level of the upper end of the stack remains substantially constant, means for withdrawing the tongue when the stack has reached a predetermined size, a hold down and pusher member, and means for advancing the hold down and pusher member into engagement with an upper portion of the stack when the stack has reached the predetermined size to hold the articles of the stack in the case as the tongue is being withdrawn.

2. A combination as in claim 1 wherein the hold down and pusher member is advanced toward the open side of the case adjacent to the tongue to advance articles of the upper portion of the stack into the case before the tongue is withdrawn.

3. In combination, a case elevator, means for supporting the case elevator for advancing along a sloping path, a conveyor above the elevator, means for supporting a case on the conveyor, means for advancing the conveyor to bring the case to a tipover station overlying the elevator, a case input tipover frame receiving the case at the tipover station, a case hold down frame mounted on the case input tipover frame, means for moving the hold down frame between a released position and a hold down position at which the hold down frame holds the case on the case input tipover frame, means for mounting the case input tipover frame for swinging to advance the case from the conveyor to the elevator, means for releasing the hold down frame when the case is on the elevator, the elevator supporting the case with an open side of the case sloping and exposed, and means for directing flat articles into the case transversely of the open side to form a stack in the case.

4. A combination as in claim 3 which includes a case stop pivotally mounted on the case input tipover frame and engageable by the case when the case is on the case input tipover frame, means urging the case stop to case engaging position, the case stop holding the case on the case input tipover frame during movement of the hold down frame to hold down position and means for swinging the case stop to a released position when the case is on the elevator.

5. In combination, a case elevator, means for supporting a case on the case elevator with an open side of the case sloping and exposed, the case having an output flap at an upper edge of the open side, means for directing articles into the case to fill the case, a case output tipover frame, means for transferring the case to the case output tipover frame, means for swinging the case output tipover frame between a lowered position and a raised position, an elongated belt, the belt extending lengthwise of the path of the upper flap, horizontally spaced means for supporting end portions of the belt above the path of the output flap, and a weight mounted on an upper side of the belt, the weight dividing the belt into a main flap engaging portion and a support portion, the output flap engaging the belt to be folded inwardly as the case output tipover frame swings upwardly.

6. In combination, a case elevator, means for supporting a case on the case elevator with an open side of the case sloping and exposed, means for directing flat articles into the case transversely of the open side to form a stack inside the case, a tongue engaging the stack as the stack increases in size, means controlled by the tongue for lowering the case as the articles are projected into the case so that the level of the upper end of the stack remains substantially constant, means for withdrawing the tongue when the stack has reached a predetermined size, the case elevator including a base portion for supporting a bottom of the case, and means for advancing the case transversely of the base portion when the case elevator is at a discharge position, the means for supporting the case on the case elevator including a flap holding device including spaced substantially parallel plate members mounted on the case elevator substantially parallel to and spaced from the base portion, the plate members engaging a lower flap of the case when the case is on the case elevator, the lower flap being advanceable transversely of the plate members when the case is advanced transversely of the base portion of the case elevator.

7. A combination as in claim 6 wherein there is means for advancing the case onto the case elevator at a case seating position, the lower flap advancing between the plate members as the case is advanced onto the case elevator.

8. In combination, a case elevator, means for supporting a case on the case elevator with an open side of the case sloping and exposed, means for directing flat articles into the case transversely of the open side to form a stack inside the case, a tongue engaging the stack as the stack increases in size, means controlled by the tongue for lowering the case as the articles are projected into the case so that the level of the upper end of the stack remains substantially constant, means for withdrawing the tongue when the stack has reached a predetermined size, the case elevator including a base portion for supporting a bottom of the case, and means for advancing the case onto the base portion when the case elevator is at a case seating position, the means for supporting the case on the case elevator including a flap holding device including spaced substantially parallel plate members mounted on the elevator substantially parallel to and spaced from the base portion, the plate members engaging a lower flap of the case when the case is on the case elevator, the lower flap being advanceable between the plate members when the case is advanced onto the base portion of the case elevator.

9. In combination, a case elevator, means for supporting a case on the case elevator with an open side of the case sloping and exposed, means for directing flat articles into the case transversely of the open side to form a stack inside the case, a tongue engaging the stack as the stack increases in size, means controlled by the tongue for lowering the case as the articles are projected into the case so that the level of the upper end of the stack remains substantially constant, means for withdrawing the tongue when the stack has reached a predetermined size, the case elevator including a base portion for supporting a bottom of the case, means for advancing the case onto the base portion when the case elevator is at a case seating position, and means for advancing the case transversely of the base portion when the case elevator is at a discharge position, the means for supporting the case on the case elevator including spaced case holding members mounted on and extending lengthwise of the base portion engageable with opposite sides of the case to hold the case on the base portion, and means for swinging one of the case holding members away from the side of the case when the case elevator is at the discharge position so that the case is advanceable transversely of the base portion when the case elevator is at the discharge position.

* * * * *